US011286083B2

(12) United States Patent
Lee et al.

(10) Patent No.: US 11,286,083 B2
(45) Date of Patent: Mar. 29, 2022

(54) PALLET WITH DECK OPENING AND BRACE

(71) Applicant: Rehrig Pacific Company, Los Angeles, CA (US)

(72) Inventors: Way Joe Lee, Marietta, GA (US); William P. Apps, Alpharetta, GA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 16/988,859

(22) Filed: Aug. 10, 2020

(65) Prior Publication Data

US 2021/0047074 A1 Feb. 18, 2021

Related U.S. Application Data

(60) Provisional application No. 62/948,419, filed on Dec. 16, 2019, provisional application No. 62/884,656, filed on Aug. 8, 2019.

(51) Int. Cl.
*B65D 19/18* (2006.01)
*B65D 19/44* (2006.01)

(52) U.S. Cl.
CPC ..... *B65D 19/18* (2013.01); *B65D 19/44* (2013.01); *B65D 2519/00034* (2013.01); *B65D 2519/00069* (2013.01); *B65D 2519/00139* (2013.01); *B65D 2519/00273* (2013.01); *B65D 2519/00288* (2013.01); *B65D 2519/00308* (2013.01); *B65D 2519/00572* (2013.01); *B65D 2519/00636* (2013.01); *B65D 2519/00796* (2013.01); *B65D 2519/00815* (2013.01)

(58) Field of Classification Search
CPC .... B65D 21/02; B65D 21/00; B65D 21/0209; B65D 21/0215; B65D 21/0224; B65D 21/023; B65D 2519/00935; B65D 19/44
USPC ..... 108/55.3, 55.5, 53.1
See application file for complete search history.

(56) References Cited

U.S. PATENT DOCUMENTS 2,321,063 A * 6/1943 Bohnke ..... B65D 85/64 206/320
4,000,704 A * 1/1977 Griffin, Jr. ..... B65D 19/004 108/53.1
RE29,192 E * 4/1977 Anderson ..... B65D 19/36 108/51.3
5,097,951 A * 3/1992 Pigott ..... B65D 19/44 108/55.3
5,507,237 A * 4/1996 Barrow ..... B65D 19/08 108/53.1

(Continued)

*Primary Examiner* — Jose V Chen
(74) *Attorney, Agent, or Firm* — Carlson, Gaskey & Olds, P.C.

(57) ABSTRACT

A pallet includes a deck having an opening therethrough, such that product can be removed through the opening from a box loaded on the deck of a pallet. A plurality of columns support the deck. The box may be supported on the deck over the opening. The bottom wall of the box may be opened though the opening in the deck. The items can then be removed from the box through the opening through the deck without removing the box from the pallet. Optionally, fasteners may secure flaps of the box in corners of the deck of a pallet. According to another feature, a brace having an elongated body portion can be secured to an opening of the pallet, such that the elongated body portion abuts goods that are supported on the deck.

25 Claims, 65 Drawing Sheets

(56) References Cited

U.S. PATENT DOCUMENTS

| | | | | |
|---|---|---|---|---|
| 6,126,002 | A * | 10/2000 | Brown | B65D 19/14 206/320 |
| 7,648,026 | B2 * | 1/2010 | Brittain | B65D 5/5054 206/320 |
| 8,146,515 | B2 * | 4/2012 | Trickett | B65D 19/36 108/55.5 |
| 8,191,489 | B1 * | 6/2012 | Smith | A47F 3/142 108/186 |
| 9,676,514 | B1 * | 6/2017 | Gamez | B65D 19/0069 |
| 2006/0213402 | A1 * | 9/2006 | Grimal | B65D 19/44 108/51.11 |
| 2007/0006783 | A1 * | 1/2007 | Braun | B65D 19/38 108/53.1 |
| 2008/0029421 | A1 * | 2/2008 | Trickett | B65D 5/005 206/503 |
| 2011/0132239 | A1 * | 6/2011 | Poulsen | B65D 19/44 108/55.1 |
| 2011/0179977 | A1 * | 7/2011 | Linares | B65D 19/0018 108/50.11 |
| 2011/0303129 | A1 * | 12/2011 | Harris | A47B 87/0215 108/53.1 |
| 2014/0151521 | A1 * | 6/2014 | Marrow | B65D 19/0002 248/346.03 |
| 2015/0158629 | A1 * | 6/2015 | Harris | A47B 47/028 108/53.3 |

* cited by examiner

PALLET WITH DECK OPENING AND BRACE

BACKGROUND

Pallets generally include a deck having an upper surface for supporting goods thereon. Columns support the deck above the floor so that fork tines or tines of a pallet jack can be inserted under the deck to lift and move the loaded pallet.

SUMMARY

A pallet according to one example disclosed herein includes a deck having an opening therethrough, such that product can be removed through the opening from a box loaded on the deck of a pallet. The opening is at least approximately ⅕ a width and at least approximately ⅕ a length of the deck. A plurality of columns support the deck.

In the example shown herein, the opening is approximately one quarter the width and length of the deck. A peripheral wall may extend downward from a periphery of the opening.

According to another feature, fasteners may secure flaps of the box in corners of the deck of a pallet. The fasteners may include corner caps configured to snap-fit to the deck and to sandwich flaps of the box to the deck.

The box may be supported on the deck over the opening. If the box contains items that are smaller than the opening, the bottom wall of the box may be opened though the opening in the deck. The items can then be removed from the box through the opening through the deck without removing the box from the pallet.

According to another feature, at least one brace includes an elongated body portion and a retainer portion extending transversely from the elongated body portion. The retainer portion can be secured to an opening of the pallet, such that the elongated body portion abuts goods that are supported on the deck. The elongated body portion may also extend downward to abut goods supported on the deck of a pallet stacked below.

DETAILED DESCRIPTION

Figure 1:
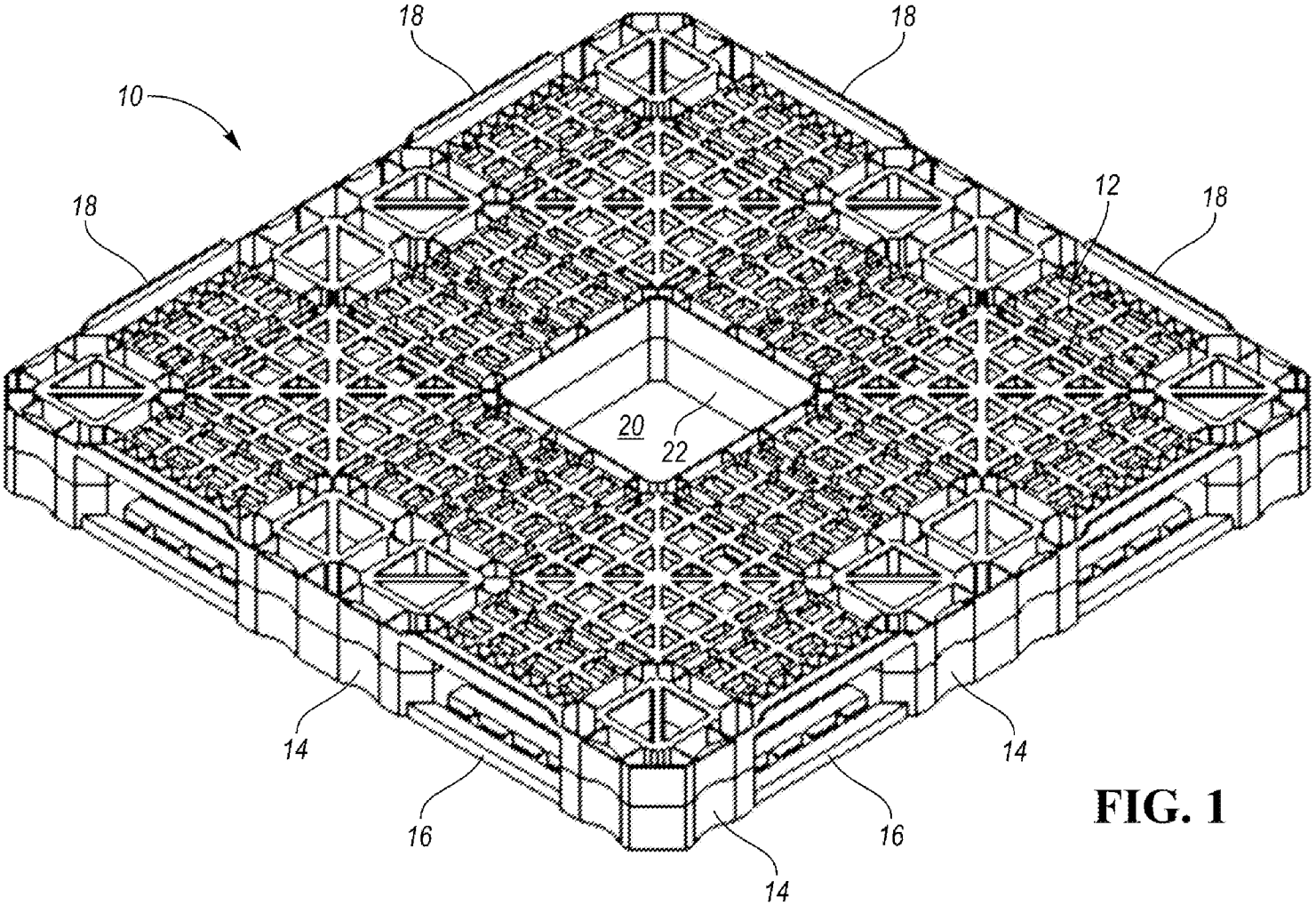
FIG. 1 is a perspective view of a pallet according to a first embodiment.

A pallet 10 according to a first embodiment is shown in FIG. 1. The pallet includes a deck 12 having an upper surface for supporting goods thereon. The deck 12 is supported above a floor by a plurality of columns 14, which optionally may be connected to one another by runners 16. A peripheral lip 18 is formed at the periphery of the deck 12 and interrupted by the columns 14. The pallet 10 is preferably injection molded of a suitable plastic, but it can be thermoformed or rotomolded.

Figure 3:
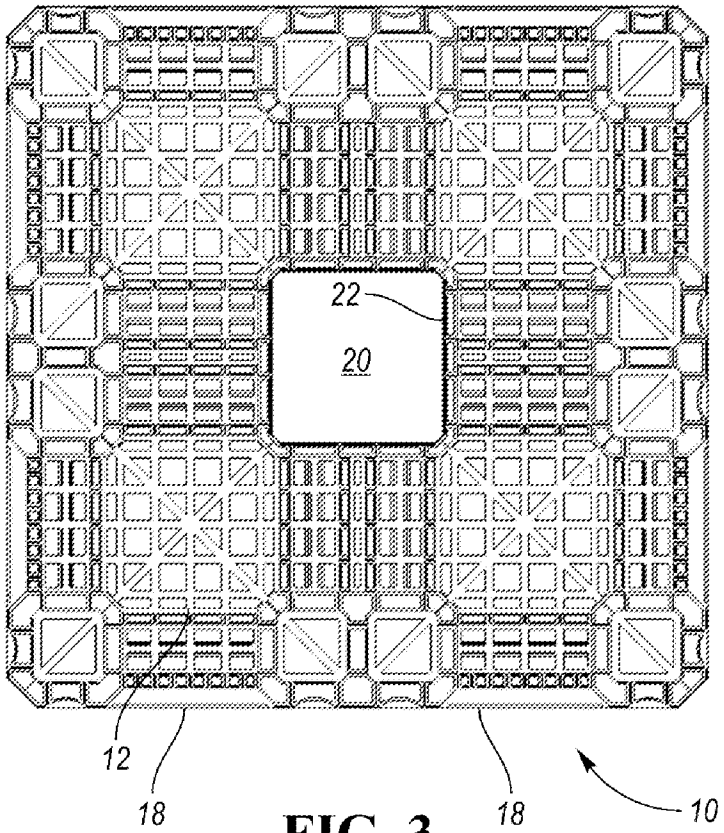
FIG. 3 is a top view of the pallet of FIG. 1.

A large central opening 20 is formed through a center portion of the deck 12 and passes entirely through the pallet 10. The opening 20 is large, i.e. at least approximately one fifth (⅕) each of the width and length of the deck 12. The opening 20 should be less than half each of the width and length of the deck 12. More preferably the opening 20 should be approximately one quarter (¼) to approximately one third (⅓) each of the width and length of the deck 12, and even more preferably approximately one quarter (¼) each of the width and length of the deck 12. The opening 20 is approximately the same width as the non-corner outer columns 14 aligned therewith, as shown in FIG. 3. In the example illustrated, the pallet 10 is approximately 48 inches by 48 inches and the opening 20 is approximately 12 inches by 12 inches. The opening does not have to be square, but could be elongated or rounded.

A peripheral wall 22 circumscribes the opening 20 to provide support to the center of the deck 12 as a central column. The peripheral wall 22 extends down to a plane containing the bottoms surfaces of the pallet 10 and transfers weight on the upper surface of the deck 12 to the floor.

Figure 2:
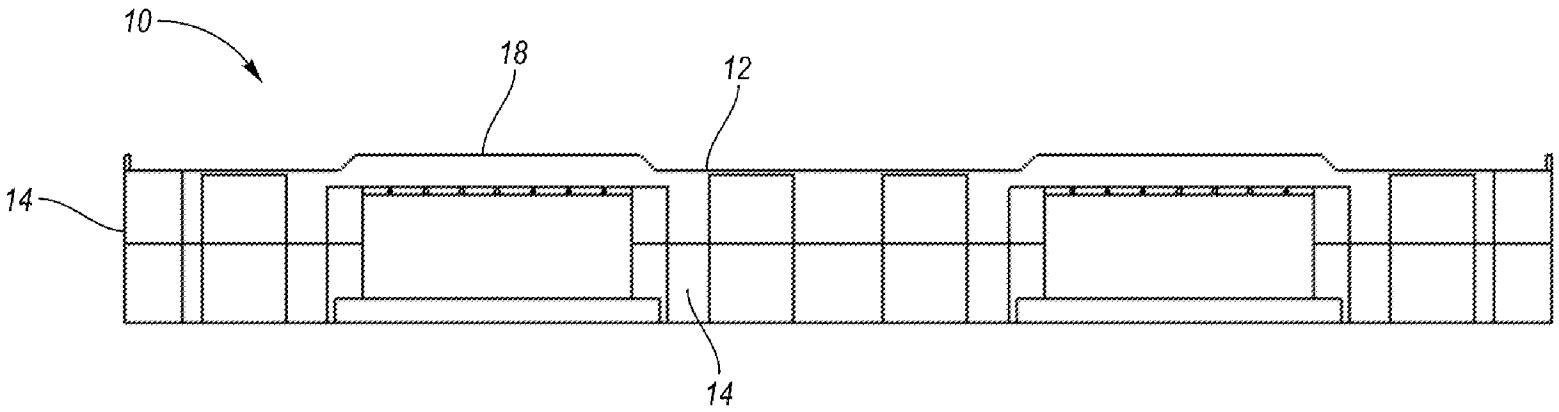
FIG. 2 is a side view of the pallet of FIG. 1.
Figure 4:
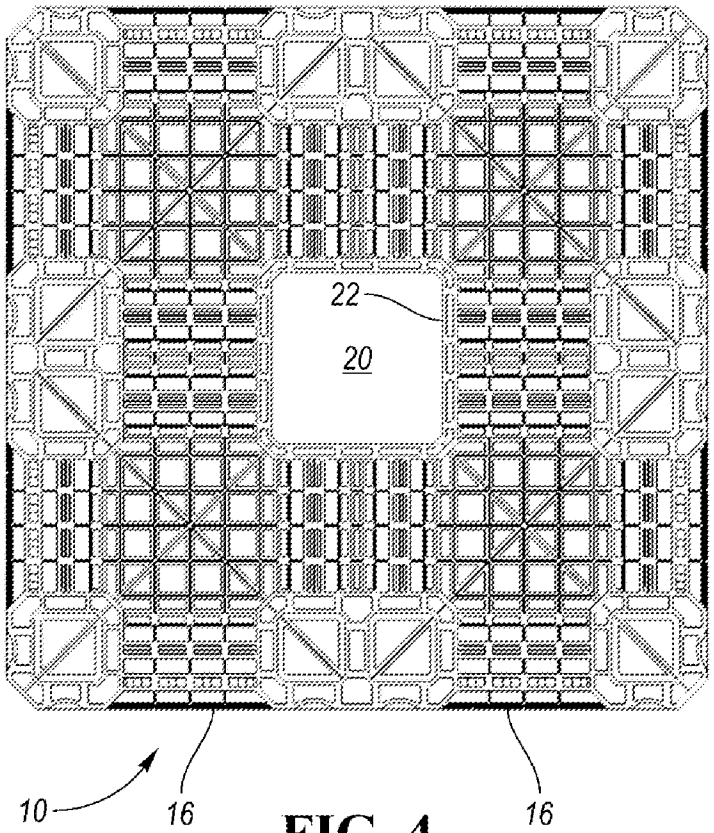
FIG. 4 is a bottom view of the pallet of FIG. 1.

FIG. 2 is a side view of the pallet 10. FIG. 3 is a top view of the pallet 10. FIG. 4 is a bottom view of the pallet 10.

The central opening 20 in the deck 12 aids in unloading material from a box that sits on the pallet 10 without removing the box from the pallet 10. The shape of the opening 20 can be any shape. The box can be accessed through the opening 20 from below when the pallet 10 is elevated. For example, an automation arm can engage the opening 20 to cut into the box. The box preferably contains items that are many times smaller than the opening, such as pellets, such as resin pellets. The items would fall out of the box and through the opening through the deck. The central opening 20 and the method for using the central opening 20 in a pallet 10 to access a box on the pallet can be used with any of the pallets described herein. It can also be used with other types, shapes and sizes of pallets, such as half pallets, nestable pallets, thermoformed pallets, etc.

Figure 5:
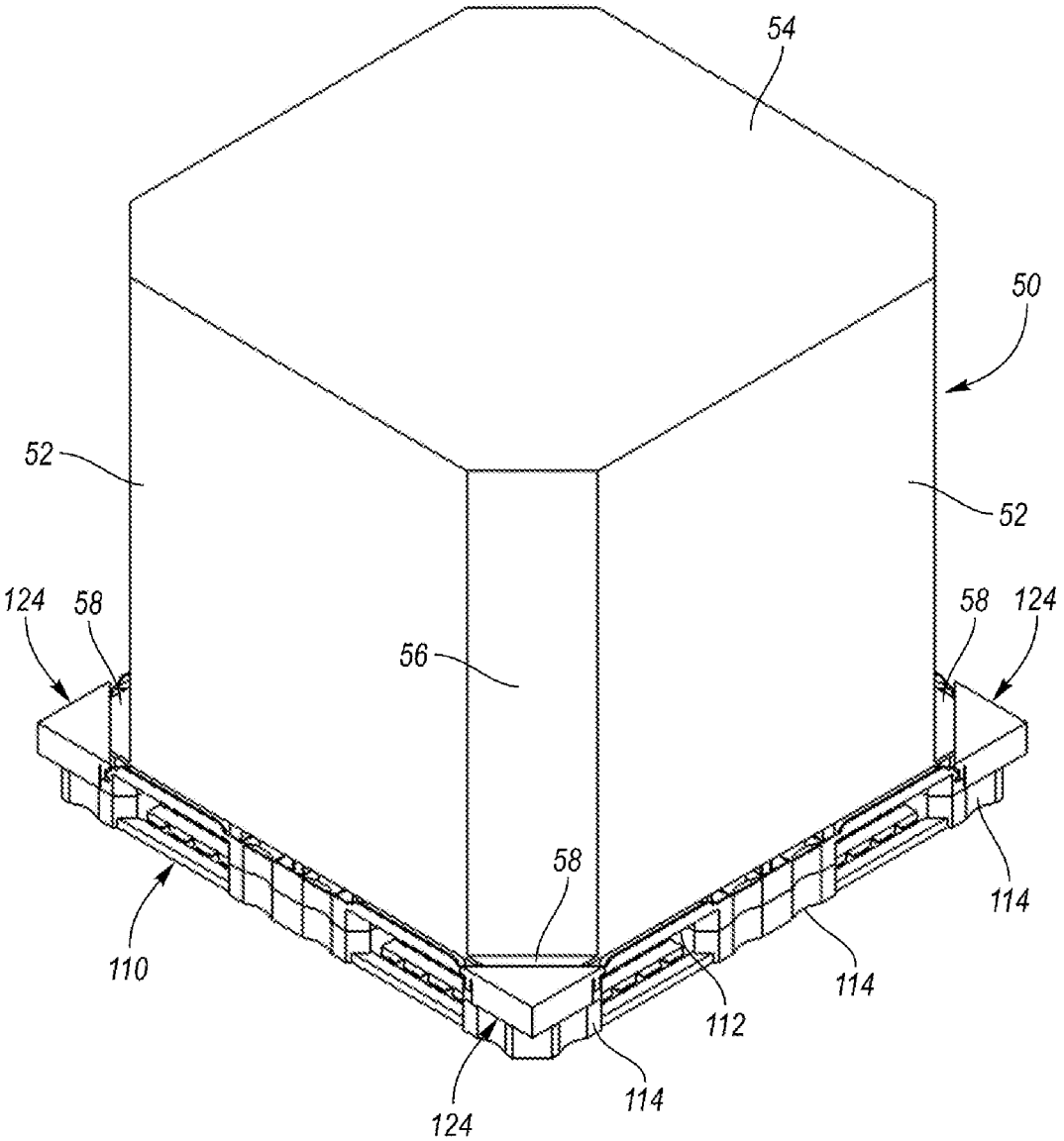
FIG. 5 shows a pallet according to a second embodiment with a box thereon.

FIG. 5 shows a pallet 110 according to a second embodiment. The pallet 110 is identical to the pallet 10 of FIG. 1 except as otherwise described or shown. The pallet 10 includes a deck 112 supported by columns 114. A box 50, such as a corrugated cardboard box 50, is supported on deck 112 of the pallet 110. The box 50 includes four sidewalls 52 and an upper wall 54. Corner walls 56 connect the sidewalls 52 to one another and have corner flaps 58 extending horizontally outward from a lower edge thereof. A bottom wall (not visible) may seal the box 50 until it is opened (such as through the opening 120 through the pallet 110). Corner caps 124 are snap fit onto the corner columns 114 of the pallet 110 on top of the corner flaps 58 of the box 50. The corner caps 124 are fasteners that sandwich the corner flaps 58 to the corner columns 114 to secure the box 50 to the pallet 110.

Figure 6:
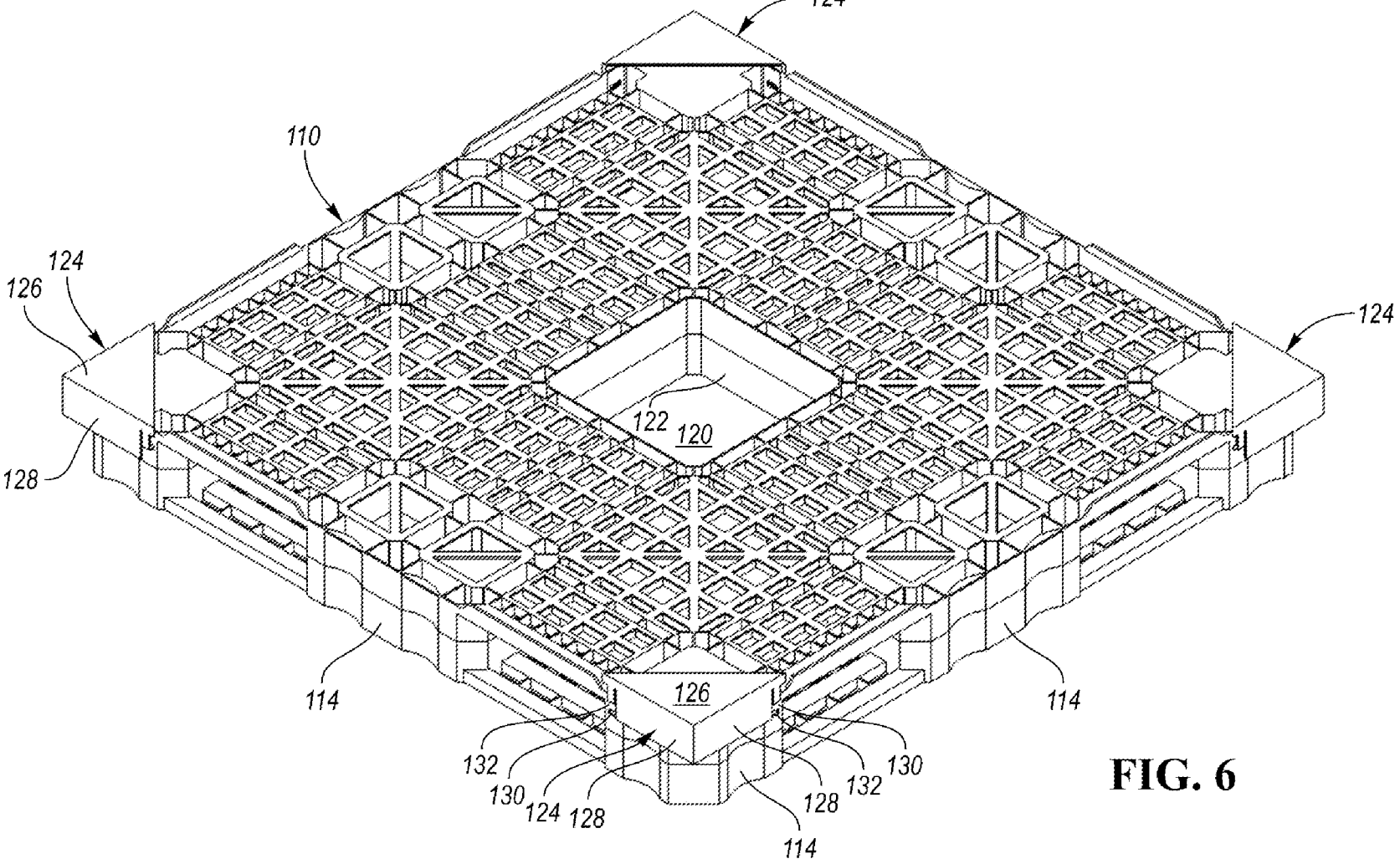
FIG. 6 shows the pallet of FIG. 5 without the box.
Figure 7:
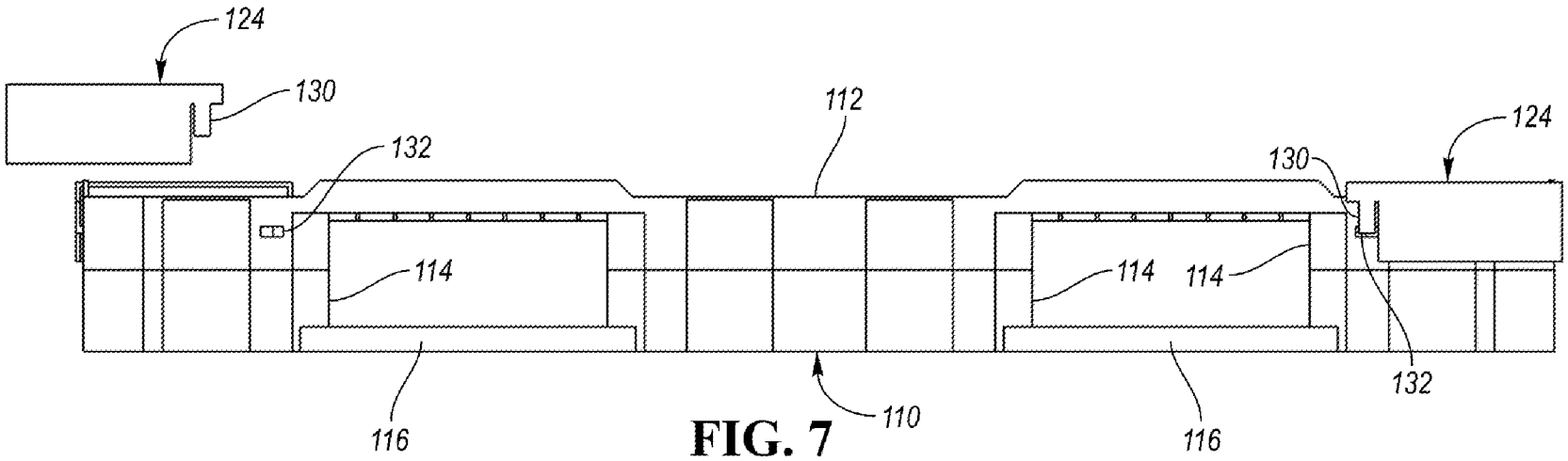
FIG. 7 is a side view with one of the corner caps exploded from the pallet of FIG. 6.
Figure 8:
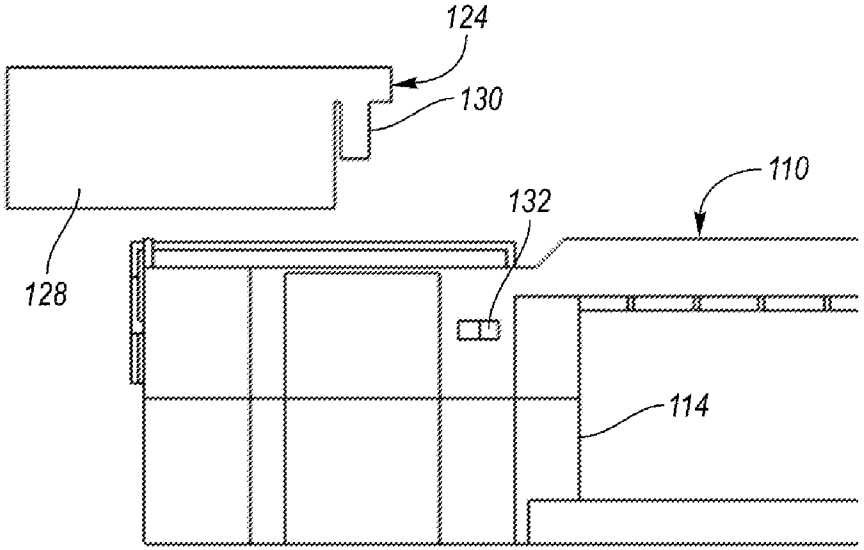
FIG. 8 is an enlarged view of the corner column and corner cap of FIG. 7.

FIG. 6 shows the pallet 110 without the box 50. As shown, the pallet 110 may include the large central opening 120 having the peripheral wall 122, as previously described. FIG. 7 is a side view with one of the corner caps 124 exploded from the pallet 110. FIG. 8 is an enlarged view of the corner column 114 and corner cap 124 of FIG. 7. The corner caps 124 are molded of plastic separately from the pallet 110 and from one another. Each corner cap 124 includes an upper triangular wall 126 having side walls 128 extending downwardly therefrom. Snap tabs 130 extend downward from the upper wall 126 and are received into openings 132 in the corner columns 114. In this manner, the corner caps 124 can snap fit onto the corner columns 114. Other methods of removable securement could also be utilized.

Figure 9:
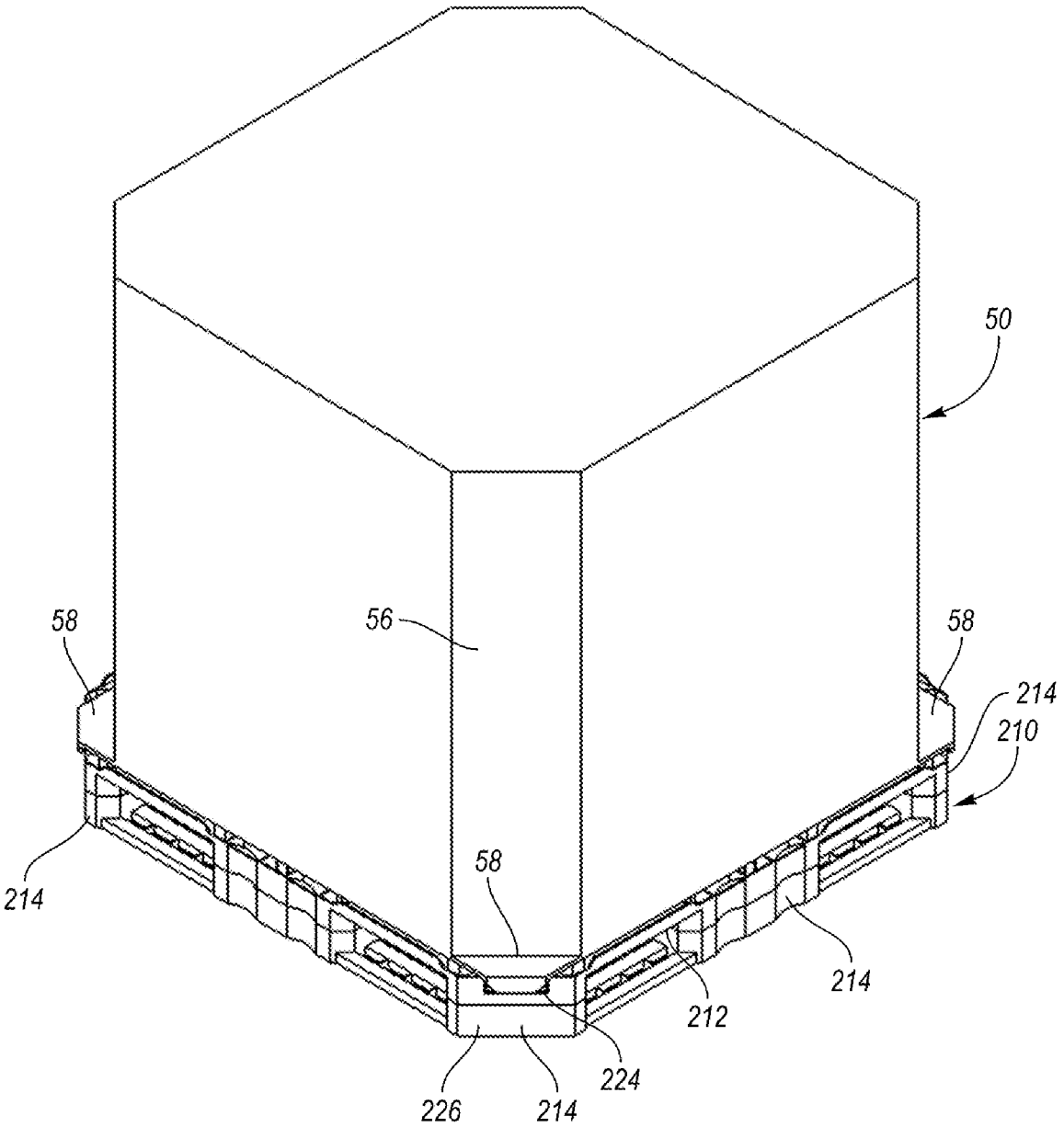
FIG. 9 illustrates a pallet according to a third embodiment with a box thereon.

FIG. 9 illustrates a pallet 210 according to a third embodiment. The pallet 210 is identical to the pallet 10 of FIG. 1 except as otherwise shown or described. The pallet 210 includes an upper deck 212 for supporting a box 50 thereon. Columns 214 support the deck 212 above the floor. In this embodiment, the corner columns 214 are truncated to provide a corner wall 226 parallel to the corner walls 56 of the box 50. An opening 224 is formed in the corner wall 226 to receive the corner flap 58. The corner flap 58 can be folded and tucked into the opening 224 of the corner wall 226 to retain the box 50 on the pallet 210.

Figure 10:
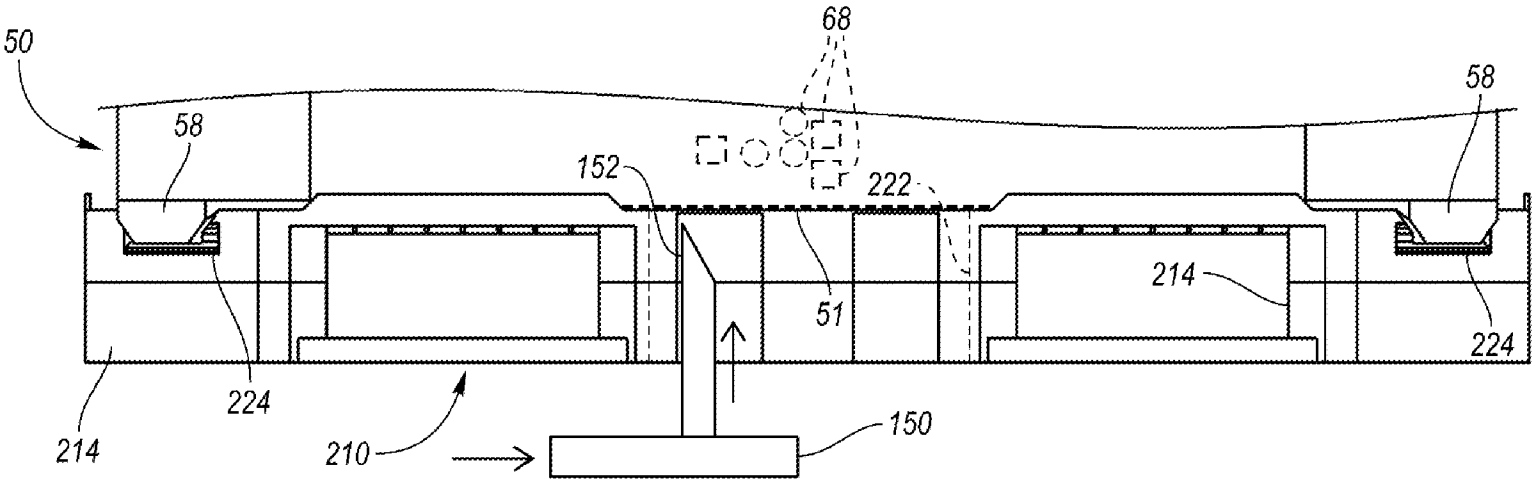
FIG. 10 is a side view of the pallet and box of FIG. 9 being engaged by a cutting instrument from below.

FIG. 10 is a side view of the pallet 210 and box 50 of FIG. 9. The opening 222 through the pallet 210 is shown in broken lines, and again would be similar in size and location to those in FIGS. 1 and 6. Items 68 inside the box are many times smaller than the opening 22. In practice, such as if the items 68 are resin pellets, they would be even smaller than shown in FIG. 10 (e.g. 2 to 5 mm).

An automated arm 150 holds a knife 152 (or other instrument capable of opening the bottom wall 51) and may be used to open the bottom wall 51 of the box 50. Optionally, a person holding a blade could cut the bottom wall 51 manually. When the bottom wall 51 of the box 50 is cut through the opening 222, the items 68 can easily fall through the opening 222. Alternatively, a wall or other seal, separate from the box can be placed across the opening 222 and subsequently removed or cut. This way the box 50 can be emptied before it is removed from the pallet 210. Again, this method could be used for any of the pallets disclosed herein.

Figure 11:
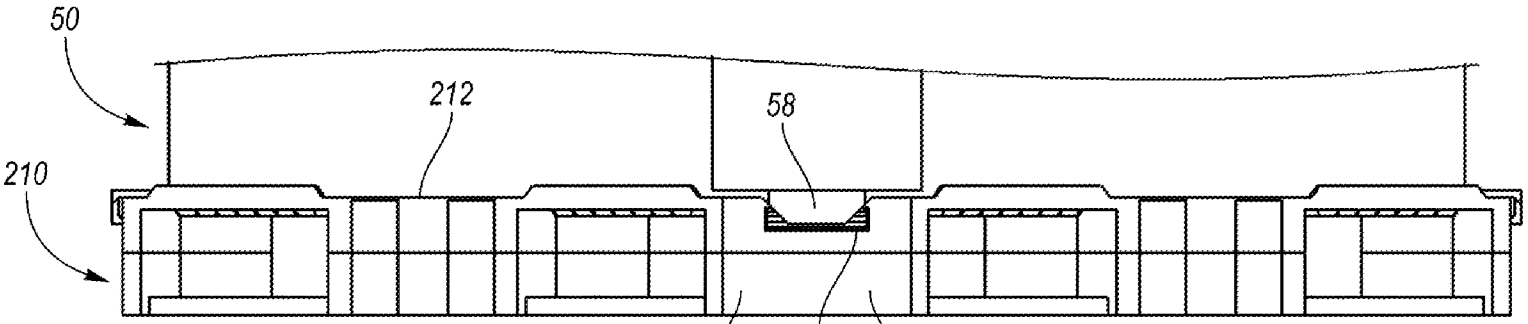
FIG. 11 is another side view of the pallet and box of FIG. 9.

FIG. 11 is a corner view of the pallet 210 and box 50, showing the flap 58 tucked into the opening 224 in the corner wall 226 of the column 214.

Figure 12:
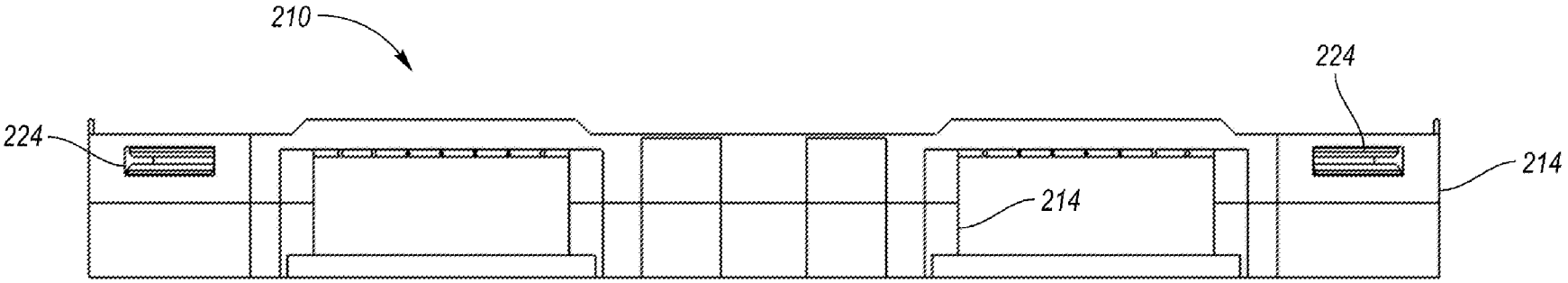
FIGS. 12 and 13 are side views of the pallet of FIG. 9 without the box.
Figure 13:
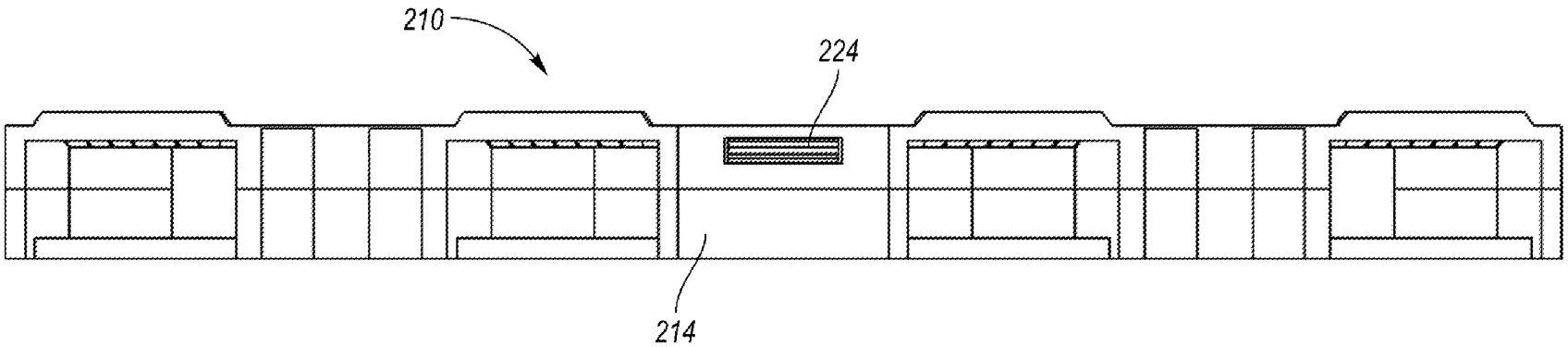

FIG. 12 is a side view of the pallet 210 without the box 50. FIG. 13 is a corner view of the pallet of FIG. 12.

Figure 14:
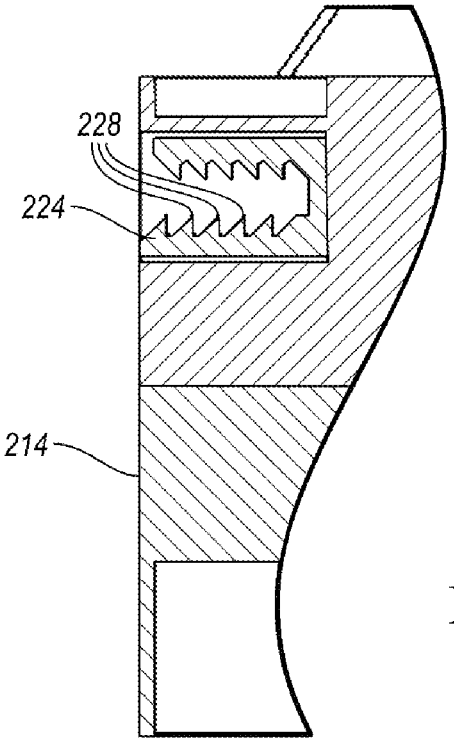
FIG. 14 is an enlarged section view through the corner column of the pallet of FIG. 12.

FIG. 14 is an enlarged section view through the corner column 214. As shown in FIG. 14, the opening 224 into the corner column 214 may include a plurality of barbs 228 extending toward one another, such that when the flap 58 is tucked into the opening 224 the barbs 228 secure the flap 58 within the opening 224 to the columns 214.

Figure 15:
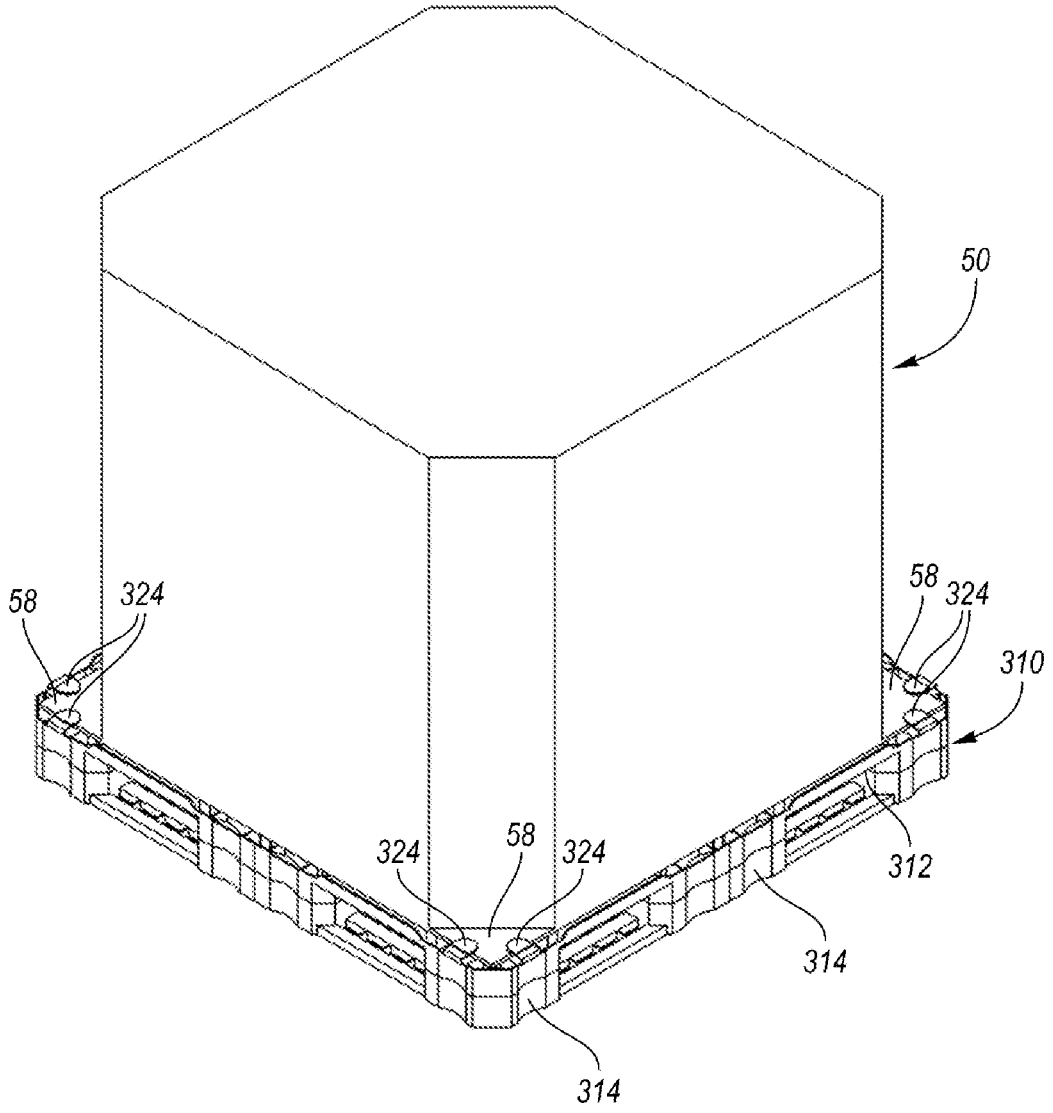
FIG. 15 shows a pallet according to a fourth embodiment with a box thereon.

FIG. 15 shows a pallet 310 according to a fourth embodiment. The pallet 310 is identical to the pallet 10 of FIG. 1 except as otherwise shown or described. The pallet 310 includes an upper deck 312 supported above the floor by columns 314. In this embodiment, retainers 324 are hingably connected to each of the corner columns 314, such as by a living hinge. The retainers 324 fold back onto the corner column 314 and snap fit to the corner column 314 over the corner flap 58 of the box 50, thereby securing the box 50 to the pallet 310.

Figure 16:
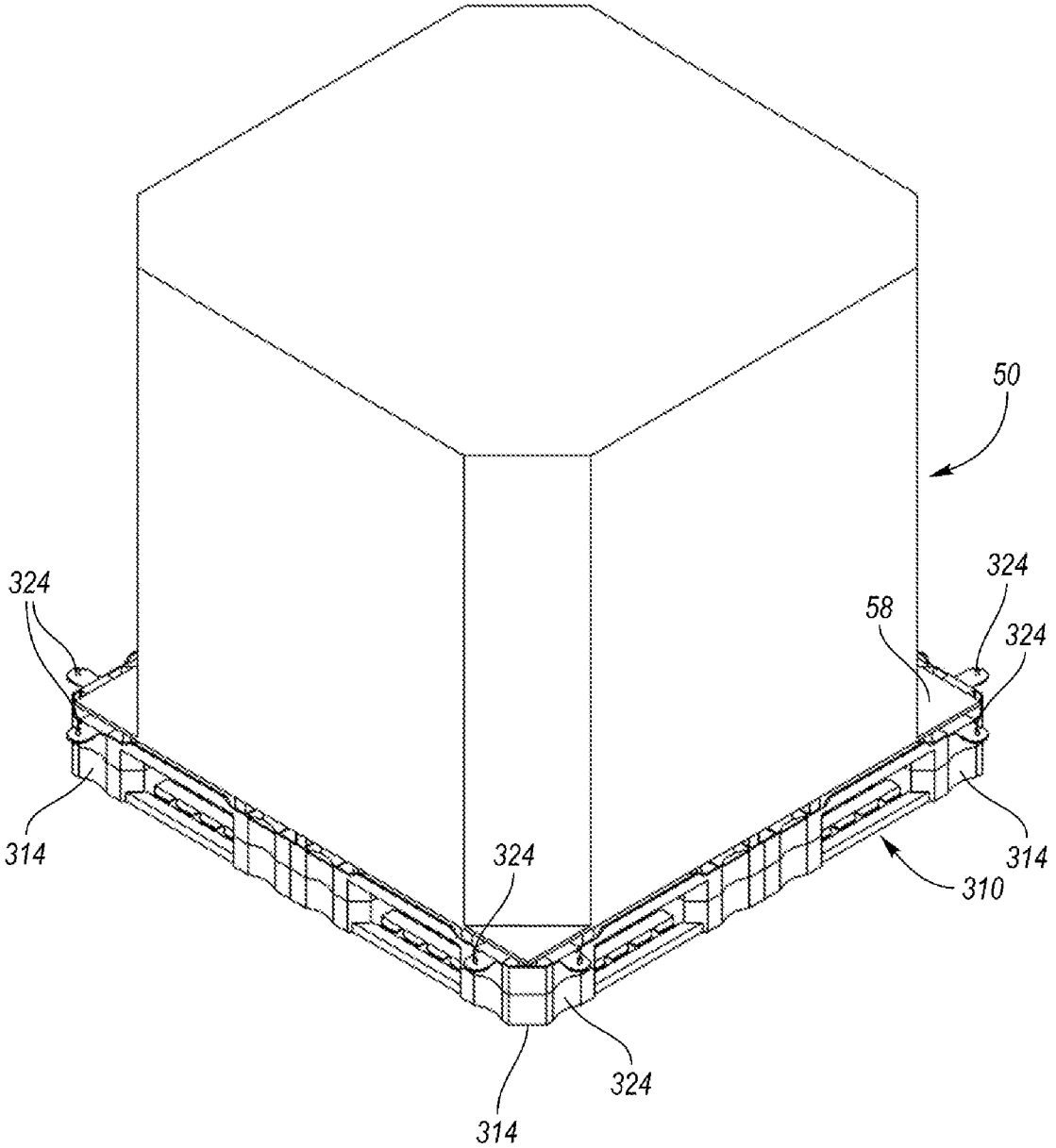
FIG. 16 shows the pallet and box of FIG. 15 with the retainers pivoted outward in the unsecured position.

FIG. 16 shows the retainers 324 pivoted outward in the unsecured position.

Figure 17:
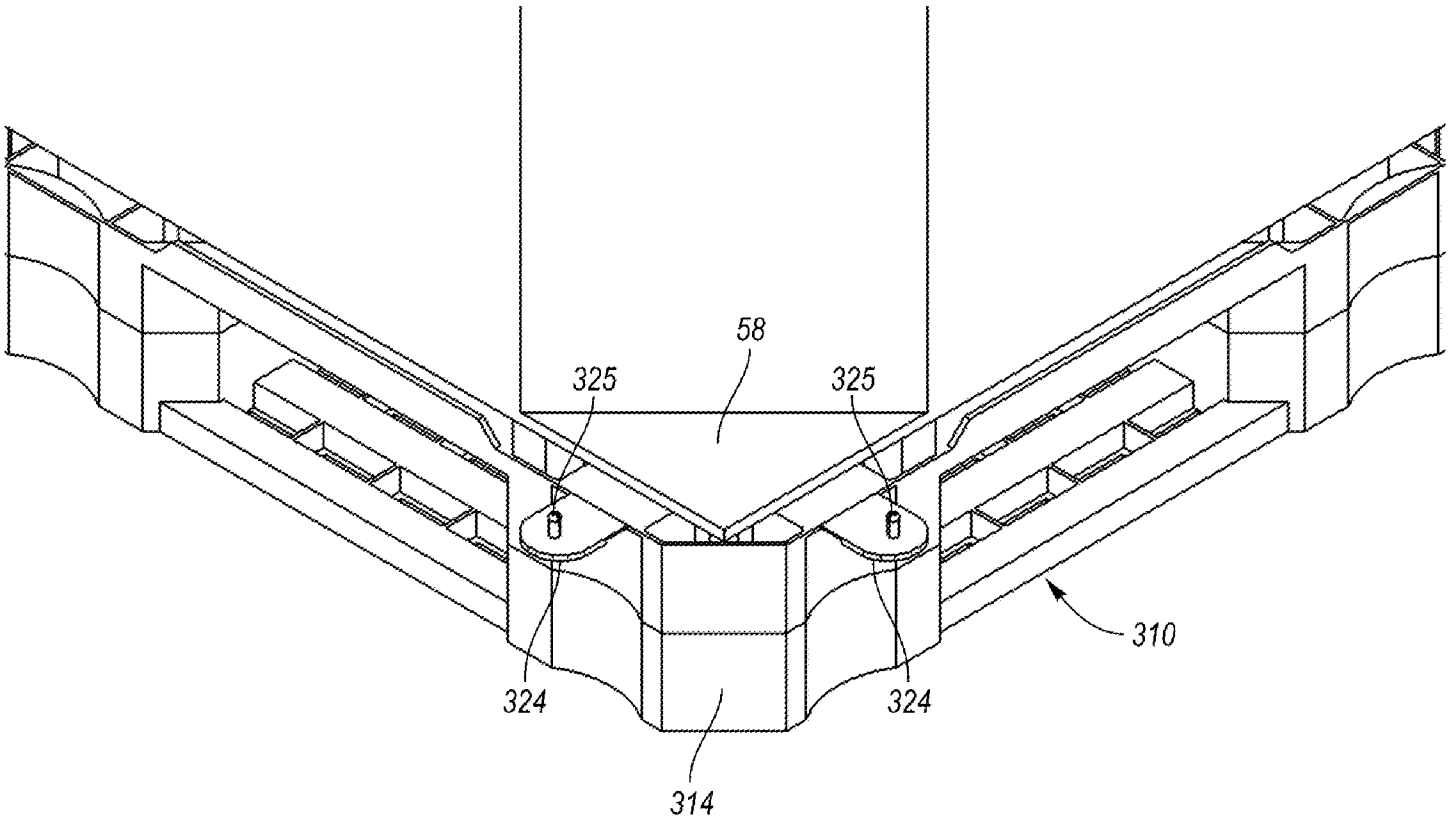
FIG. 17 is an enlarged view of one corner column of the pallet and box of FIG. 16.
Figure 18:
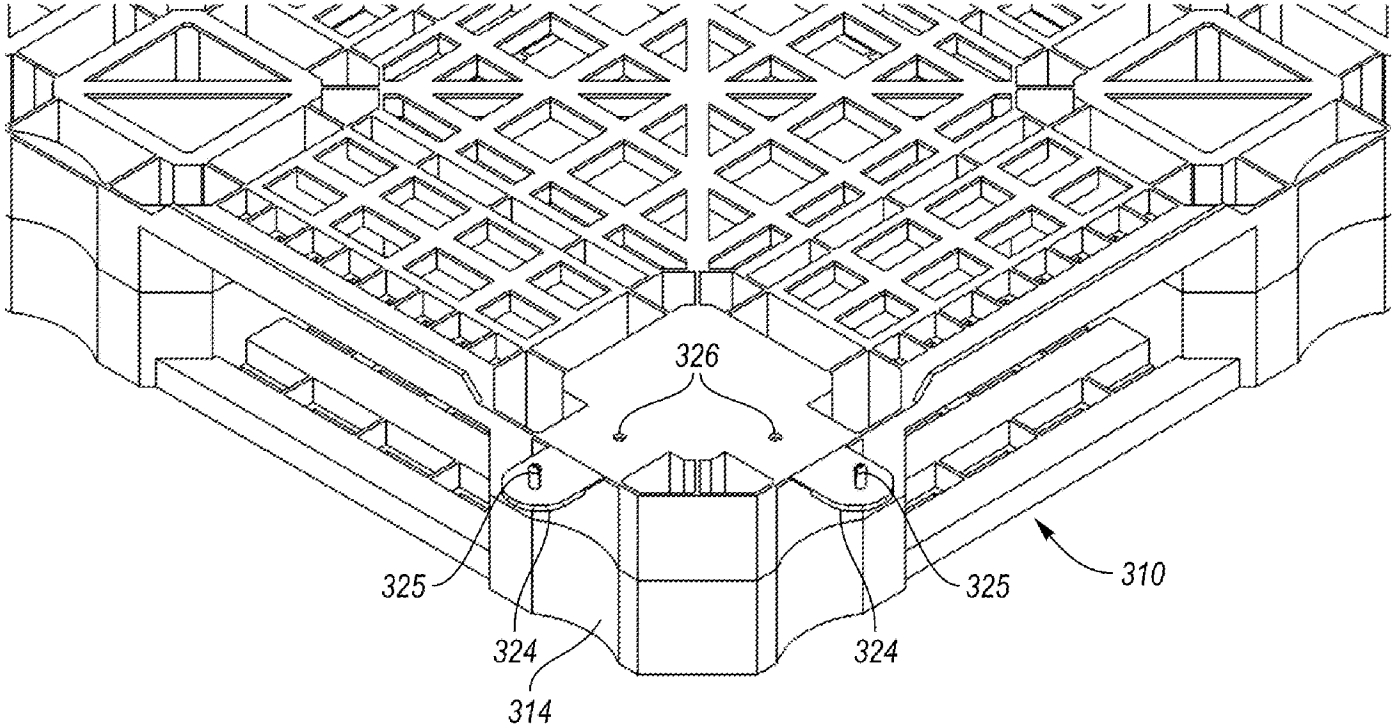
FIG. 18 shows the corner column of FIG. 17 without the box.

FIG. 17 is an enlarged view of one corner column 314 of the pallet 310. As shown, each of the retainers 324 is formed integrally with the corner column 314 and includes a protrusion 325. As shown in FIG. 18, the columns 314 include corresponding apertures 326, into which the protrusions 325 can be snap fit. In use, the protrusions 325 may puncture the flaps 58 and then snap fit into the apertures 326. Alternatively, the protrusions 325 may be received through preformed holes through the corner flaps 58. Alternatively, the protrusions 325 can snap fit into the apertures 326 immediately adjacent the flaps 58 with the retainers 324 protruding over the corner flaps 58, to retain the flaps 58 to the corner columns 314.

Figure 19:
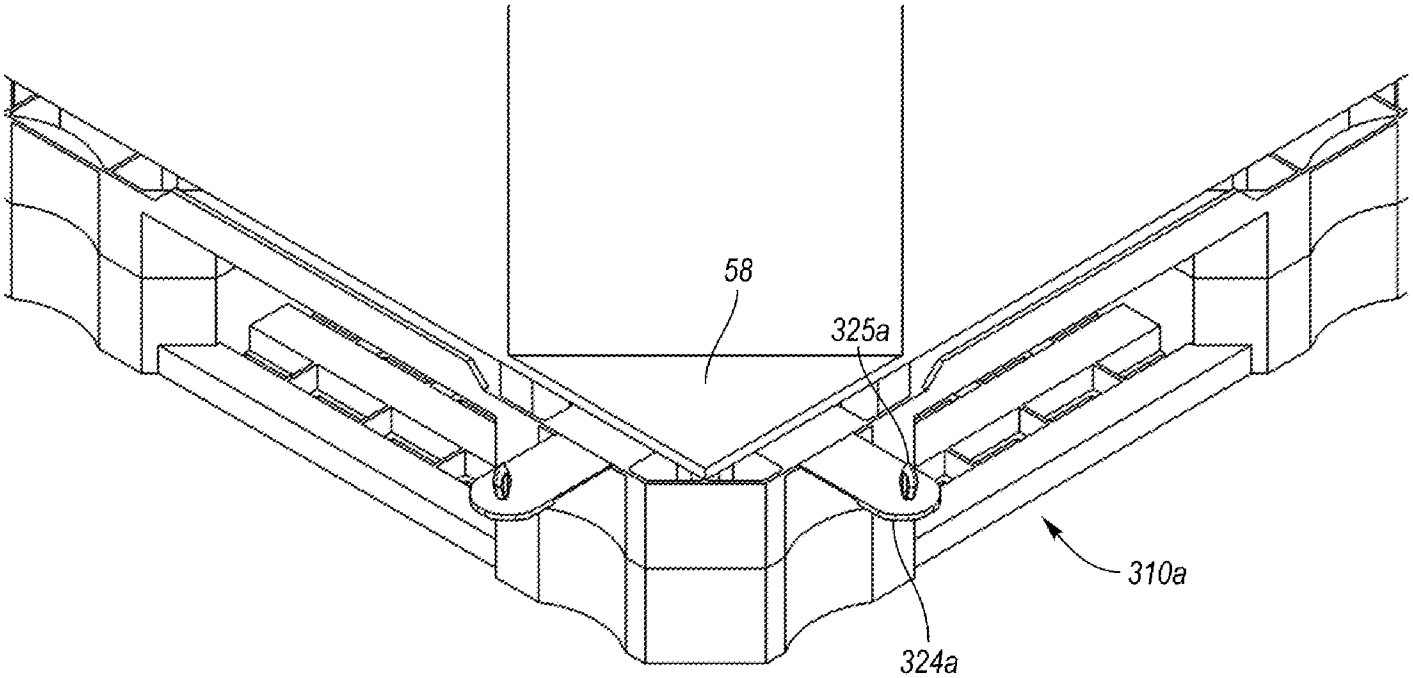
FIG. 19 shows an alternate pallet with a box thereon.
Figure 20:
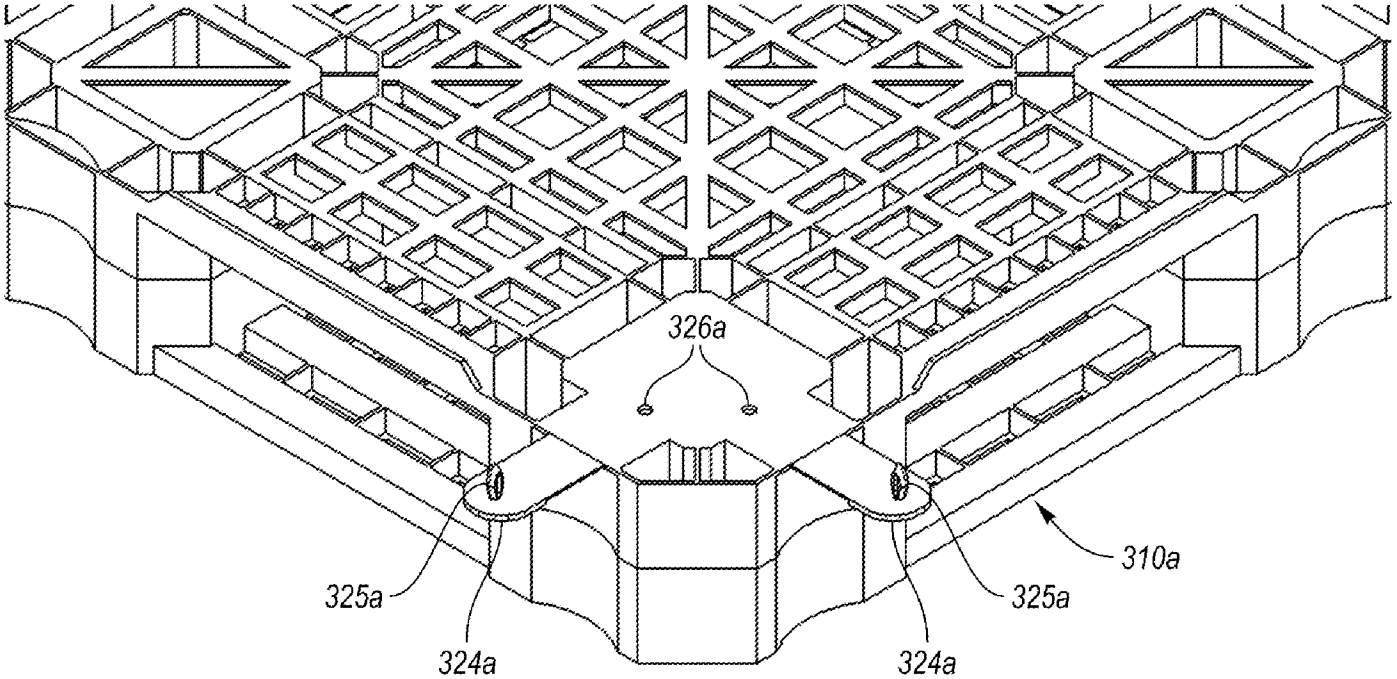
FIG. 20 shows the pallet of FIG. 19 without the box.

FIG. 19 shows an alternate pallet 310*a* having alternate retainers 324*a* with alternate protrusions 325*a*. The protrusions 325*a* are configured in a different physical shape, but can be snap fit into apertures 326*a* (FIG. 20).

Figure 21:
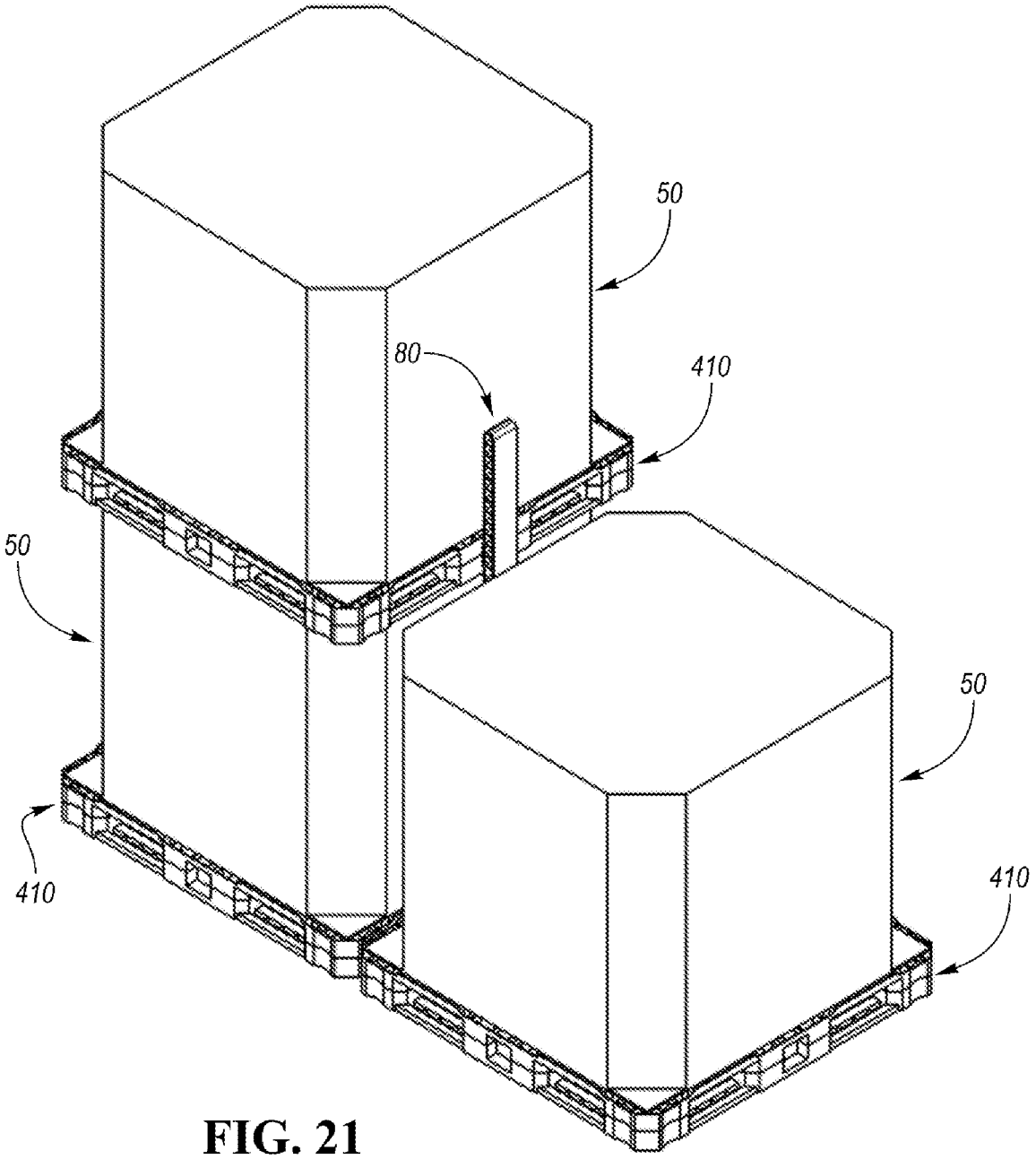
FIG. 21 shows a system including a plurality of pallets and a brace positioned between the plurality of loaded pallets.
Figure 22:
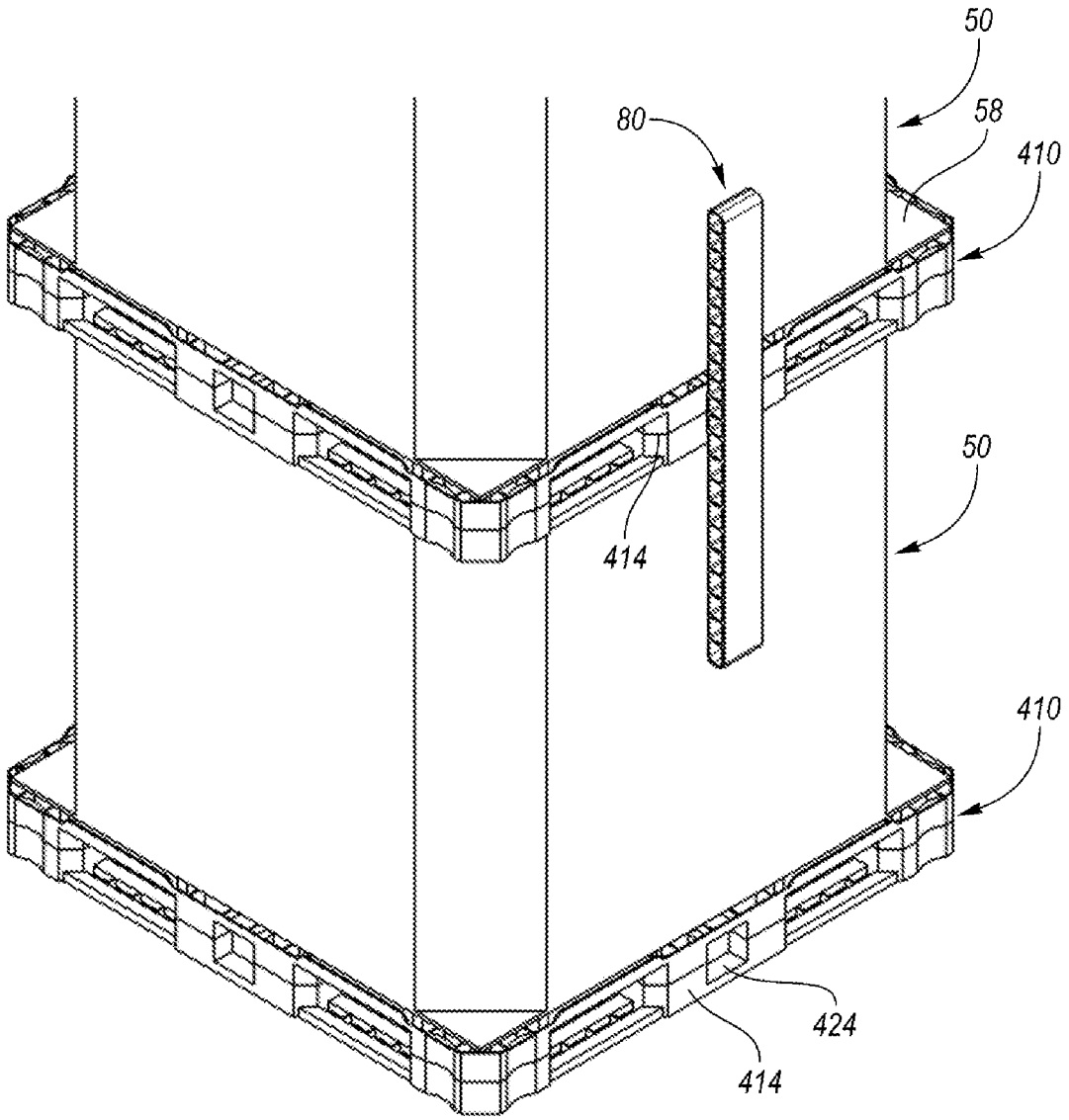
FIG. 22 shows two of the loaded pallets and the brace of FIG. 21.

FIG. 21 shows a system including a plurality of pallets 410 and a brace 80 positioned between the plurality of loaded pallets 410. As shown in FIG. 22, the brace 80 is secured to a central outer column 414 of an upper pallet 410. The brace extends upward adjacent the box 50 on the pallet 410 and the brace 80 extends downward adjacent the box 50 below the pallet 410 supported on the lower pallet 410. The central outer columns 414 of the pallets 410 include an opening 424 to which the braces 80 can be secured.

Figure 23:
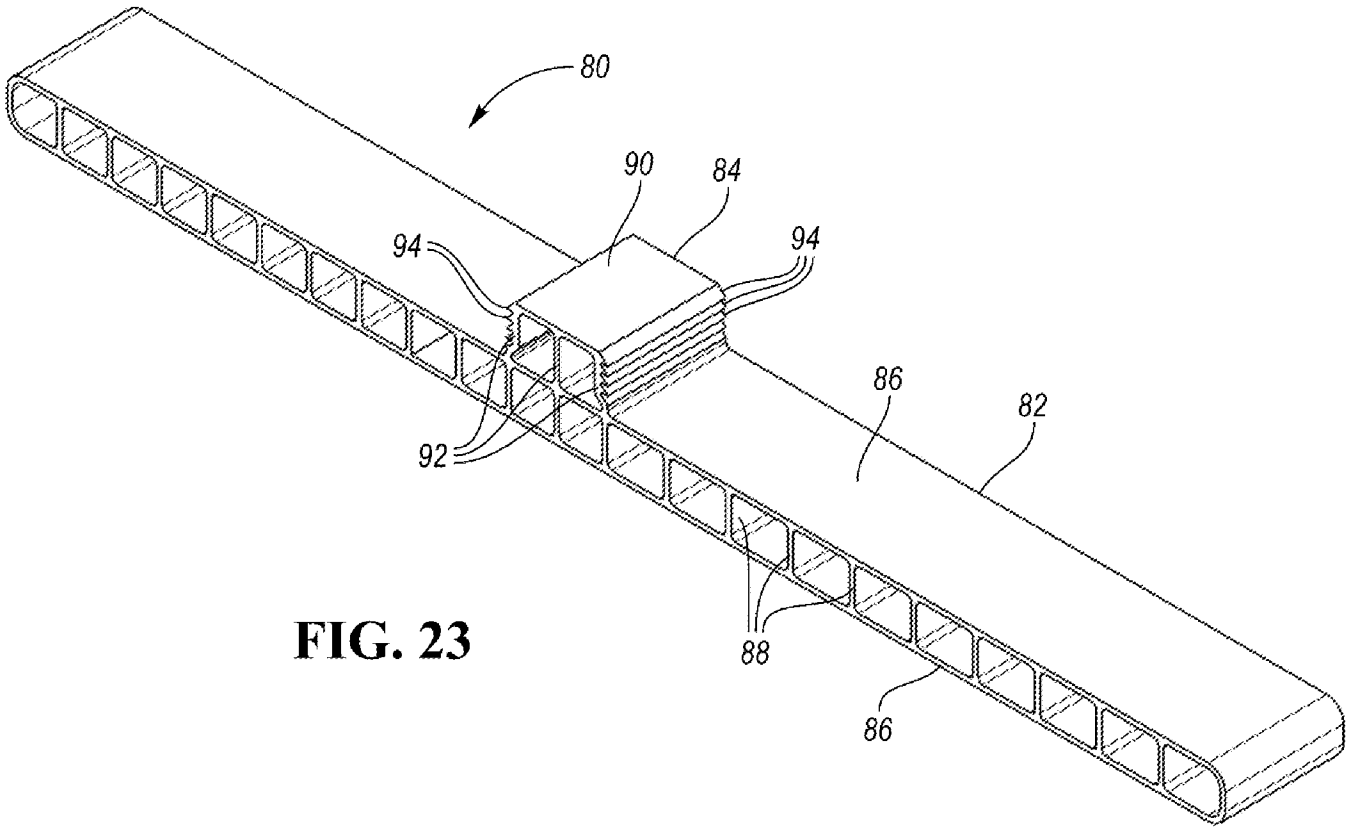
FIG. 23 shows one embodiment of the brace of FIG. 22.

FIG. 23 shows one embodiment of the brace 80. The brace 80 includes an elongated body portion 82 and a retainer portion 84 protruding generally transversely away from a mid-portion of the body portion 82. In FIG. 23, the retainer portion 84 extends upward relative to the body portion 82 ("upward" defined only with reference to FIG. 23). The body portion 82 includes outer walls 86 connected by perpendicular ribs 88. The retainer portion 84 includes an outer wall 90 connected to the body portion 82 by a plurality of ribs 92 or walls. The retainer portion 84 is flexible or resiliently deformable. The outermost ribs 92 include a plurality of barbs 94, which may be angled downward toward the body portion 82.

Figure 24:
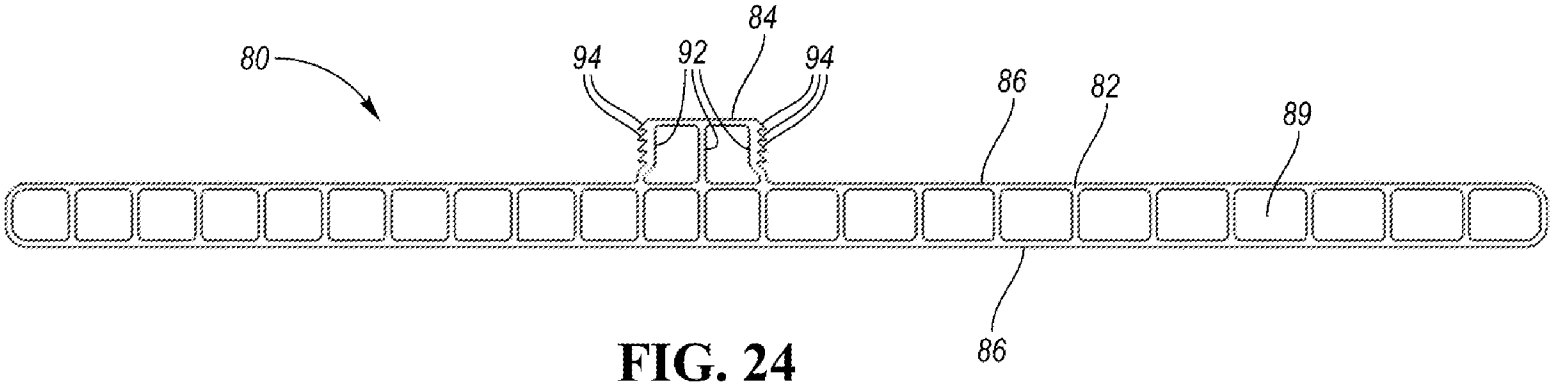
FIG. 24 is side view of the brace of FIG. 23.
Figure 25:
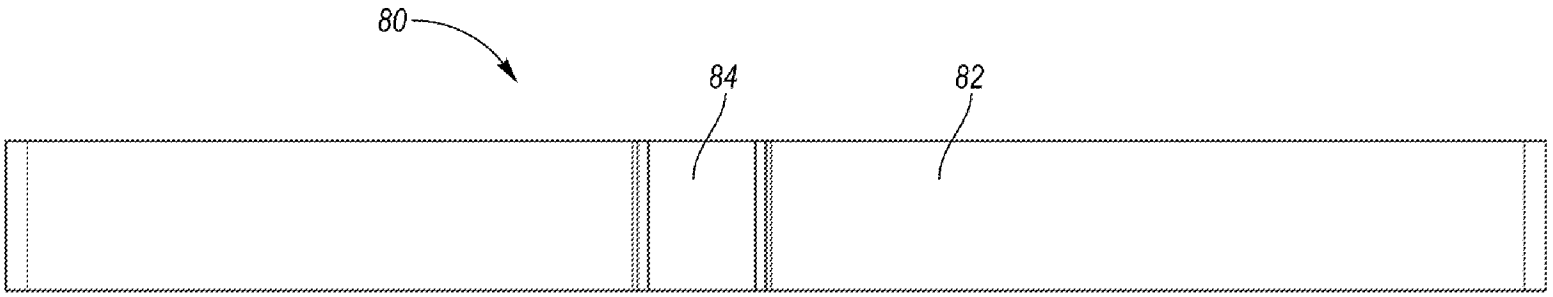
FIG. 25 is a top view of the brace of FIG. 23.

FIG. 24 is side view of the brace 80. As can be seen in FIG. 24, the brace 80 includes a longitudinal mid-wall 89 extending from one outer wall 86 to the other and between the ribs 88. The mid-wall 89 is perpendicular to the outer walls 86 and to the ribs 88 and is positioned approximately halfway between opposite edges of the outer walls 86. The mid-wall 89 also extends into the retainer portion 84 between the ribs 92. FIG. 25 is a top view of the brace 80.

Figure 26:
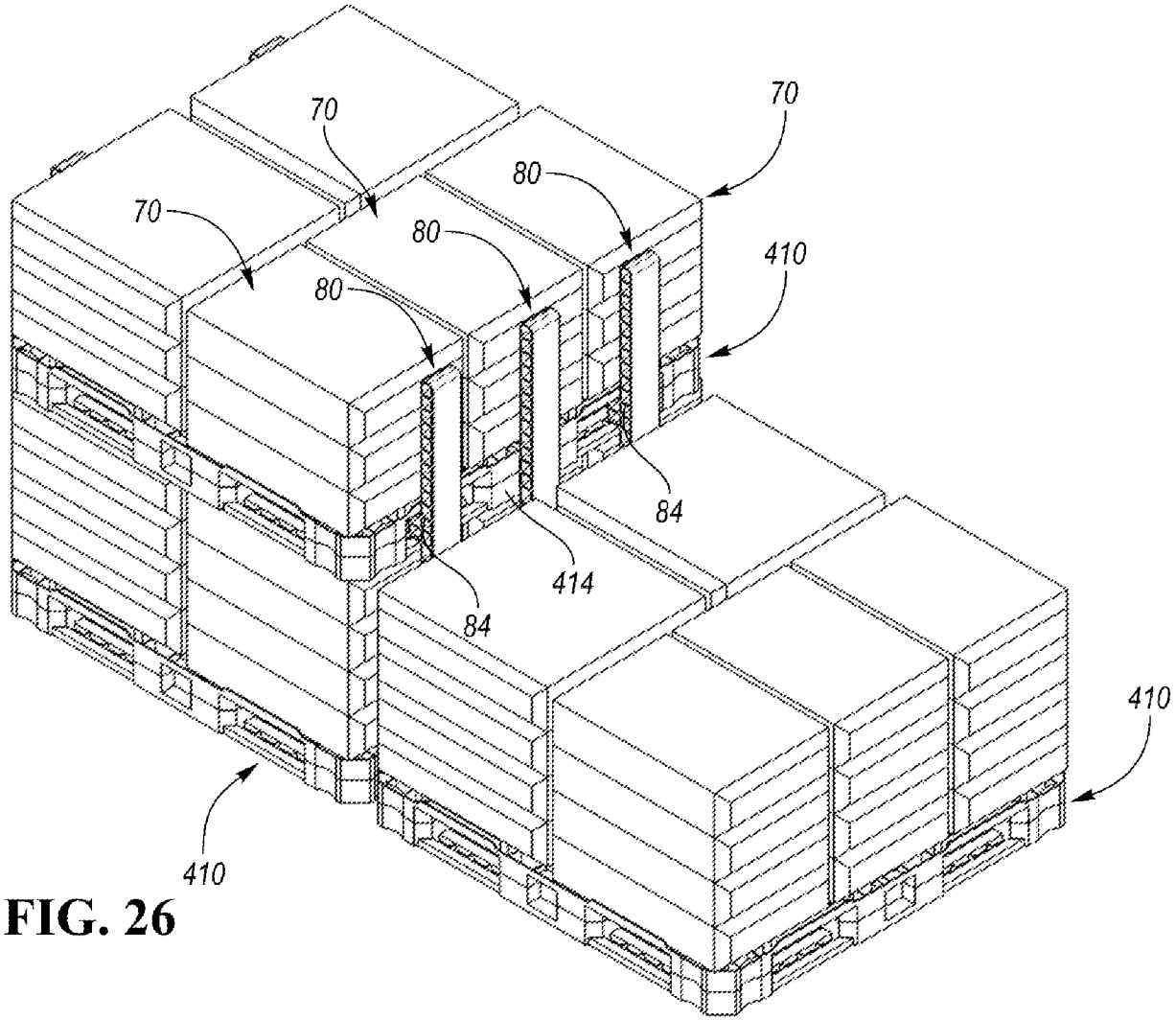
FIG. 26 shows a plurality of the pallets of FIG. 21 loaded with goods and with a plurality of braces similar to the brace of FIG. 23.

FIG. 26 shows a plurality of pallets 410 loaded with goods 70. Three braces 80 are secured to the upper pallet 410. The retainer portion 84 (not visible) of the center brace 80 is secured to an opening in the center outer column 414. The retainer portions 84 of the outer braces 80 are secured in the fork tine openings of the upper pallet 410. All three retainer portion 84 are pressed into their respective openings, somewhat deforming the retainer portions 84, which together with the barbs 94 retains the braces 80 in this position. Additionally, the adjacent goods 70 loaded on the adjacent lower pallet 410 also keep the braces 80 in place, which in turn assists in keeping the goods 70 in place on that pallet 410. In other words, although the braces 80 would not assist much in keeping the goods 70 on the pallet 410 by themselves, they can provide substantial support to the goods 70 on the pallet 410 once another loaded pallet 410 abuts the braces 80.

Figure 27:
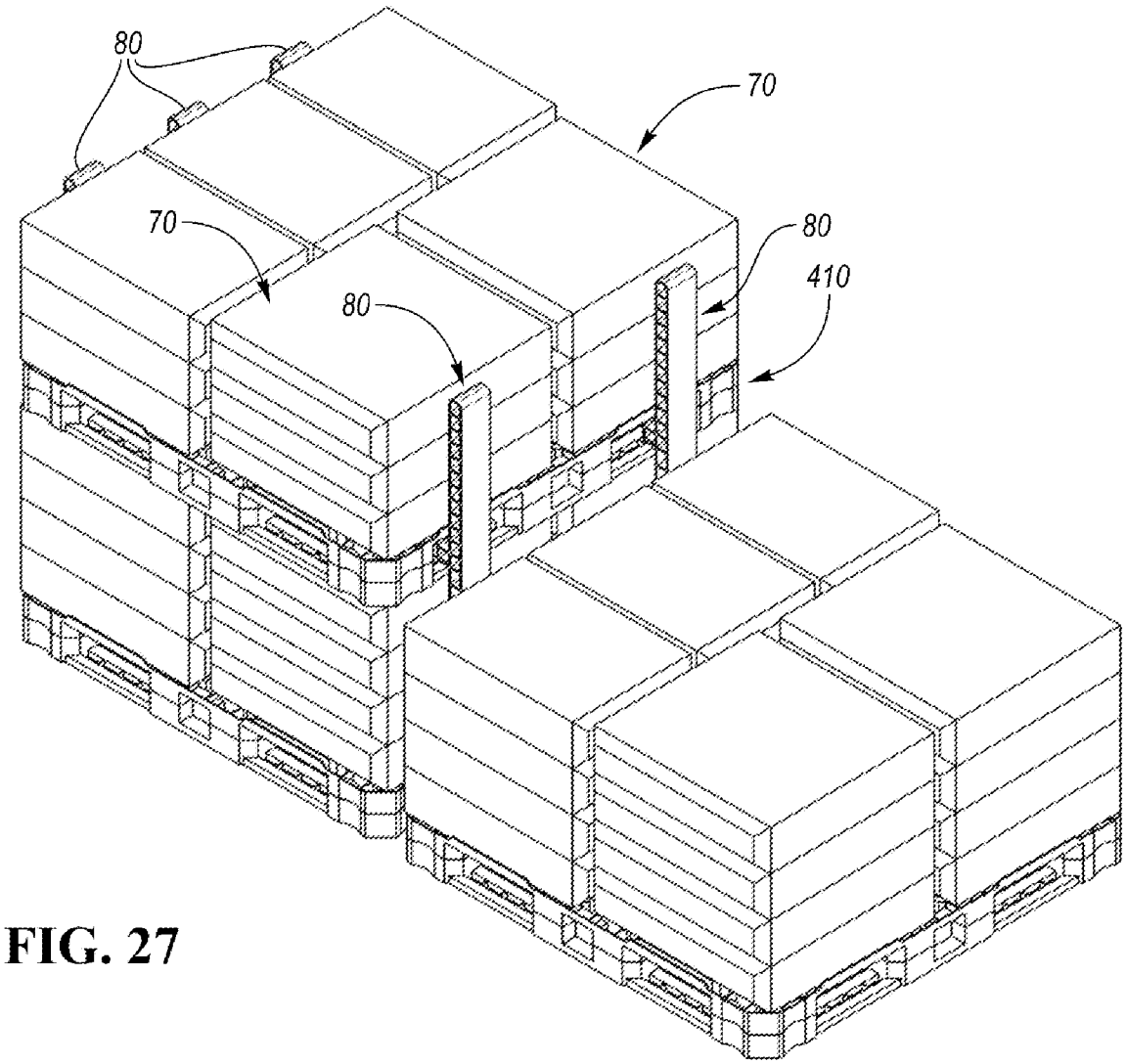
FIG. 27 shows a plurality of the pallets and braces of FIG. 21 loaded with different size goods.

As shown in FIG. 27, depending upon the arrangement of the goods 70 on the pallet 410 only two braces 80 may be needed on a particular side of the pallet 410. In FIG. 27, the upper pallet 410 is rotated 180 degrees compared to the upper pallet 410 in FIG. 26.

Figures 28, 29:
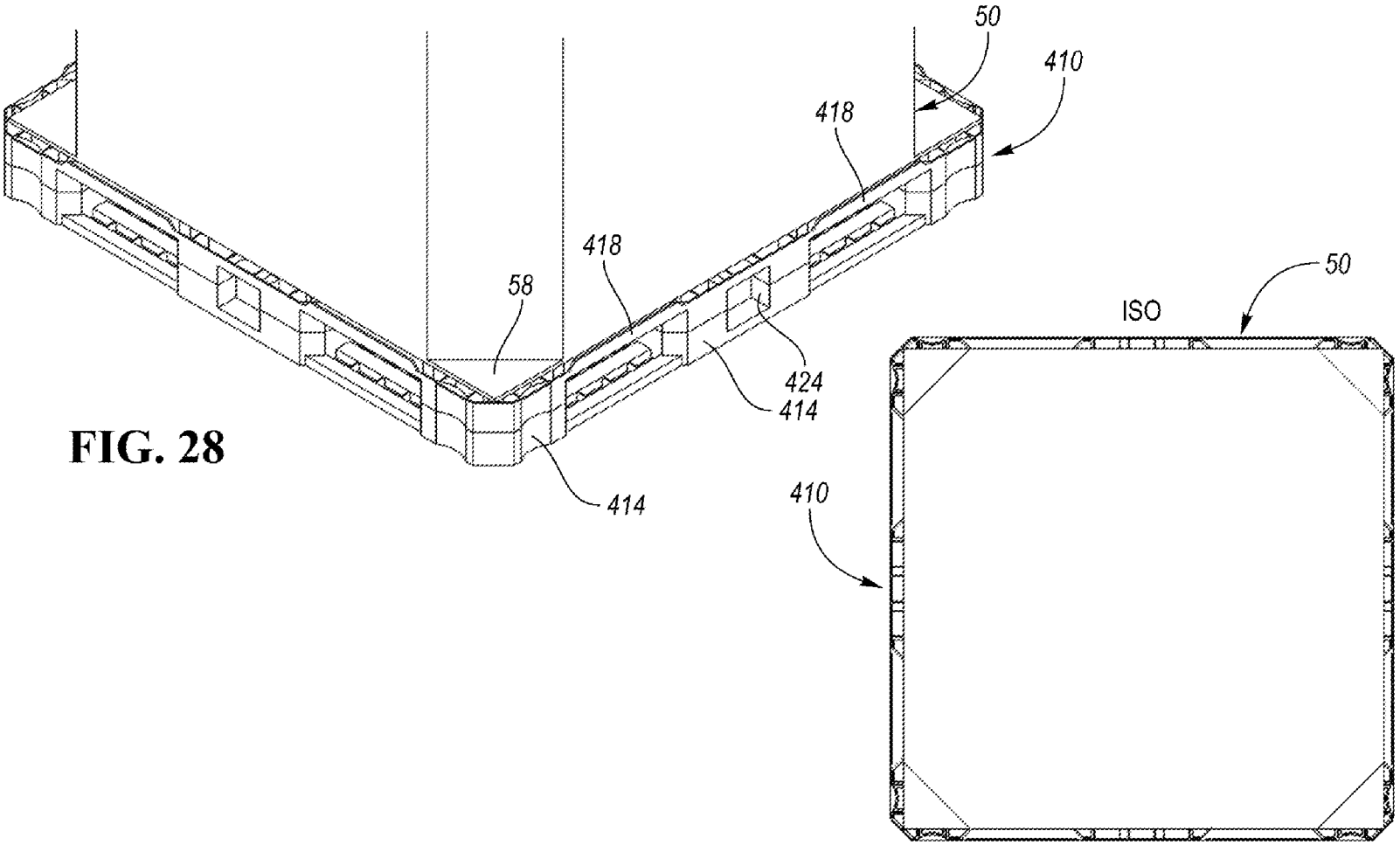
FIG. 28 shows one of the pallets of FIG. 21 with a box loaded thereon.
FIG. 29 is a top view of the pallet and box of FIG. 28.

FIG. 28 shows the pallet 410 with a box 50 loaded thereon. The peripheral lip 418 helps secure the box 50 on the pallet 410. The opening 424 is provided in the central outer columns 414 for receiving the retaining portion 84 of the braces 80 (FIG. 23). FIG. 29 is a top view of the pallet 410 and box 50.

Figure 30:
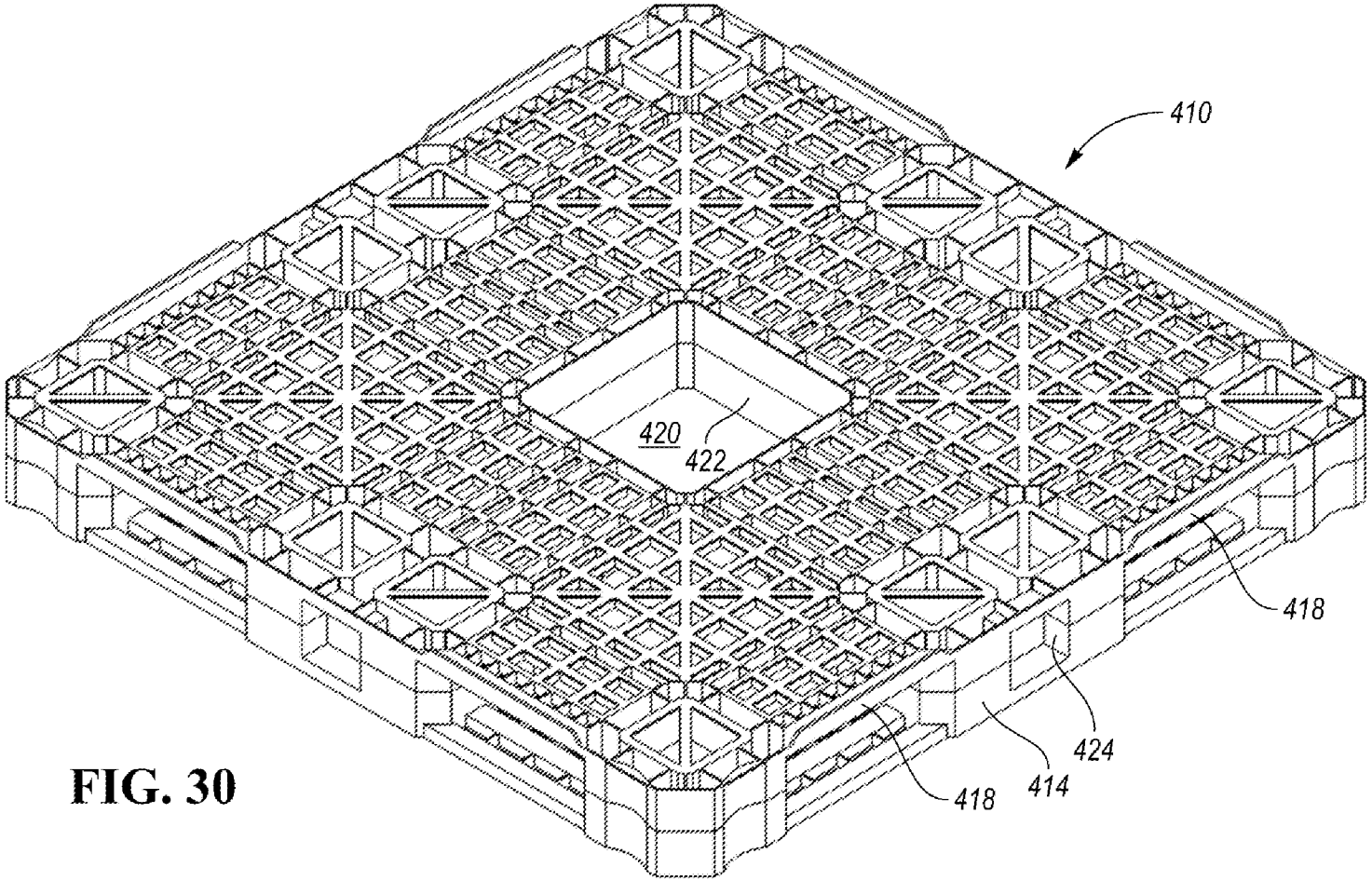
FIG. 30 is a perspective view of one of the pallets of FIG. 21.
Figure 31:
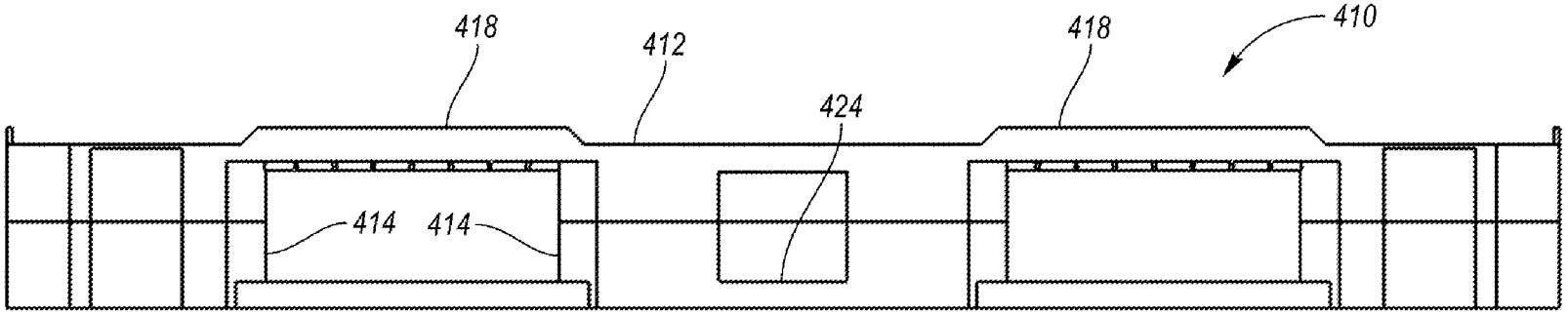
FIG. 31 is a side view of the pallet of FIG. 30.

FIG. 30 is a perspective view of the pallet 410. As shown, the pallet 410 may also include the central opening 420 circumscribed by the peripheral wall 422, as described above with respect to the earlier embodiments. FIG. 31 is a side view of the pallet 410.

Figure 32:
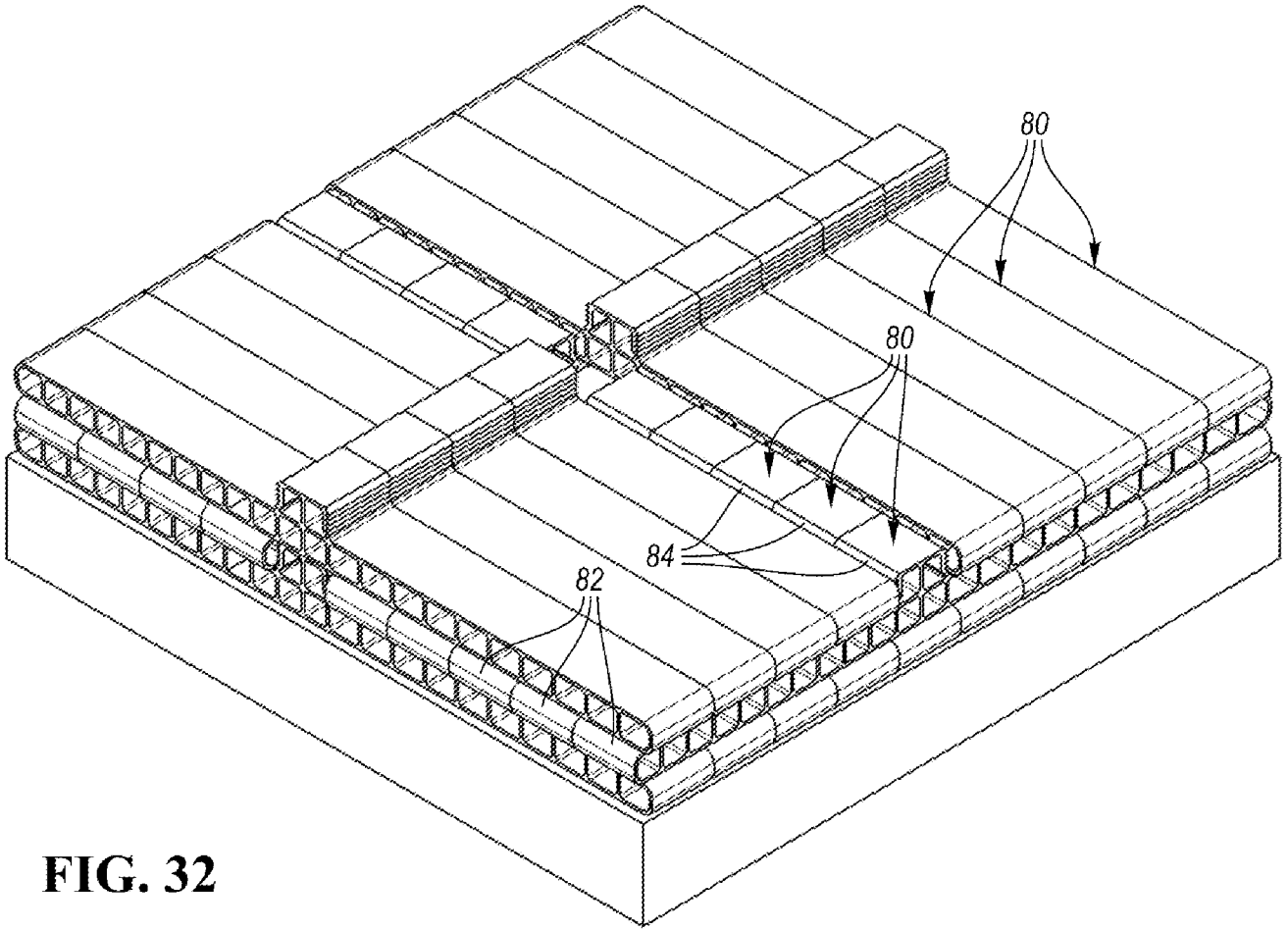
FIG. 32 shows a plurality of the braces of FIG. 23 stacked together.

As shown in FIG. 32, a plurality of the braces 80, when not in use, can be stacked as shown. By alternating the orientation of the braces 80 in each subsequent row, the retaining portions 84 aligned in the lower row can fit between perpendicular braces 80 in the upper row. In this manner, these braces 80 can be shipped and stored efficiently.

Figure 33:
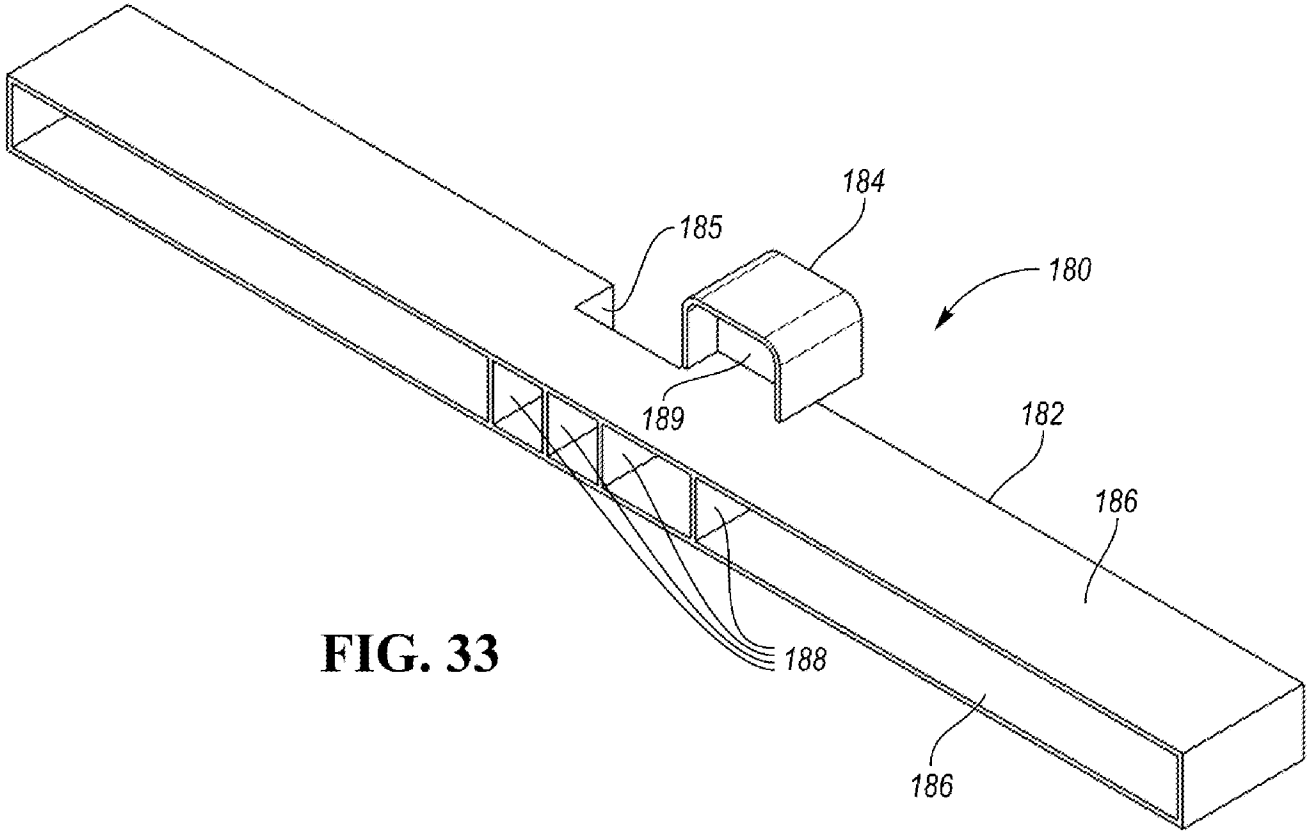
FIG. 33 shows a brace according to a second embodiment.

FIG. 33 shows a brace 180 according to a second embodiment, which could be used identically to the brace 80 of the previous embodiment (e.g. as shown in FIGS. 21, 22, 26, and 27). The brace 180 includes an elongated body portion 182 and an offset retaining portion 184. The retaining portion 184 is offset off the longitudinal axis of the body portion 182 and may be offset from the longitudinal center of the body portion 182 as well (i.e. toward one longitudinal end). A recess 185 may be formed through the upper wall 186 of the body portion 182 adjacent the retaining portion 184. The body portion 182 includes perpendicular ribs 188 between the walls 186.

Figure 34:
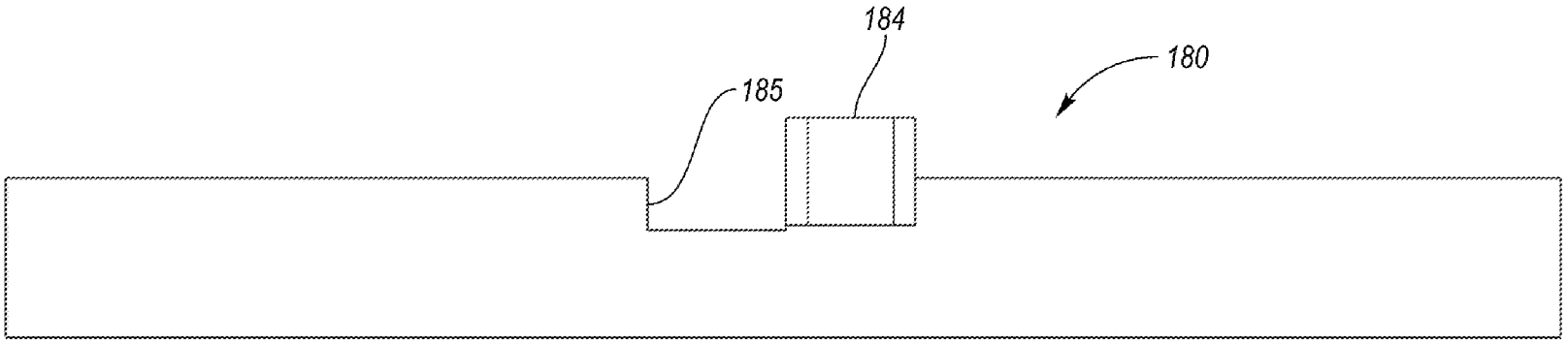
FIG. 34 is a top view of the brace of FIG. 33.
Figure 35:
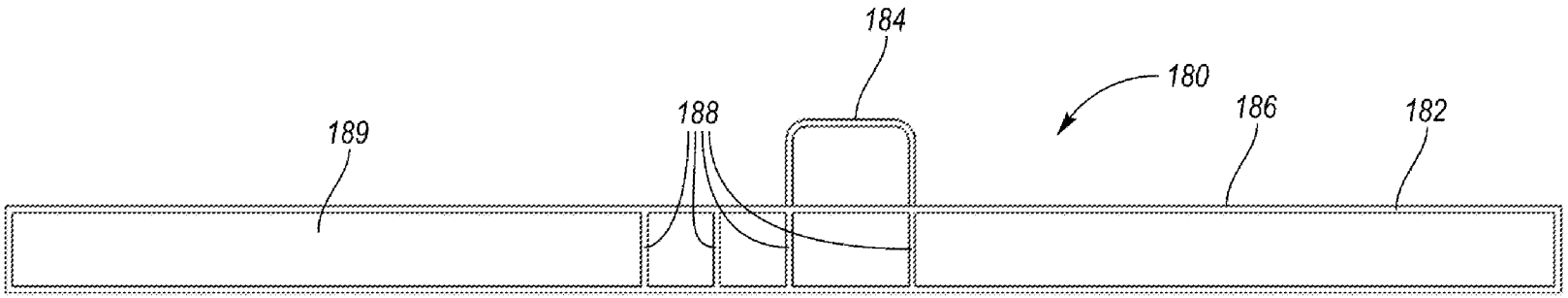
FIG. 35 is a side view of the brace of FIG. 33.

FIG. 34 is a top view of the brace 180. FIG. 35 is a side view of the brace 180. As can be seen in FIG. 35, the brace 180 includes a longitudinal mid-wall 189 extending from one outer wall 186 to the other and between the ribs 188. The mid-wall 189 is perpendicular to the outer walls 186 and to the ribs 188 and is positioned approximately halfway between opposite edges of the outer walls 186. The mid-wall 189 also extends into the retainer portion 184.

Figure 36:
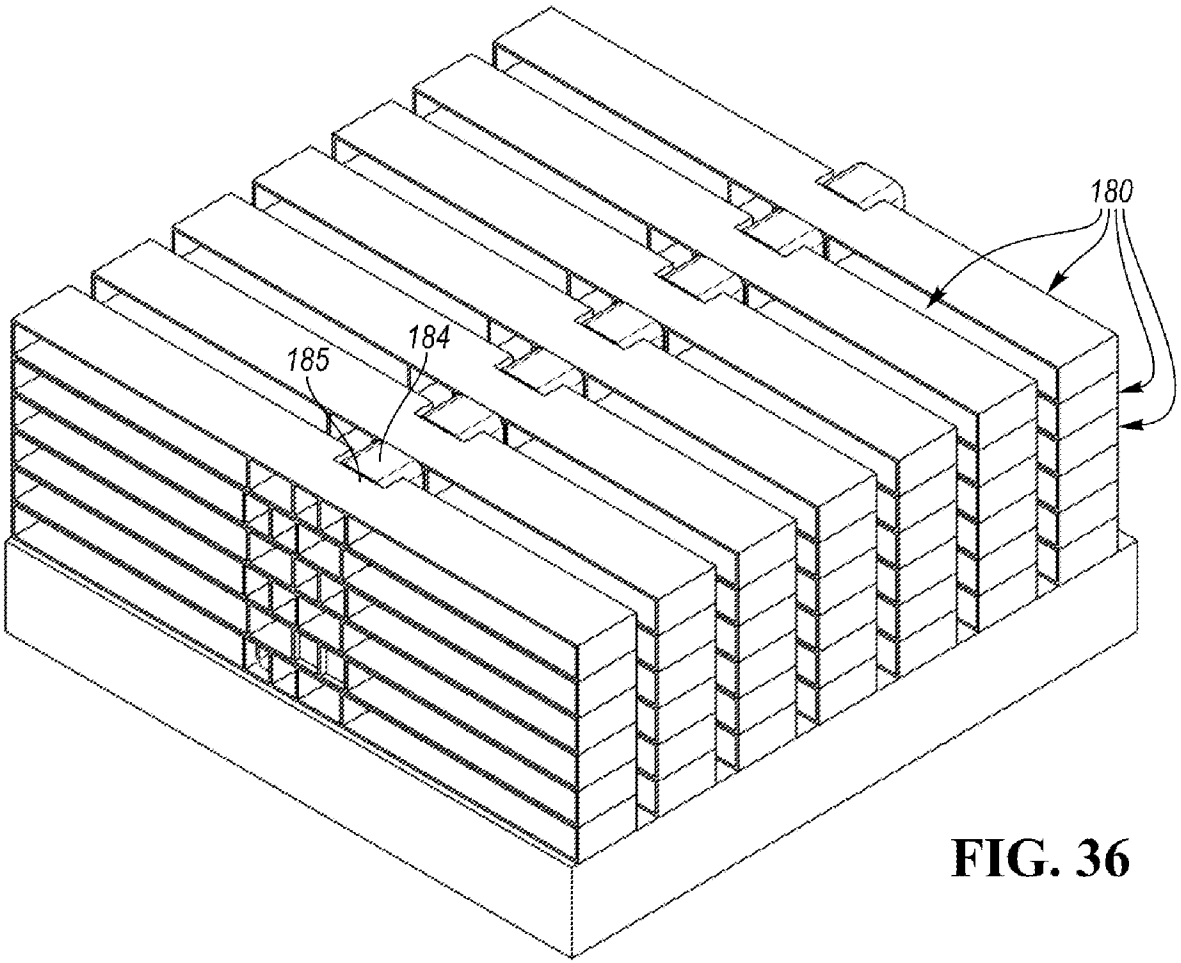
FIG. 36 shows a stack of a plurality of the braces of FIG. 33.

As shown in FIG. 36, by flipping subjacent braces 180, the retaining portions 184 of one brace 180 can be received partially in the recess 185 of the adjacent brace 180. This provides efficient storage and shipping of the braces 180 when not in use.

Figure 37:
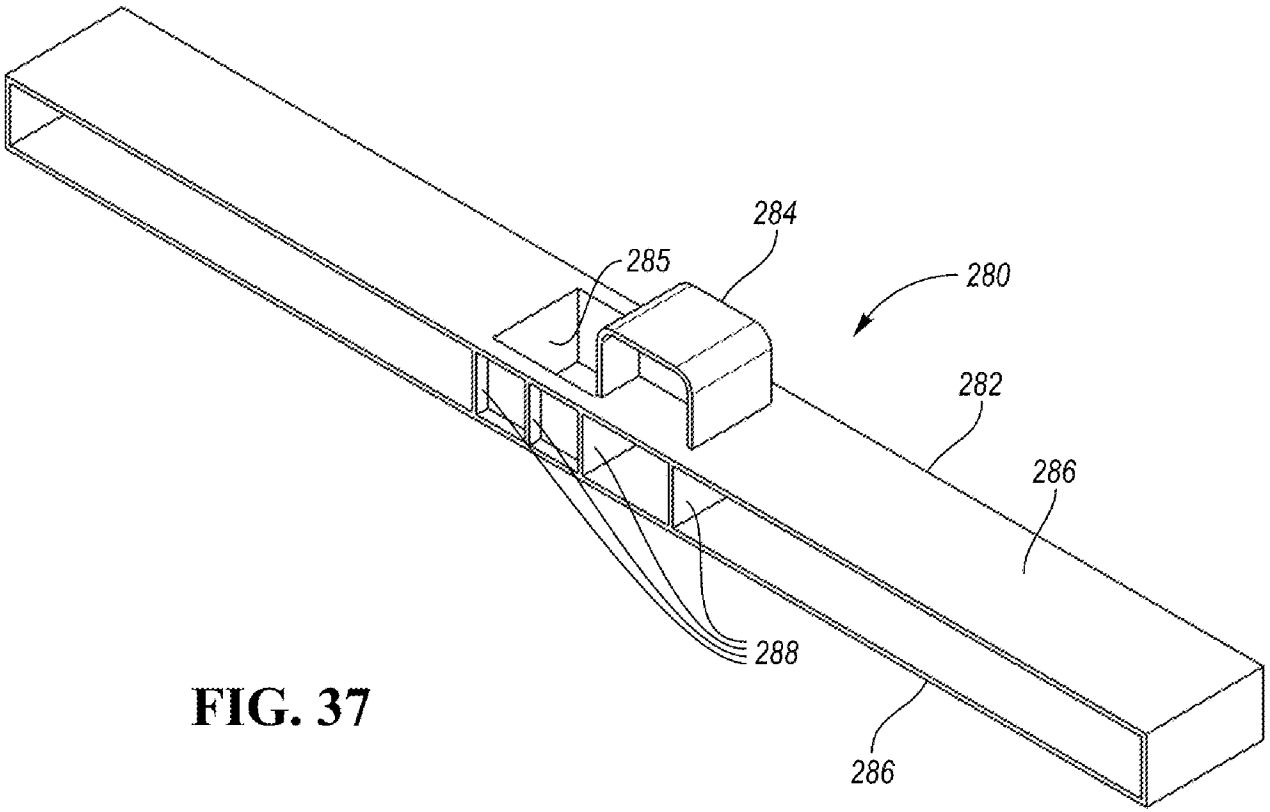
FIG. 37 shows a brace according to a third embodiment.
Figure 38:
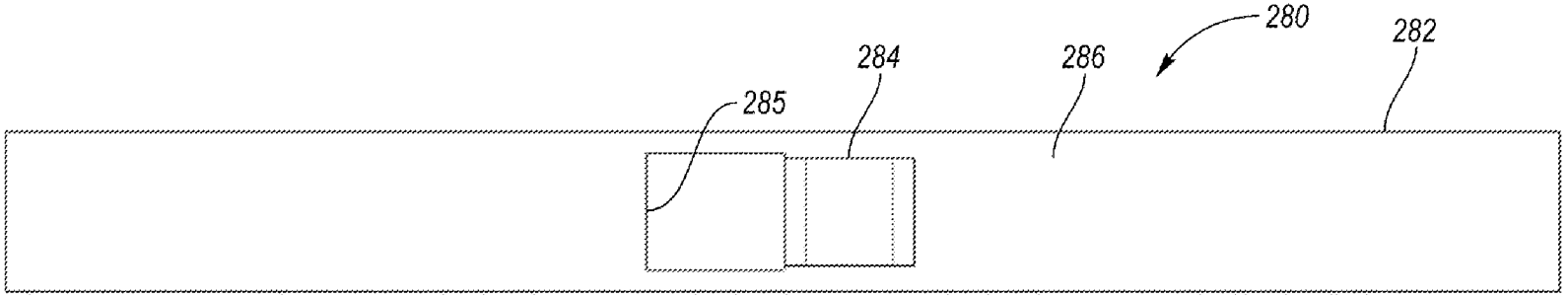
FIG. 38 is a top view of the brace of FIG. 37.
Figure 39:
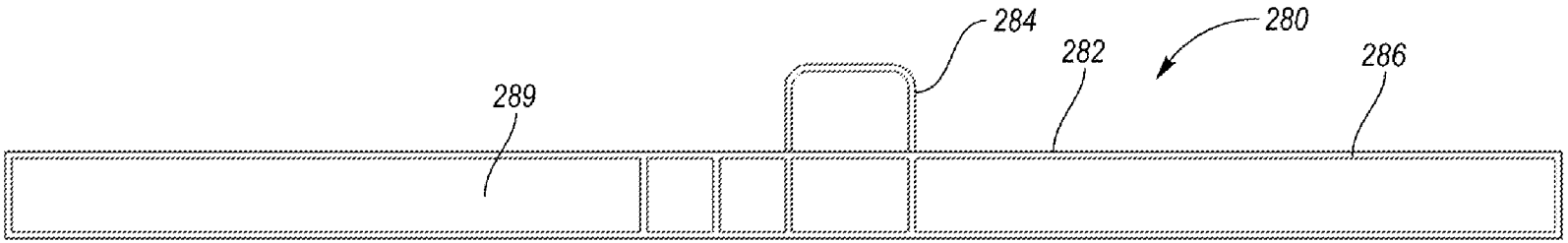
FIG. 39 is a side view of the brace of FIG. 37.

FIG. 37 shows a brace 280 according to a third embodiment, which could be used identically to the previous embodiments (e.g. as shown in FIGS. 21, 22, 26, and 27). The brace 280 includes an elongated body portion 282 having opposed elongated walls 286 connected by ribs 288. A retaining portion 284 comprises an inverted U-shaped wall adjacent a recess 285 formed through the wall 286 of the body portion 282. FIG. 38 is a top view of the brace 280. FIG. 39 is a side view of the brace 280. As can be seen in FIG. 39, the brace 280 includes a longitudinal mid-wall 289 extending from one outer wall 286 to the other and between the ribs 288. The mid-wall 289 is perpendicular to the outer walls 286 and to the ribs 288 and is positioned approximately halfway between opposite edges of the outer walls 286. The mid-wall 289 also extends into the retainer portion 284.

Figure 40:
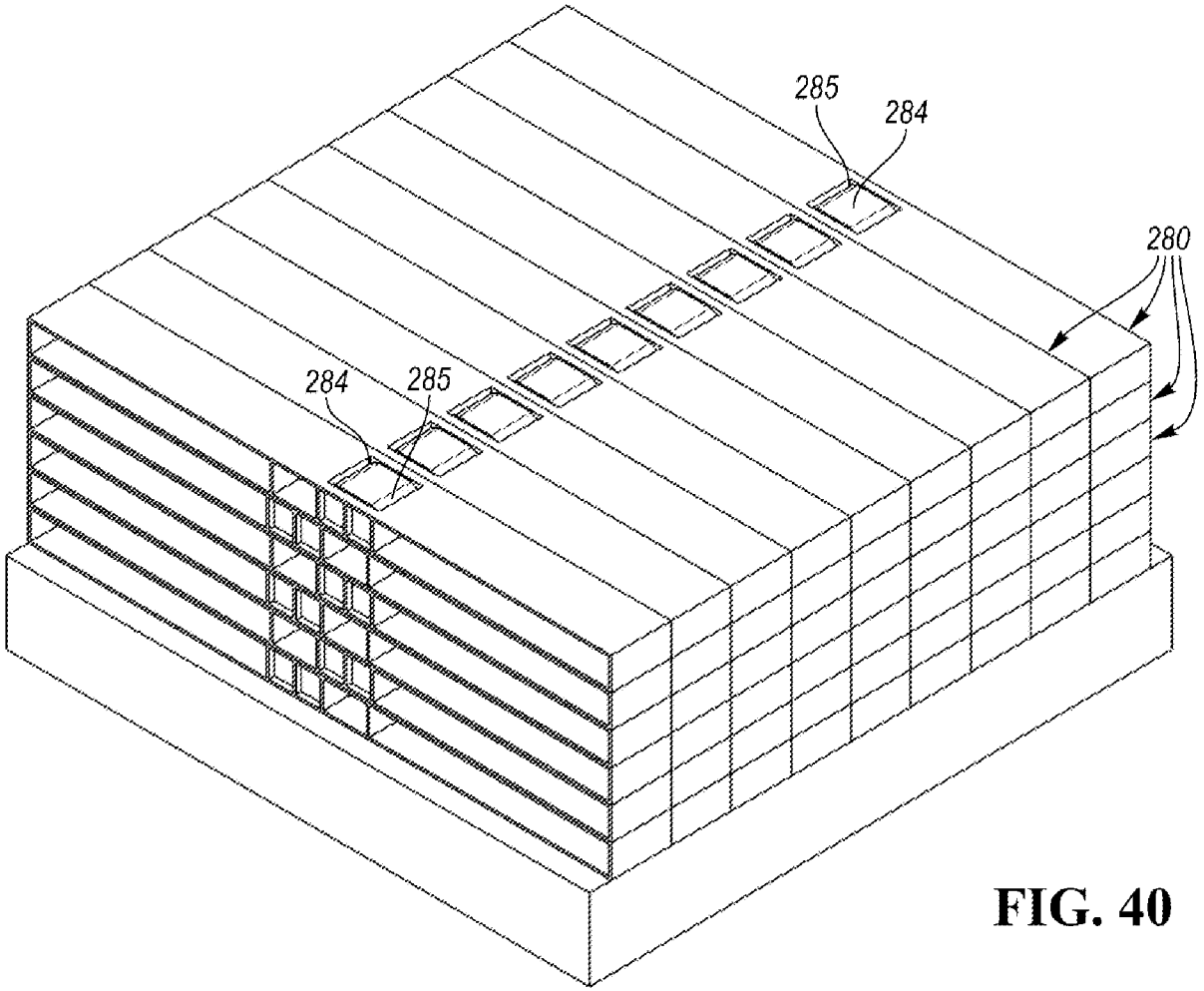
FIG. 40 shows a stack of a plurality of braces of FIG. 37.

Referring to FIG. 40, by flipping an upper brace 280, adjacent braces 280 have their retaining portions 284 received in the recesses 285 of the other, thereby providing a very efficient and compact storage.

Figure 41:
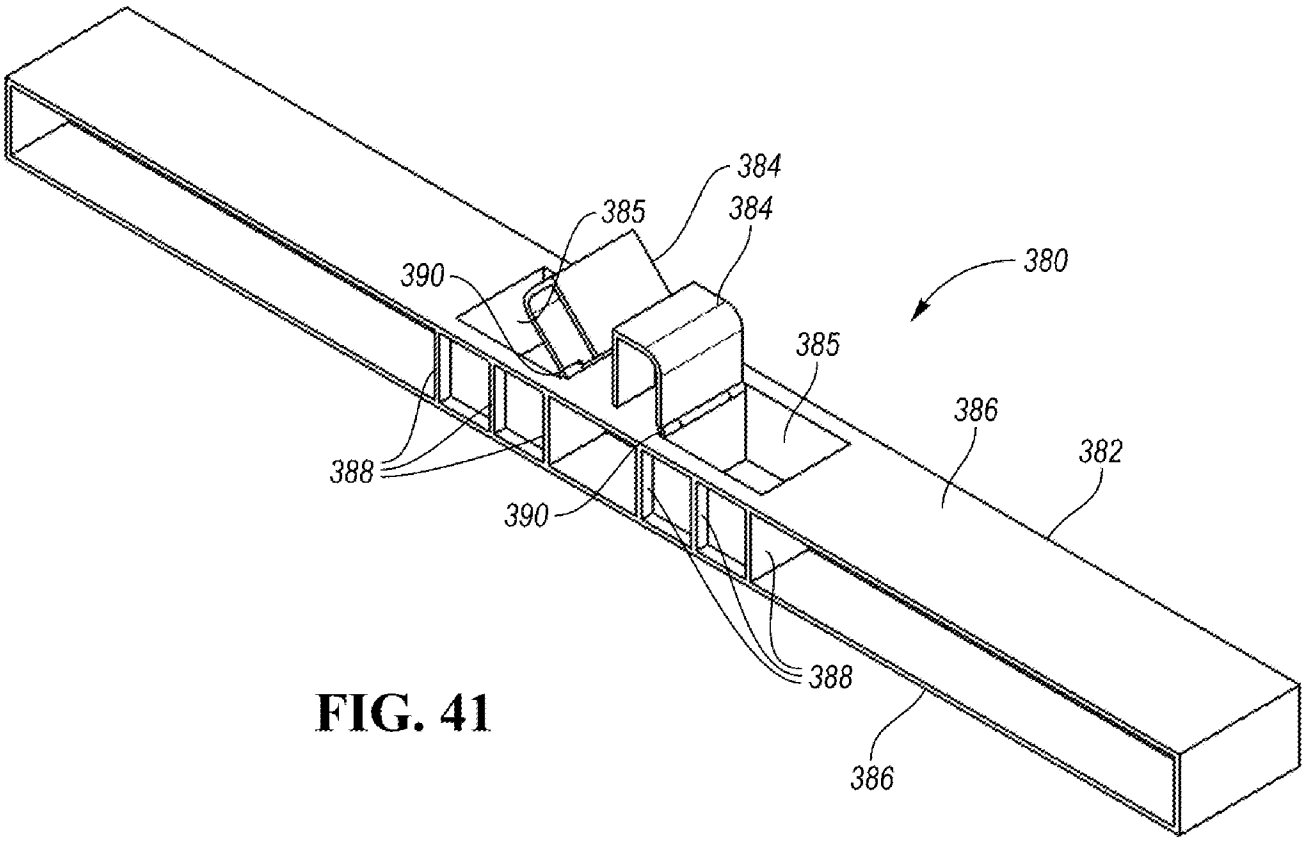
FIG. 41 shows a brace according to a fourth embodiment.
Figure 42:
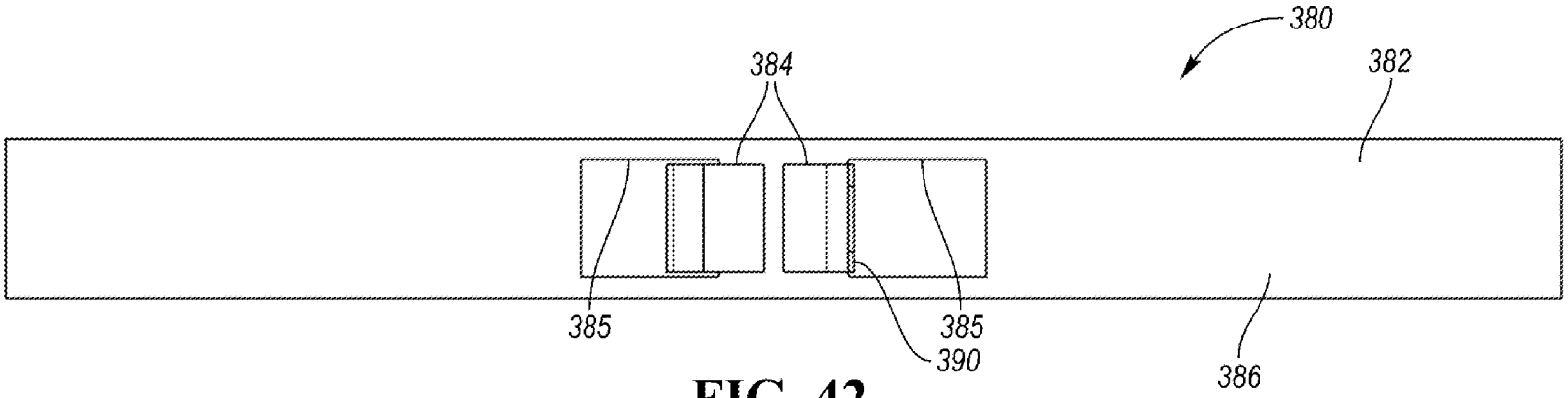
FIG. 42 is a top view of the brace of FIG. 41.

FIG. 41 shows a brace 380 according to a fourth embodiment, which could be used identically to the previous embodiments (e.g. as shown in FIGS. 21, 22, 26, and 27). The brace 380 includes an elongated body portion 382 and a two-part retaining portion 384. The elongated body portion 382 includes spaced apart walls 386 connected by ribs 388. The retaining portions 384 are connected to the upper wall 386 of the body portion 382 adjacent recess 385 by hinges 390. In FIG. 41, one of the retaining portions 384 is shown in the deployed position, while the other retaining portion 384 is shown being pivoted into the retracted position in its respective recess 385. FIG. 42 is a top view of the brace 380 of FIG. 41.

Figure 43:
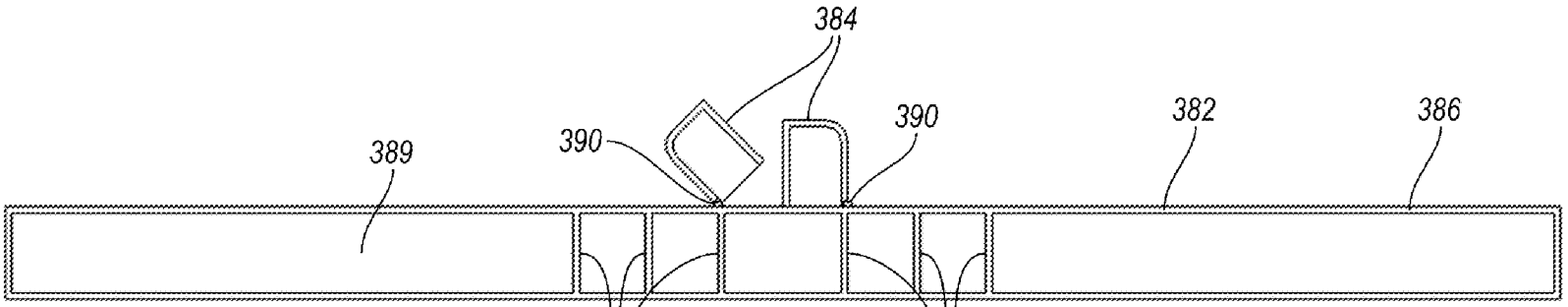
FIG. 43 is a side view of the brace of FIG. 41.

FIG. 43 is a side view of the brace 380 of FIG. 41, again with one of the retaining portions in the deployed position and the other retaining portion 384 being pivoted toward the retracted position. As can be seen in FIG. 43, the brace 380 includes a longitudinal mid-wall 389 extending from one outer wall 386 to the other and between the ribs 388. The mid-wall 389 is perpendicular to the outer walls 386 and to the ribs 388 and is positioned approximately halfway between opposite edges of the outer walls 386. The mid-wall 389 also extends into the retainer portions 384.

Figure 44:
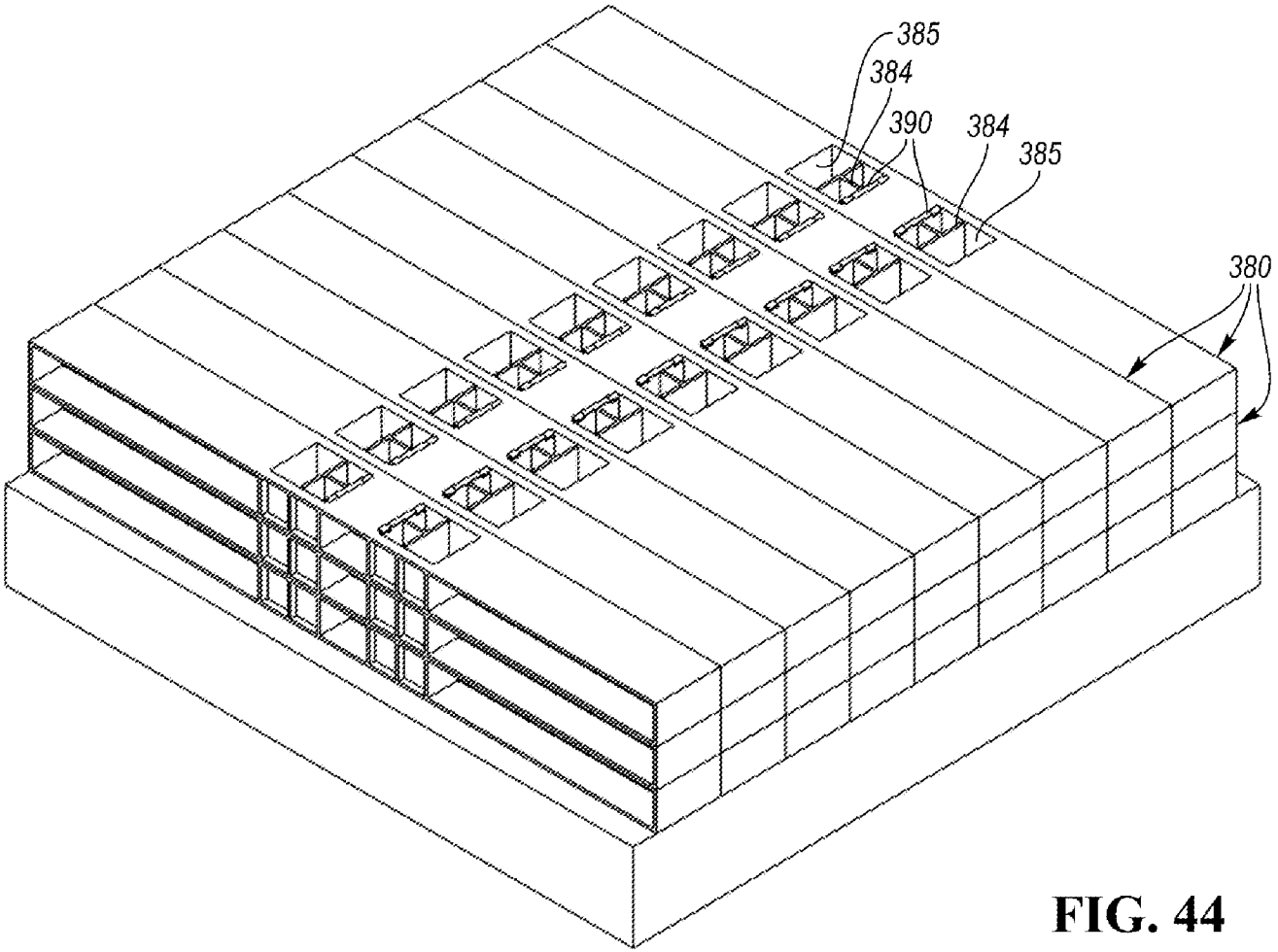
FIG. 44 shows a stack of a plurality of the braces of FIG. 41.

FIG. 44 shows a plurality of the braces 380 with all of their retaining portions 384 pivoted into their respective recesses 385 about their hinges 390 to provide a very compact and efficient storage configuration.

Figure 45:
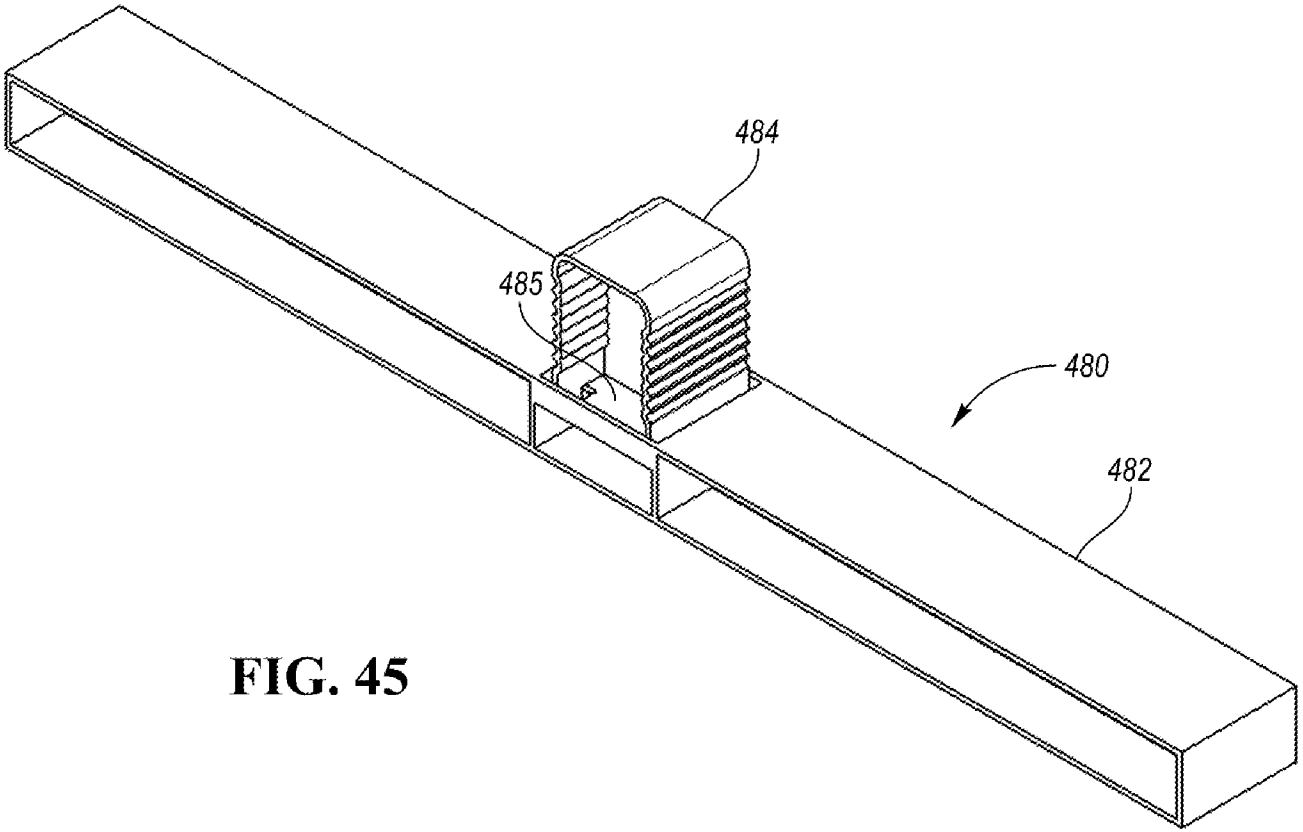
FIG. 45 shows a brace according to a fifth embodiment.

FIG. 45 shows a brace 480 according to a fifth embodiment in which the body portion 482 and retaining portion 484 are initially formed as separate pieces. The brace 480 could be used identically to the previous embodiments (e.g. as shown in FIGS. 21, 22, 26, and 27). The retaining portion 484 is partially received in a recess 485 formed in a body portion 482 and snap fit therein.

Figure 46:
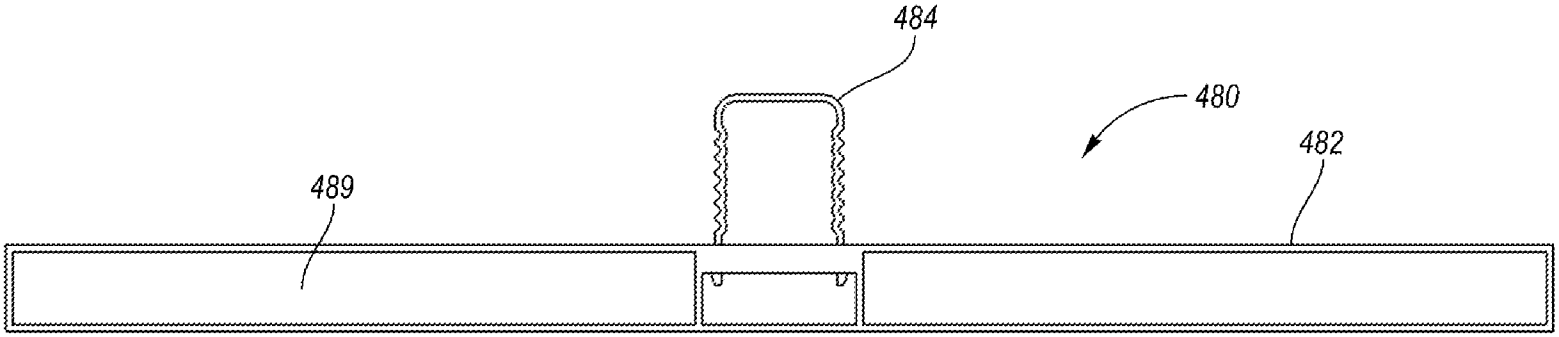
FIG. 46 is a side view of the brace of FIG. 45.

FIG. 46 is a side view of the brace 480. As can be seen in FIG. 46, the brace 480 includes a longitudinal mid-wall 489 extending from one outer wall 486 to the other and between the ribs 488. The mid-wall 489 is perpendicular to the outer walls 486 and to the ribs 488 and is positioned approximately halfway between opposite edges of the outer walls 486. The retainer portion 284 does not include the mid-wall 489.

Figure 47:
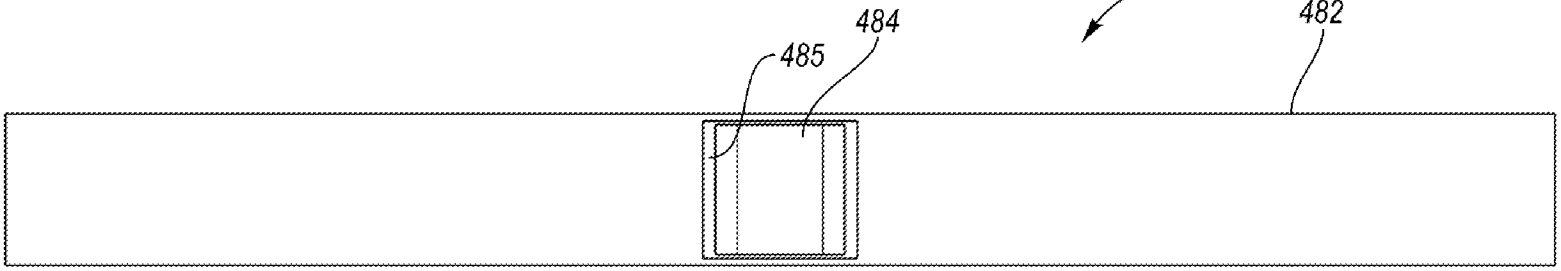
FIG. 47 is a top view of the brace of FIG. 45.
Figure 48:
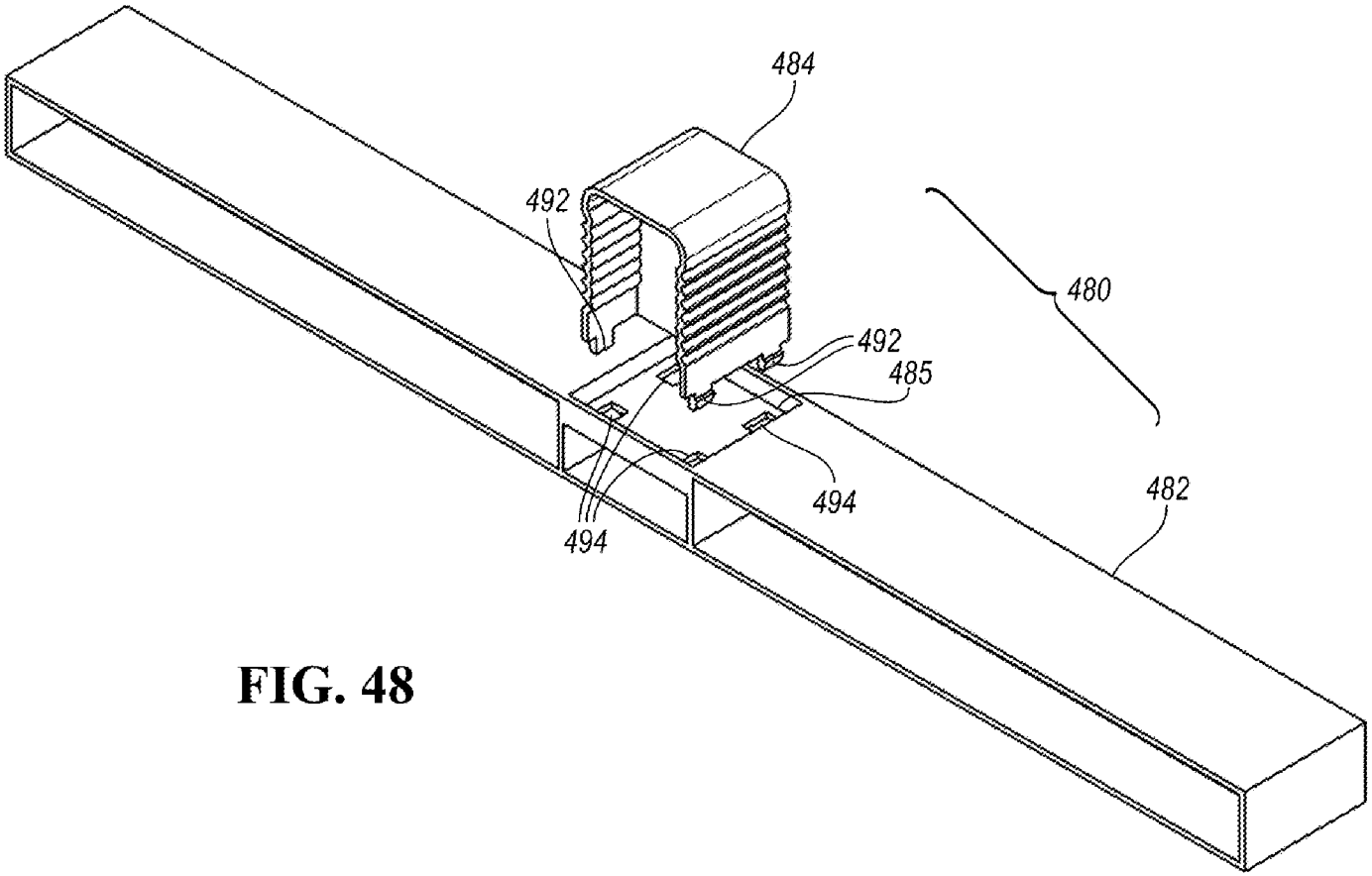
FIG. 48 is an exploded view of the brace of FIG. 45.

FIG. 47 is a top view of the brace 480. FIG. 48 is an exploded view of the brace 480. As shown, the retaining portion 484 includes a plurality of snap tabs 490 configured to snap fit into openings 494 in the recess 485.

Figure 49:
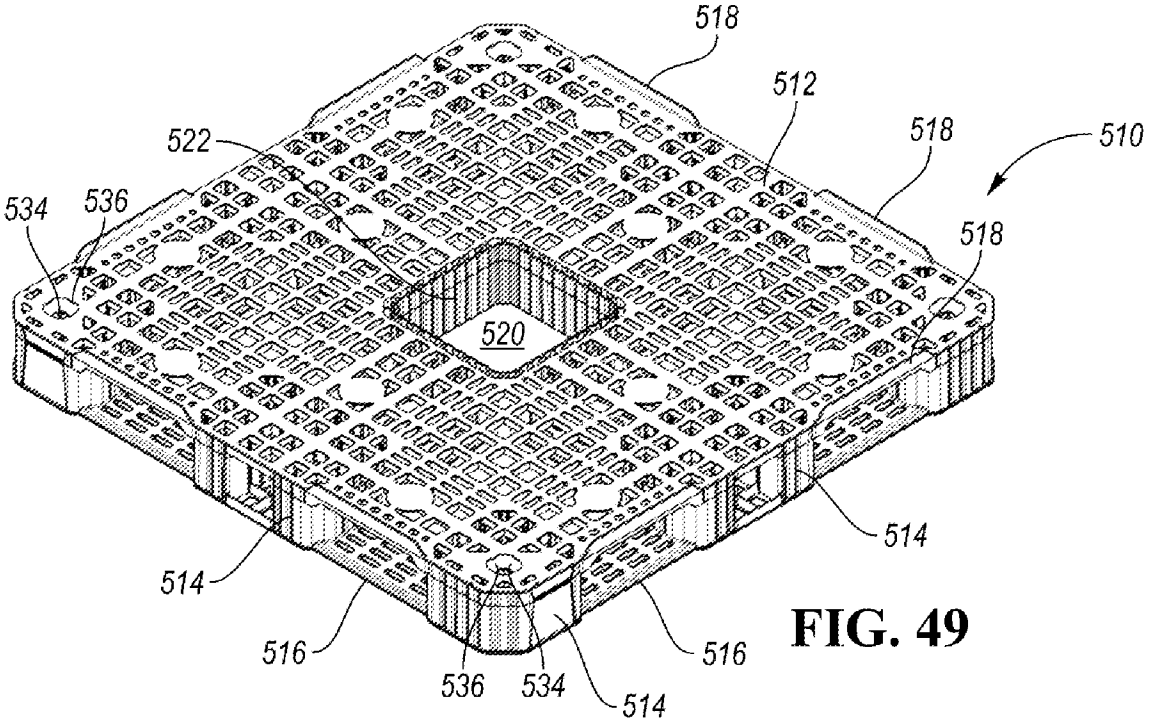
FIG. 49 is a perspective view of a pallet according to a sixth embodiment.

A pallet 510 according to a sixth embodiment is shown in FIG. 49. The pallet 510 includes a deck 512 having an upper surface for supporting goods thereon. The deck 512 is supported above a floor by a plurality of columns 514, which optionally may be connected to one another by runners 516. Peripheral lips 518 are formed at the periphery of the deck 512 and interrupted by the columns 514.

Figure 51:
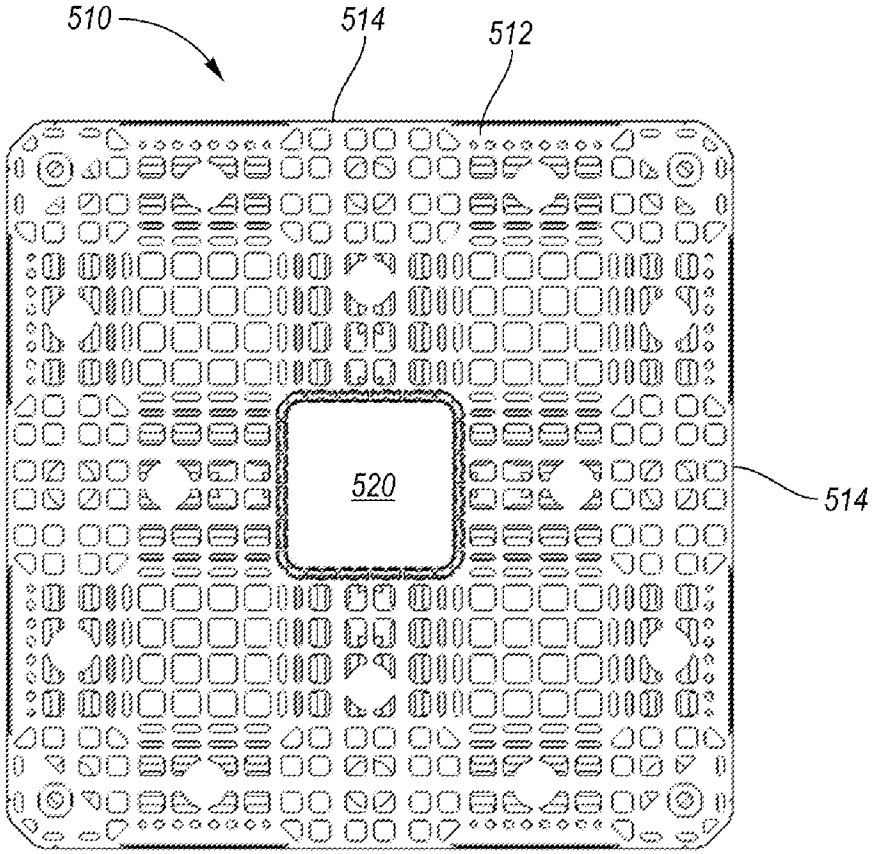
FIG. 51 is a top view of the pallet of FIG. 49.

A large central opening 520 is formed through a center portion of the deck 512 and passes entirely through the pallet 510. The opening 520 is large, i.e. at least approximately one fifth (⅕) each of the width and length of the deck 512. The opening 520 should be less than half each of the width and length of the deck 512. More preferably the opening 520 should be approximately one quarter (¼) to approximately one third (⅓) each of the width and length of the deck 512, and even more preferably approximately one quarter (¼) each of the width and length of the deck 512. The opening 520 is approximately the same width as the non-corner outer columns 514 aligned therewith, as shown in FIG. 51. In the example illustrated, the pallet 510 is approximately 48 inches by 48 inches and the opening 520 is approximately 12 inches by 12 inches. The opening does not have to be square, but could be elongated or rounded.

A peripheral wall 522 circumscribes the opening 520 to provide support to the center of the pallet 510 as a central column. The corner columns 514 each include an aperture 534 formed through the center of a concave upper surface 536. The concave upper surface 536 may be conical, as shown, or other self-centering shape.

Figure 50:
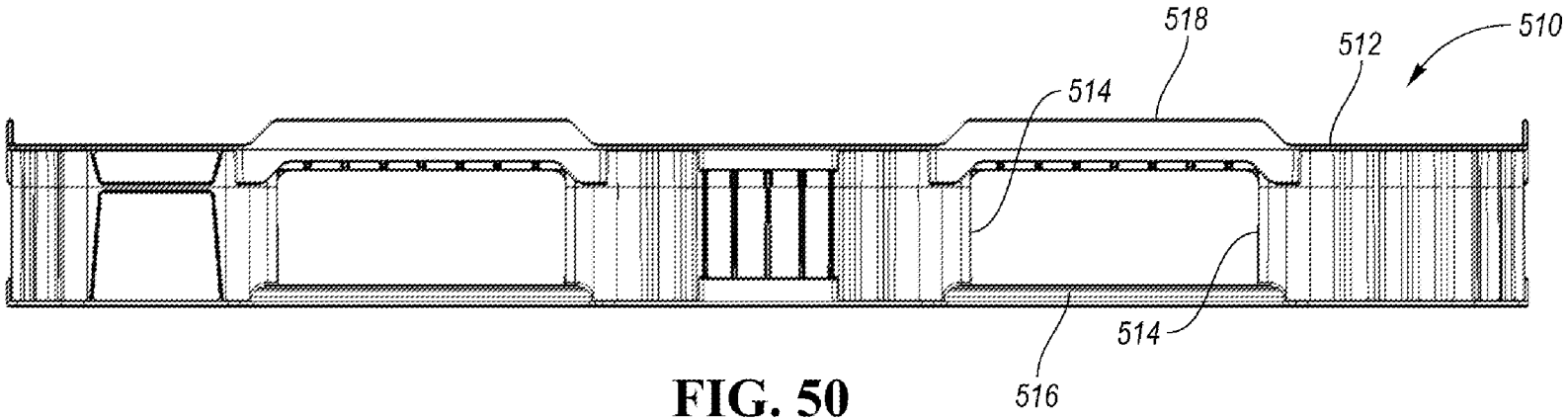
FIG. 50 is a side view of the pallet of FIG. 49.
Figure 52:
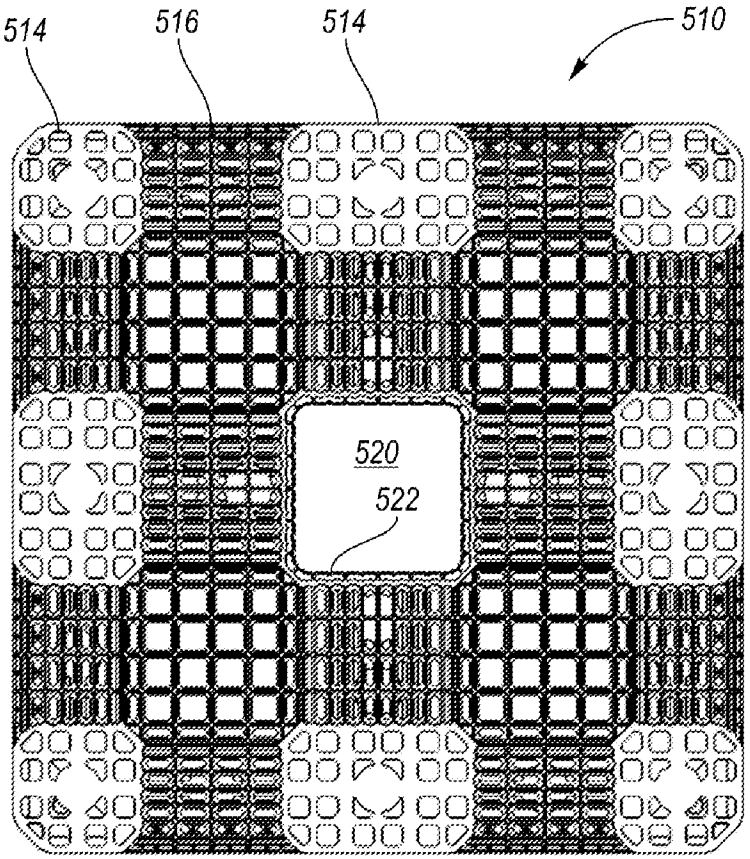
FIG. 52 is a bottom view of the pallet of FIG. 49.

FIG. 50 is a side view of the pallet 510. FIG. 51 is a top view of the pallet 510. FIG. 52 is a bottom view of the pallet 510.

The central opening 520 in the pallet deck 512 aids in unloading material from a box that sits on the pallet 510 without removing the box from the pallet 510. The shape of the opening 520 can be any shape. The box can be accessed through the opening 520 from below when the pallet 510 is elevated. For example, an automation arm can engage the opening 520 to cut into the box, as described above. The central opening 520 and the method for using the central opening 520 in a pallet deck 512 to access a box on the pallet 510 can be used with any of the pallets described herein. It can also be used with other types, shapes and sizes of pallets, such as half pallets, nestable pallets, thermoformed pallets, etc.

Figure 53:
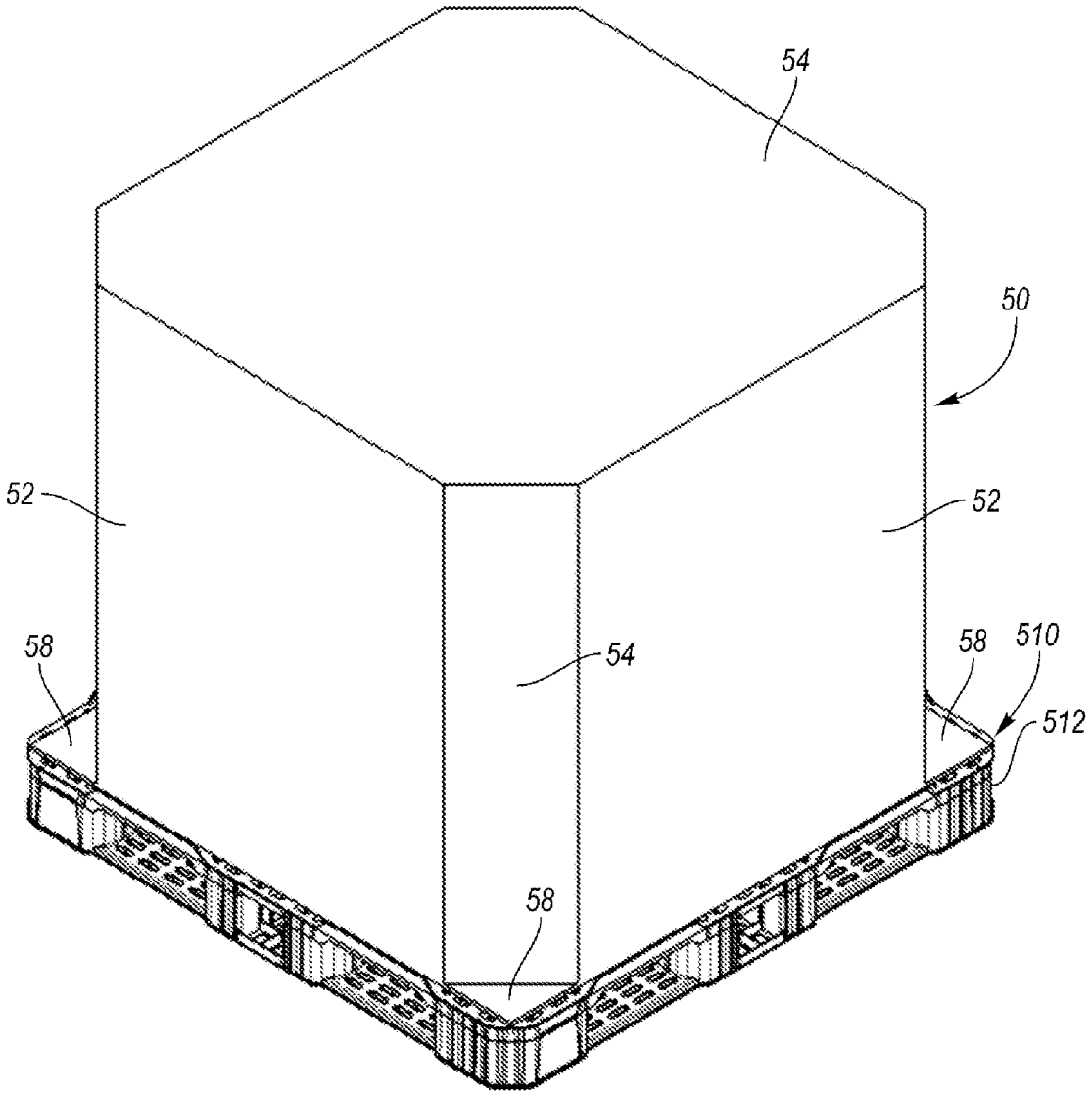
FIG. 53 shows the pallet of FIG. 49 with the box thereon.

FIG. 53 shows the pallet 510 with the box 50, such as a corrugated cardboard box 50, supported on deck 512 of the pallet 510. The box 50 includes four sidewalls 52 and an upper wall 54. A bottom wall (not visible) may seal the box 50 until it is opened (such as through the opening 520—all as described above). Corner walls 56 connect the sidewalls 52 to one another and have corner flaps 58 extending horizontally outward from a lower edge thereof. The corner flaps 58 are subsequently secured to the deck 512 of the pallet 510, as will be explained below.

Figure 54:
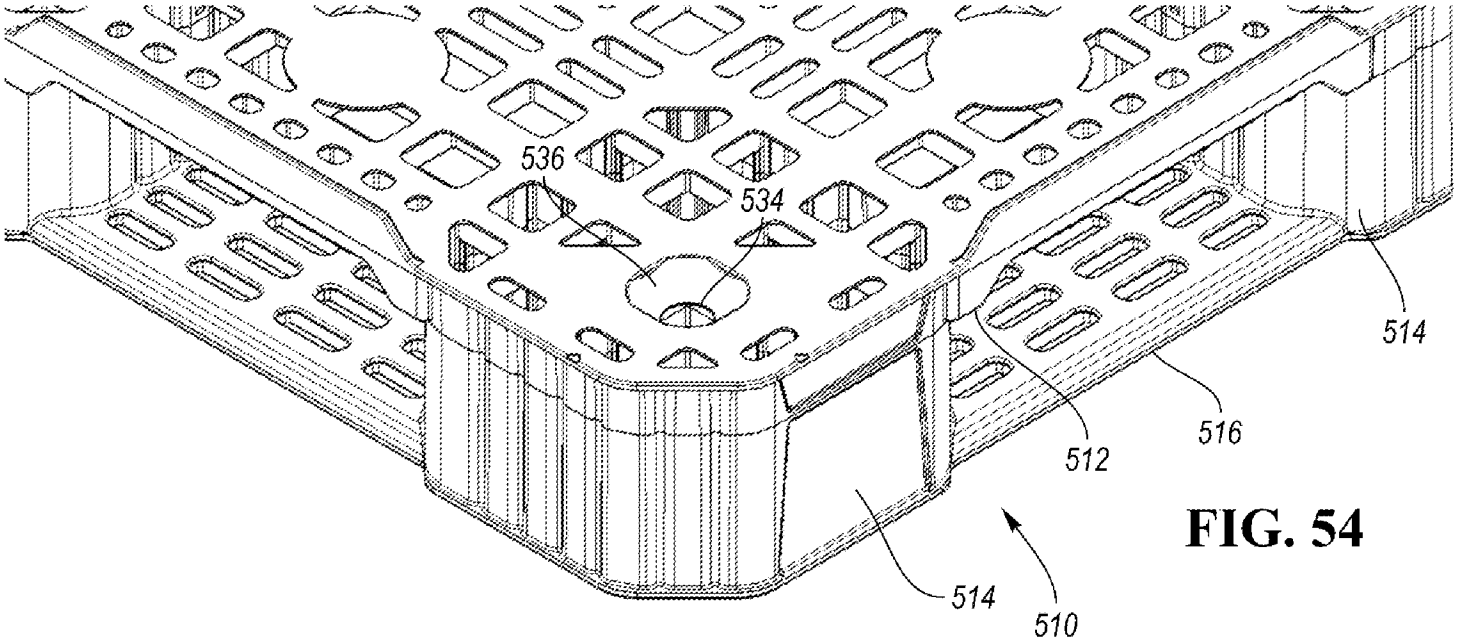
FIG. 54 is an enlarged view of one corner of the pallet of FIG. 49.

FIG. 54 is an enlarged view of one corner of the pallet 510. Again, the corner columns 514 each include the aperture 534 formed through the center of the concave upper surface 536, which is recessed relative to the support surface of the deck 512. The concave upper surface 536 may be conical, as shown, or other self-centering shape providing surfaces that slope toward the aperture 534.

Figure 55:
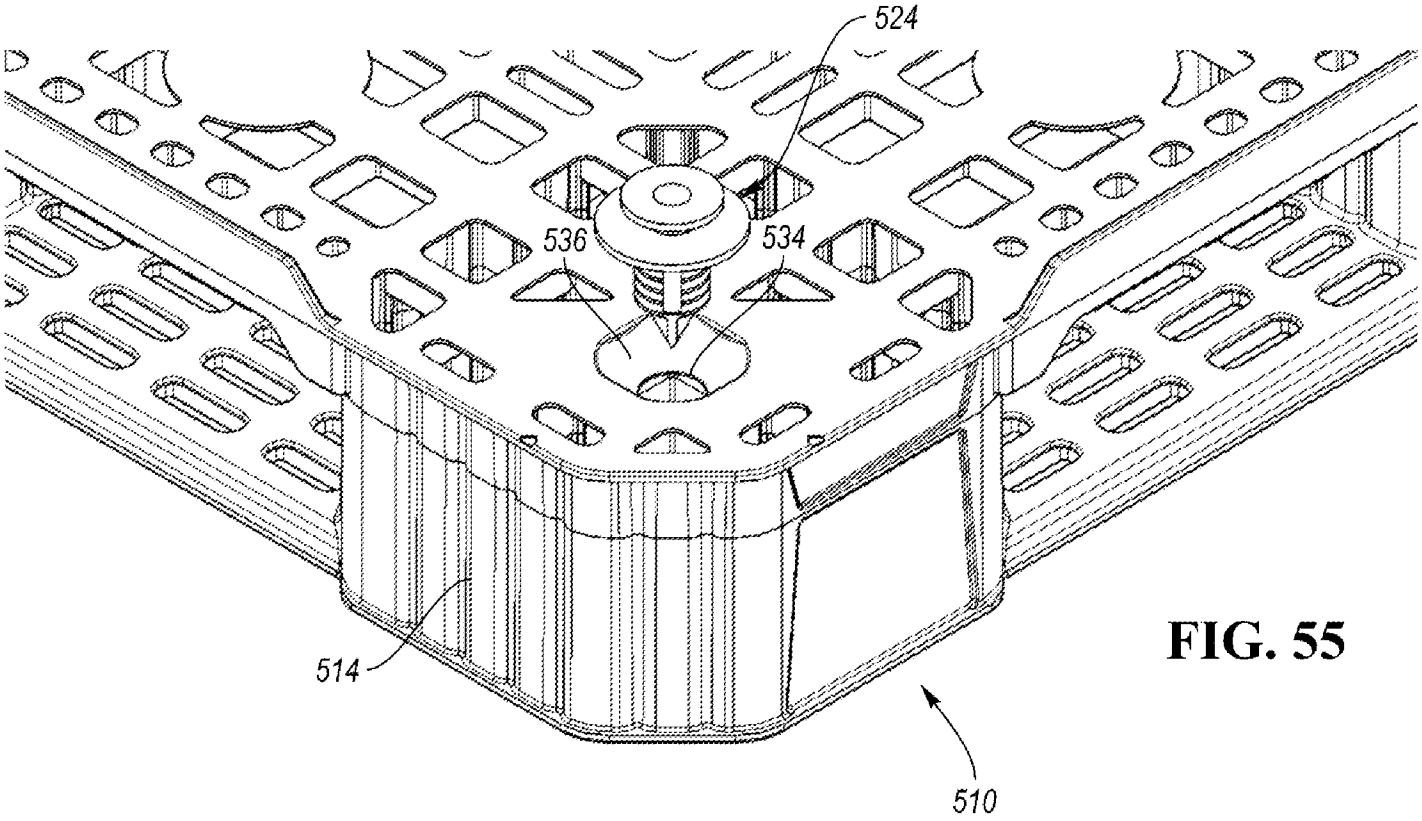
FIG. 55 shows the pallet of FIG. 54 and one possible fastener that could be used in the corner of the pallet.

FIG. 55 shows one possible fastener 524 positioned above the aperture 534 in the corner of the pallet 510 over one of the corner columns 514.

Figure 56:
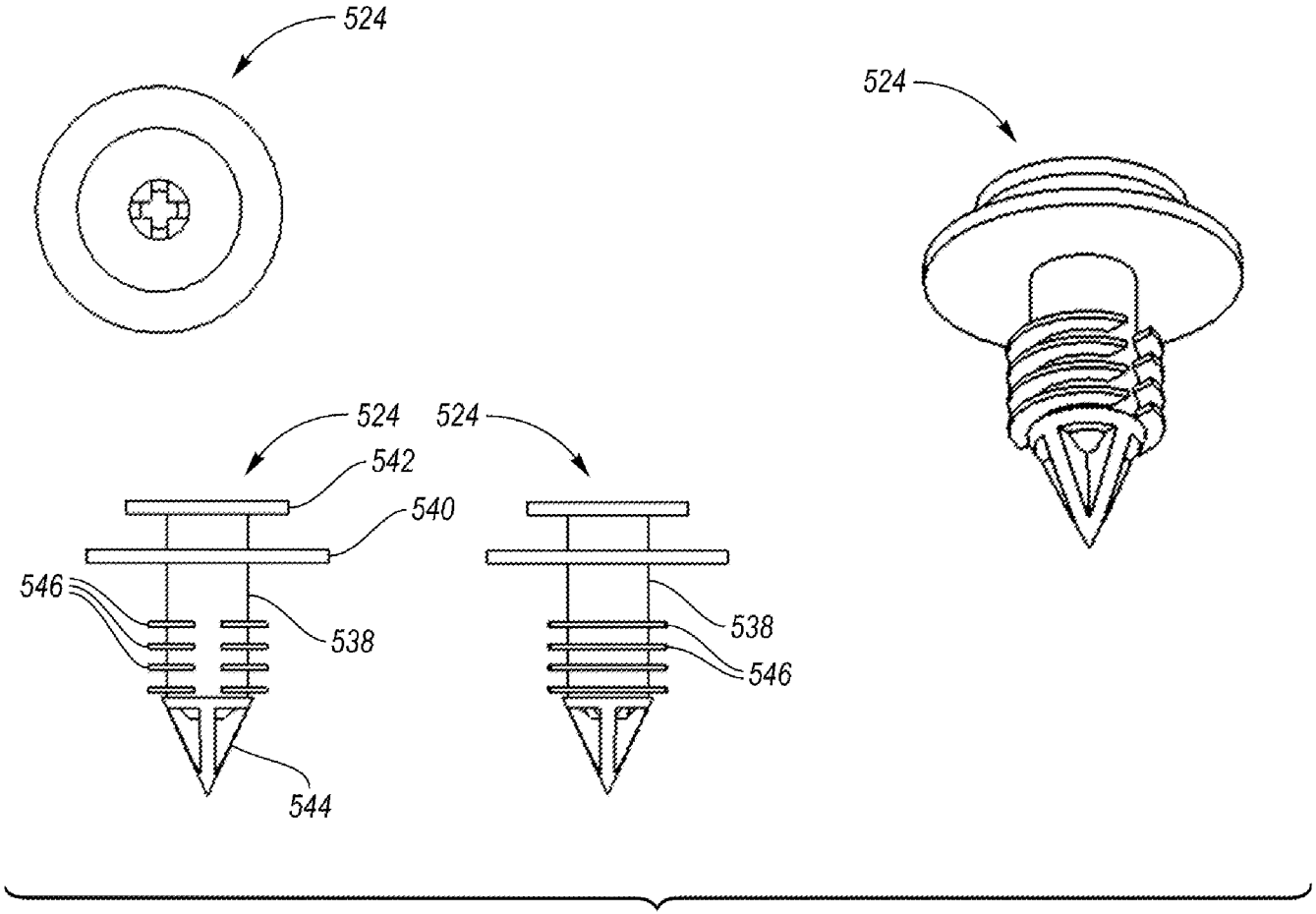
FIG. 56 shows multiple views of the fastener of FIG. 55 in detail.

FIG. 56 shows multiple views of the fastener 524 in detail. The fastener 524 includes a stem 538, which in this example is generally cylindrical and having a lower head 540 and an upper head 542. The upper head 542 is spaced above the lower head 540 to leave room for a pry tool, to remove the fastener 524. In this example, the heads 540, 542 are both annular, circumscribing the stem 538, but other shapes would be possible. At the lower end of the stem 538 is a tapered portion 544, which may comprise intersecting tapered ribs as shown, and which terminates in a relatively sharp point. Between the lower head 540 and the tapered portion 544 are a plurality of annular ribs 546 that can flex during insertion but are rigid enough to retain the fastener 524 in the aperture 534. The annular ribs 546 may each include a gap, as shown.

Figure 57:
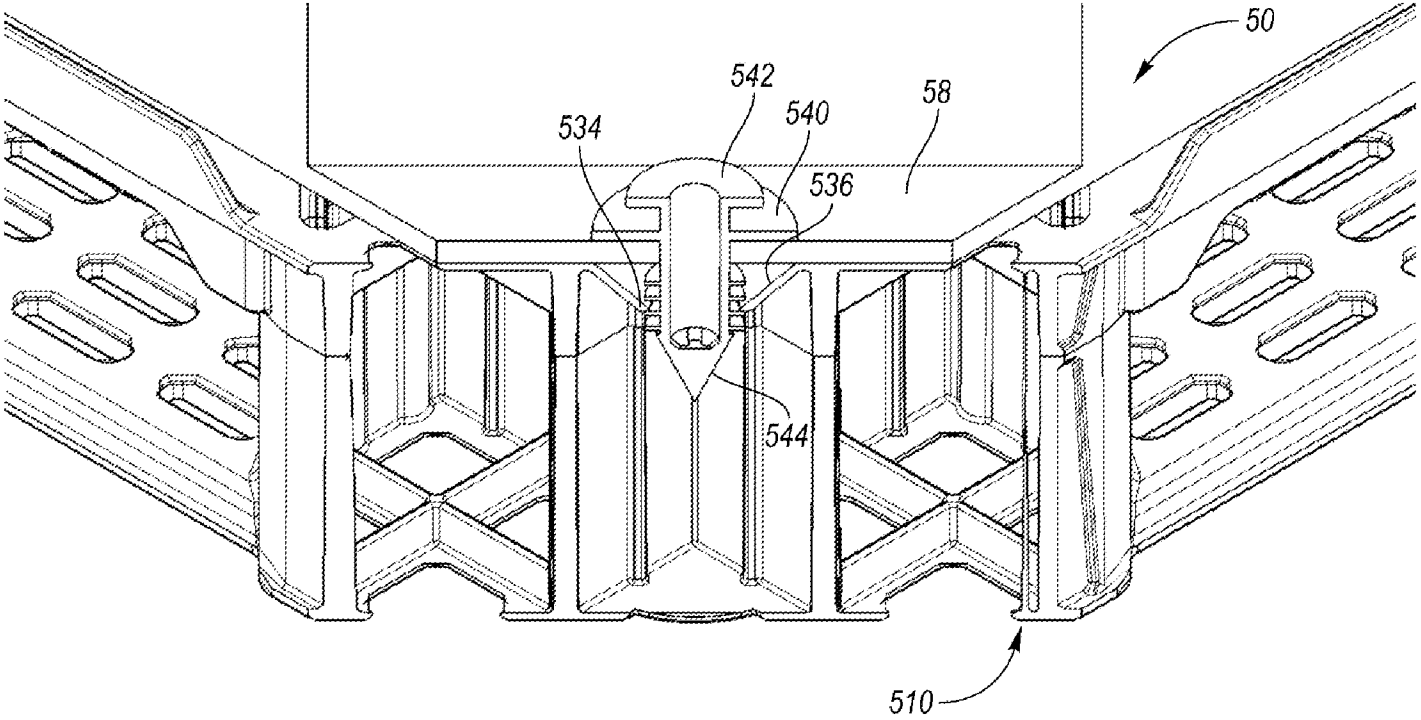
FIG. 57 shows the fastener installed through a flap of a box in the corner of the pallet of FIG. 55, partially broken away.

Referring to FIG. 57, in use, each fastener 524 is punched through one of the corner flaps 58 of the box 50 and snap fit into one of the apertures in the corners of the pallet 510. The fastener 524 secures the corner flap 58 to the corner column 514 to secure the box 50 to the pallet 510. The tapered portion 544 facilitates the fastener 524 punching through the corner flap 58 and together with the concave surface 536, facilitates the fastener 524 aligning with the aperture 536. The tapered portion 544 and at least one of the ribs 546 are inserted through the aperture 536 and the fastener 524 is retained in place by the rib 546.

Figure 58:
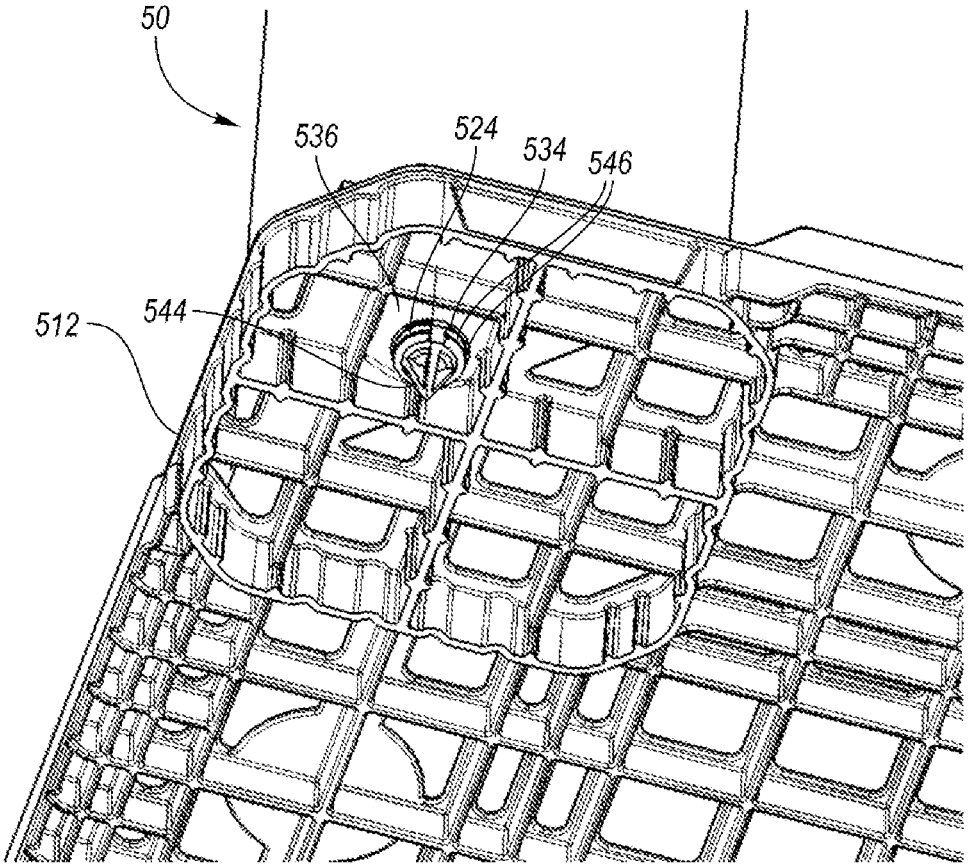
FIG. 58 shows a bottom view of the deck of FIG. 57, with lower portions of the pallet removed for illustration.

FIG. 58 shows a bottom view of the deck 512 of FIG. 57, with lower portions of the pallet 510 removed for illustration. As shown, the tapered portion 544 and some of the ribs 546 protrude downward past the concave surface 536 through the aperture 534. The ribs 546 retain the fastener 524 and retain the box 50 to the deck 512.

Figure 59:
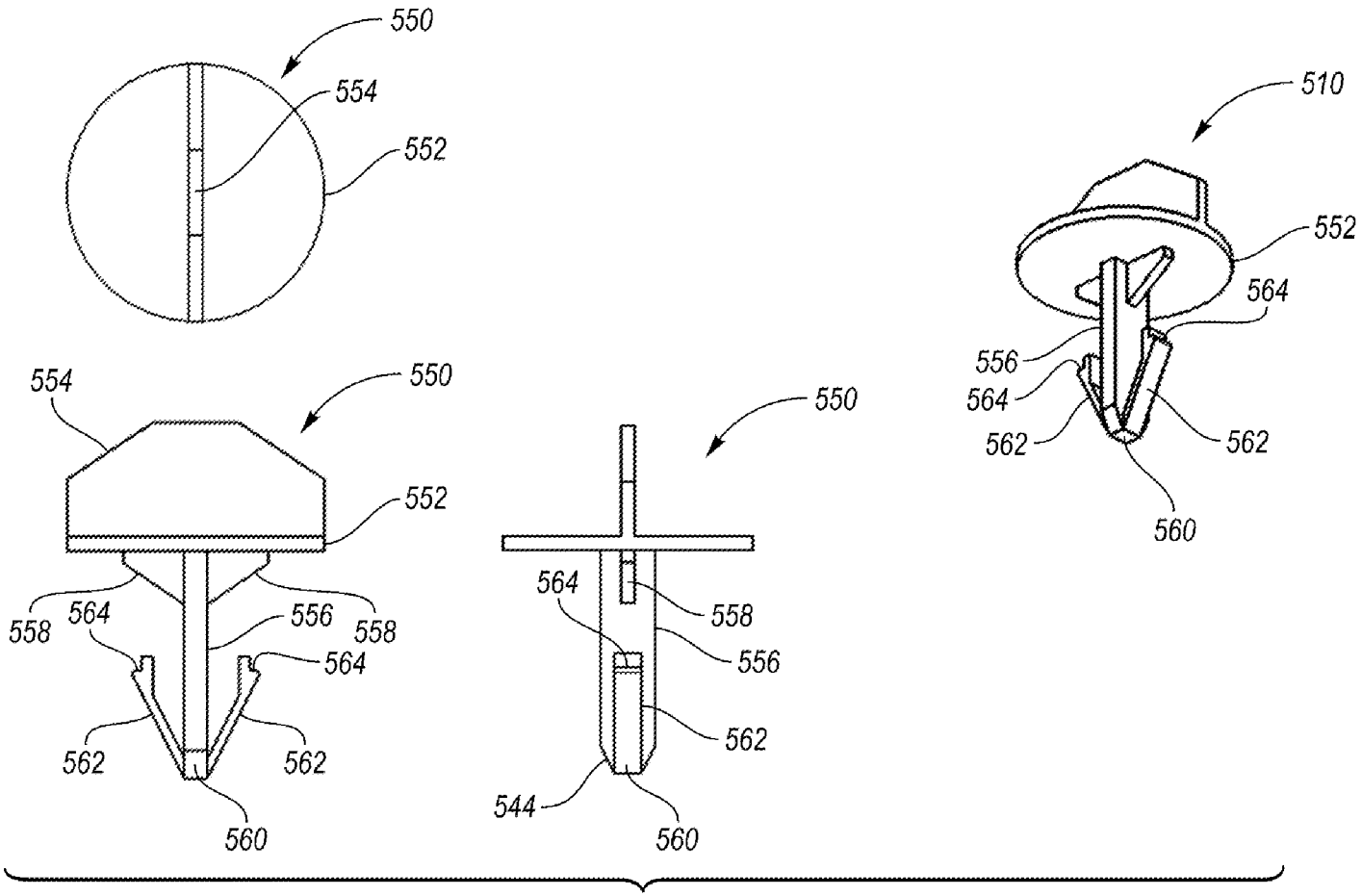
FIG. 59 shows multiple views of an alternative fastener.

FIG. 59 shows multiple views of an alternative fastener 550. The fastener 550 includes a head 552 having a perpendicular handle 554 extending upward therefrom and a stem 556 extending downward therefrom. Tapered gussets 558 reinforce the connection between the head 552 and the stem 556. A pair of flexible arms 562 extend upward and outward from a relatively sharp tapered portion 560 and terminate in a shoulder 584.

Figure 60:
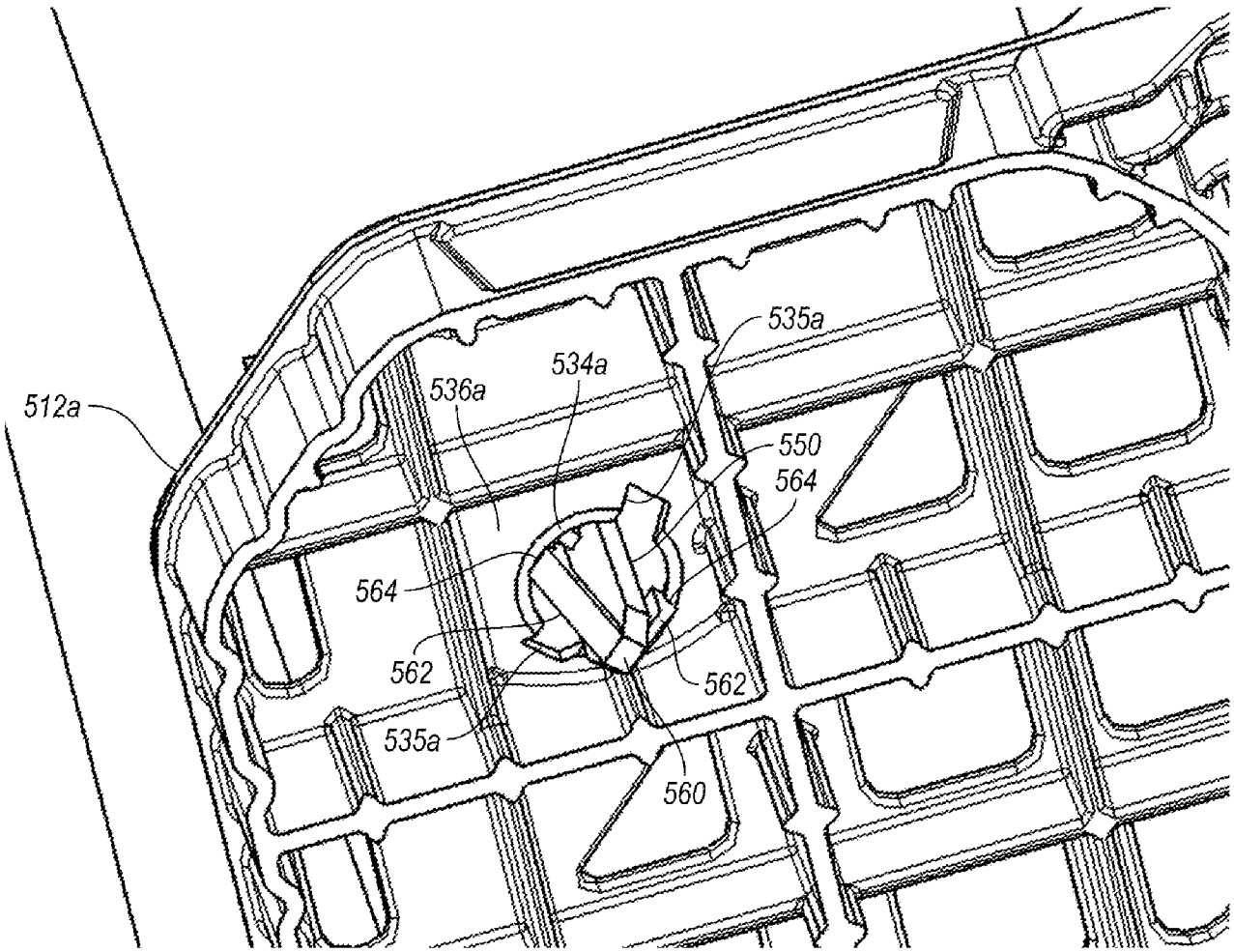
FIG. 60 shows the fastener of FIG. 59 being inserted into an alternate deck.

FIG. 60 shows the fastener 550 being inserted into an alternate deck 512*a*. The tapered portion 544 of the fastener 550 is punched through the corner flap (not shown) of the box 50 and into the aperture 534*a*. The aperture 534*a* of the deck 512*a* includes opposed portions of increased diameter 535*a*. As the arms 562 pass through the aperture 534*a* of the concave portion 536*a*, the arms 562 are flexed inward toward one another by the concave wall 536*a*. Once the arms 562 extend fully past the concave wall 536*a*, the arms 562 return to their normal undeflected position, with the edges of the concave wall 536*a* received in the shoulders 584 of the arms 562. This secures the fasteners 550 in the apertures 534*a* and secures the box 50 to the deck 512*a*.

Figure 61:
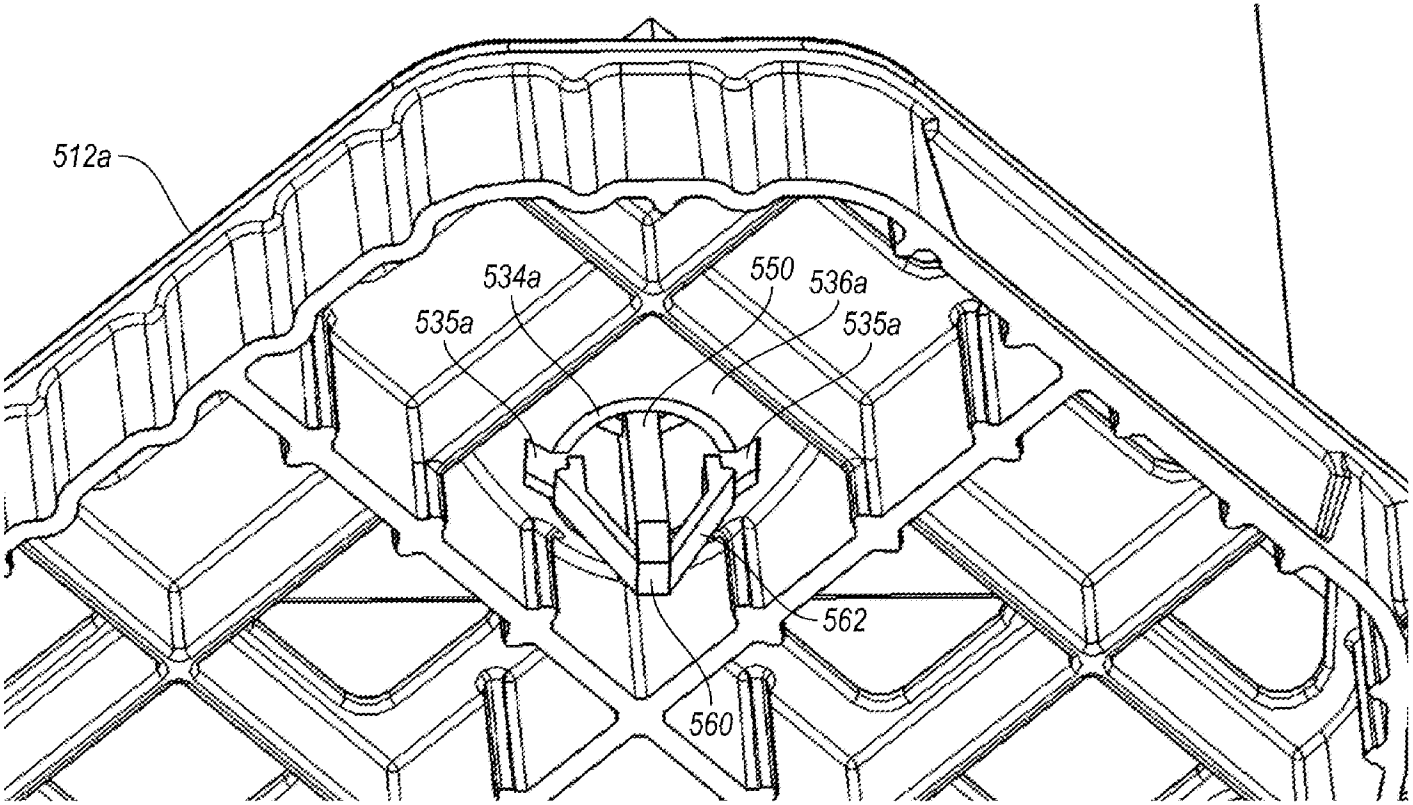
FIG. 61 shows the fastener and deck of FIG. 60 with the fastener rotated to a position for removal.

If one wants to remove the fasteners 550, one can rotate the fastener 550 using the handle 554 (FIG. 59) to the position shown in FIG. 61. By aligning the arms 562 with the portions of increased diameter 535*a* of the aperture 534*a*, the fastener 550 can be removed from the deck 512*a*.

Figure 62:
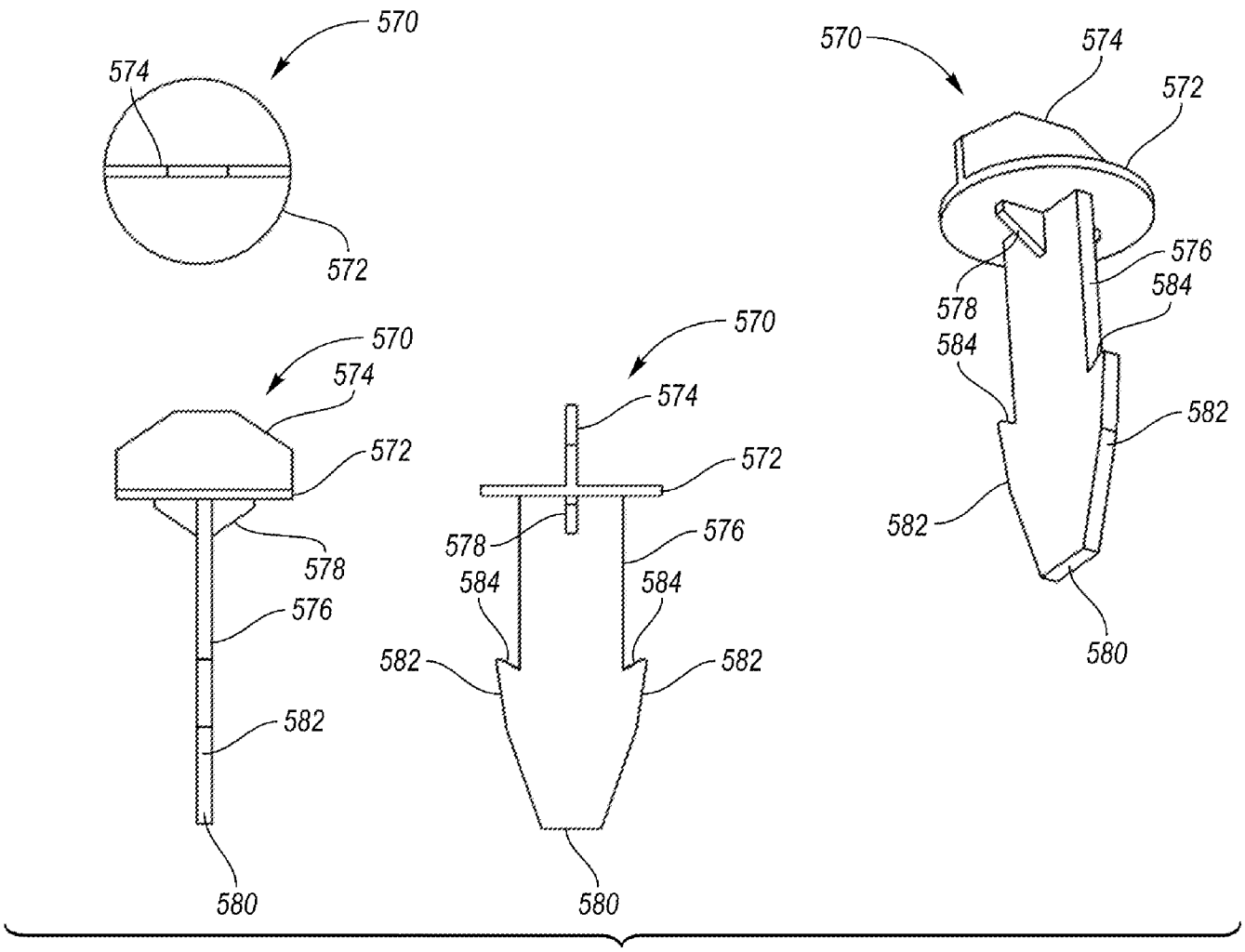
FIG. 62 shows multiple views of an alternative fastener.

FIG. 62 shows an alternative fastener 570. The fastener 570 includes a head 572 having a perpendicular handle 574 extending upward therefrom and a stem 576 extending downward therefrom. Tapered gussets 578 reinforce the connection between the head 572 and the stem 576. A pair of rigid arms 582 contiguous with the stem 576 extend upward from a relatively sharp tapered portion 580 and terminate in a shoulder 584 that is defined by an undercut in each arm 582. In this embodiment, the stem 576 and the arms 582 are coplanar.

Figure 63:
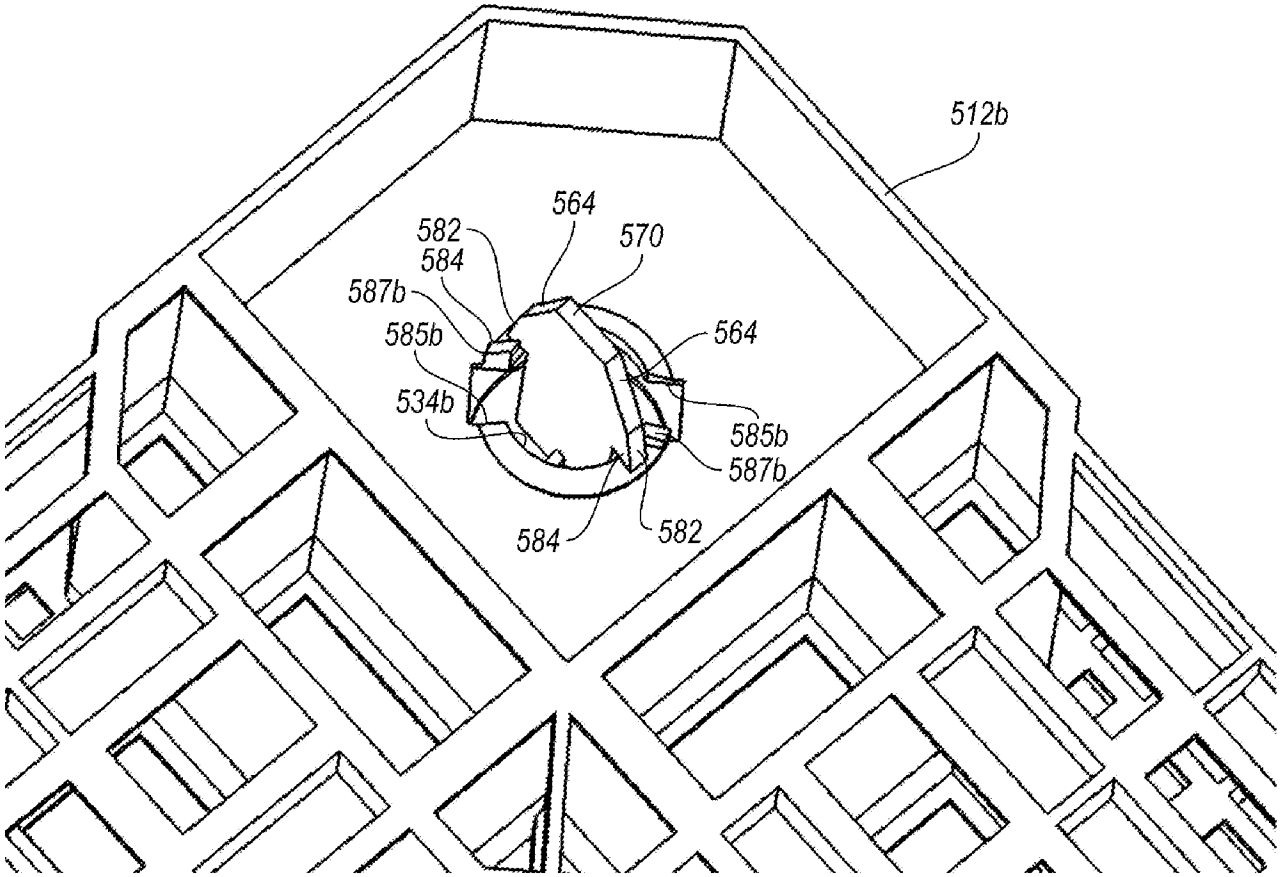
FIG. 63 shows the fastener of FIG. 62 installed in an alternative deck.

FIG. 63 shows the fastener 570 inserted into an alternate deck 512*b*. The fastener 570 is punched through the corner flap (not shown) of the box 50 and into the aperture 534*b*. The aperture 534*b* of the deck 512*a* includes opposed portions of increased diameter 585*b*. The arms 582 are aligned with the portions of increased diameter 585*b* during insertion. Once the arms 582 extend fully through the aperture 534*b*, the fastener 570 is rotated about 350 degrees until the arms 582 contact stops 587*b* adjacent the portions of increased diameter 585*b*, with the edges of the wall adjacent the aperture 534*b* received in the shoulders 584 of the arms 582. This secures the fasteners 570 in the apertures 534*b* and secures the box 50 to the deck 512*b*.

If one wants to remove the fasteners 570, one can rotate the fastener 570 using the handle 574 (FIG. 62) to re-align the arms 582 with the portions of increased diameter 535*a* of the aperture 534*a*.

Figure 64:
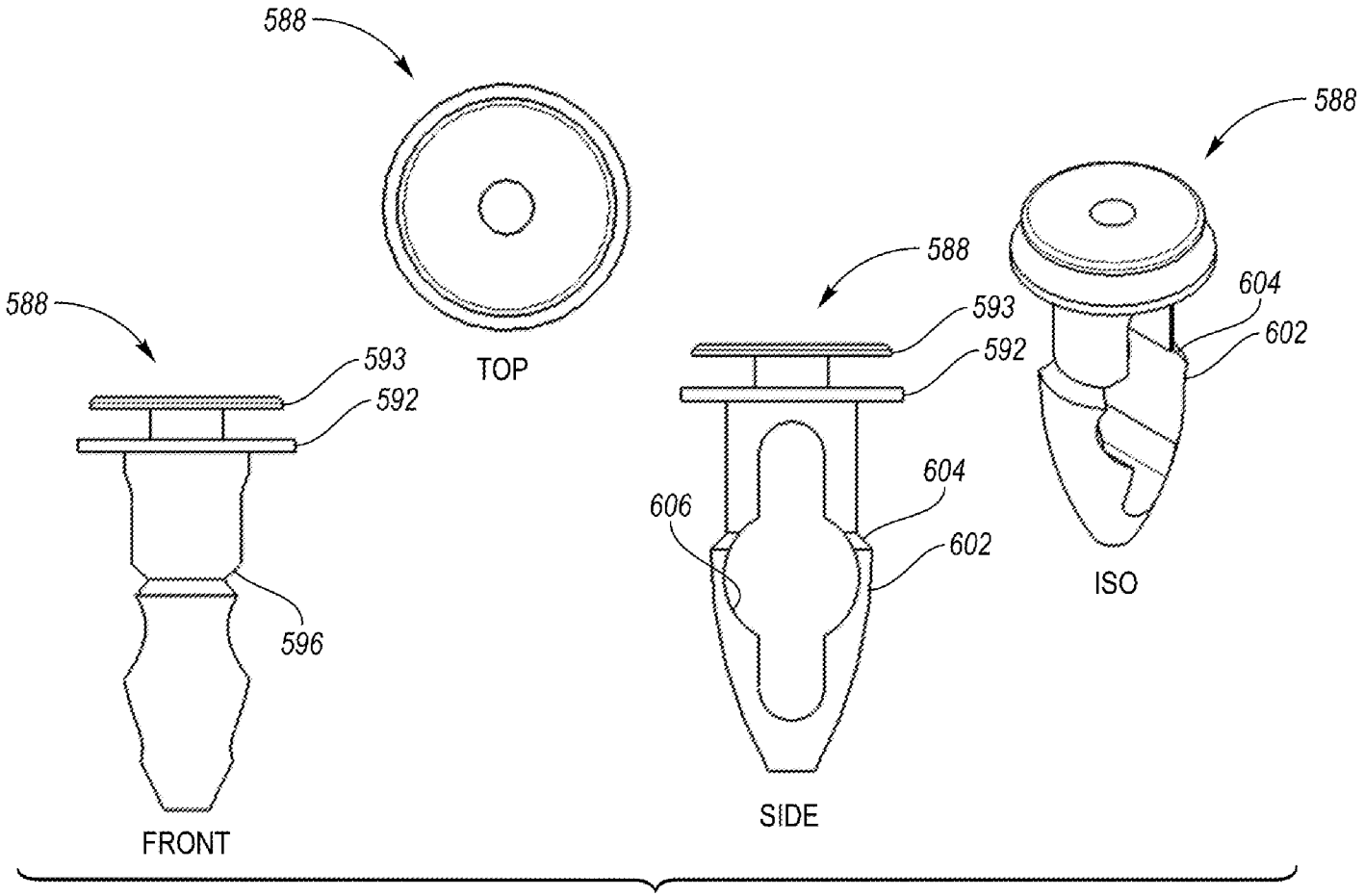
FIG. 64 shows multiple views of an alternative fastener.

FIG. 64 shows another alternative fastener 588 having a stem 596. A lower head 592 is spaced below an upper head 593 at an upper end of the stem 596. The stem 596 includes a portion of increased diameter 602 and a tapered shoulder 604 at the upper end of the portion of increased diameter 602. The stem 596 may also include a large opening 606 therethrough, extending in a direction perpendicular to the longest axis of the stem 596.

Figure 65:
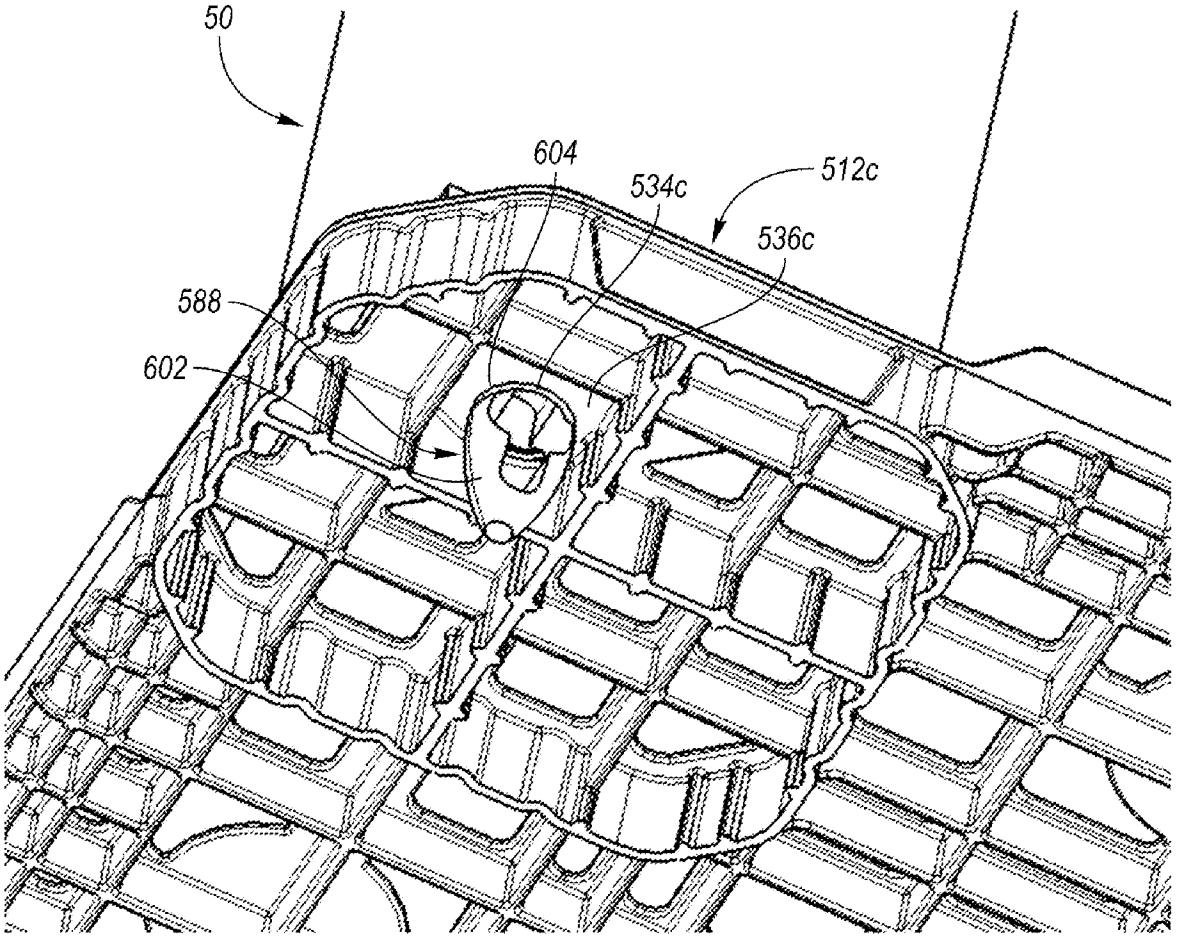
FIG. 65 shows the fastener of FIG. 64 inserted into an alternate deck.
Figure 68:
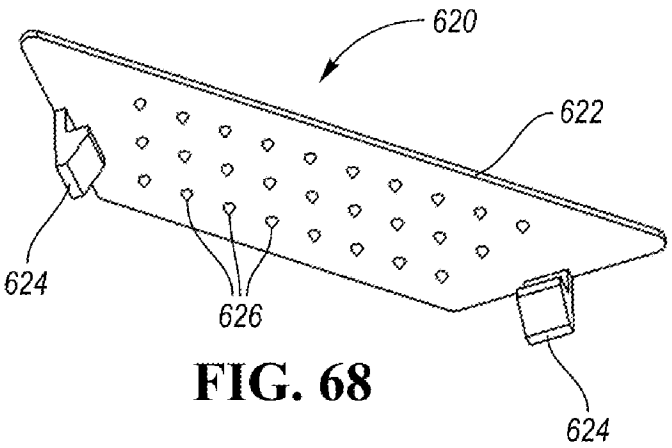
FIG. 68 is a bottom perspective view of the corner cap of FIG. 66.
Figure 69:
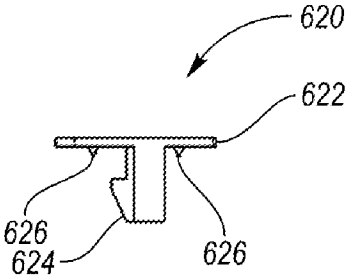
FIG. 69 is a side view of the corner cap of FIG. 66.
Figure 66:
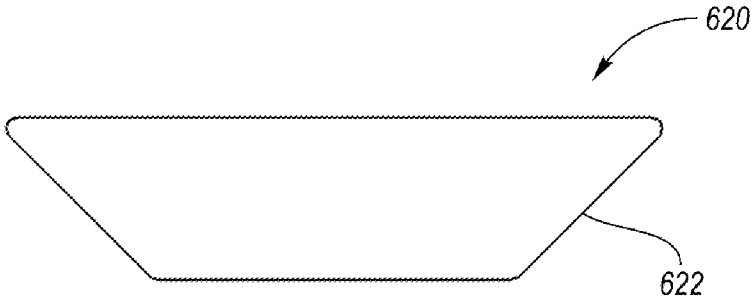
FIG. 66 is a top view of an alternate corner cap.
Figure 67:
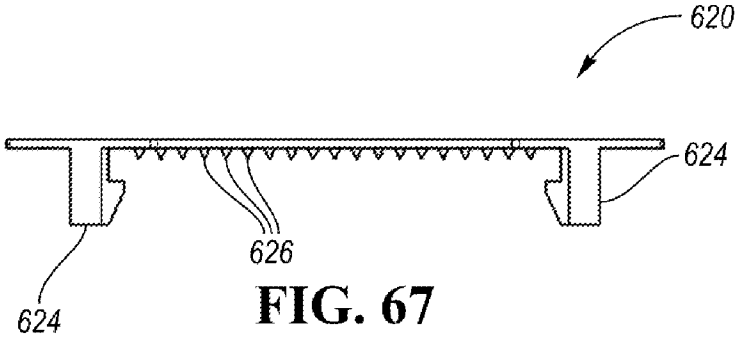
FIG. 67 is a front view of the corner cap of FIG. 66.

FIG. 65 shows the fastener 588 inserted into an alternate deck 512*c*. The fastener 588 is punched through the corner flap (not shown) of the box 50 and into the aperture 534*c* formed in a concave wall 536*c*. The portion of increased diameter 602 flexes inward as it is inserted through the aperture 534*c* and then expands again, such that the shoulder 604 retains the fasteners 588 in the aperture 534*c* and secures the box 50 to the deck 512*c*. Similar fasteners 588 would be used in the other three corner flaps.

FIGS. 66-69 show an alternate corner cap 620. The corner cap 620 is molded as a single piece of plastic. The corner cap 620 includes a trapezoidal upper wall 622 and a pair of snap-fit connectors 624 adjacent opposite side edges. A plurality of small teeth 626 project downward from the upper wall 622.

Figure 70:
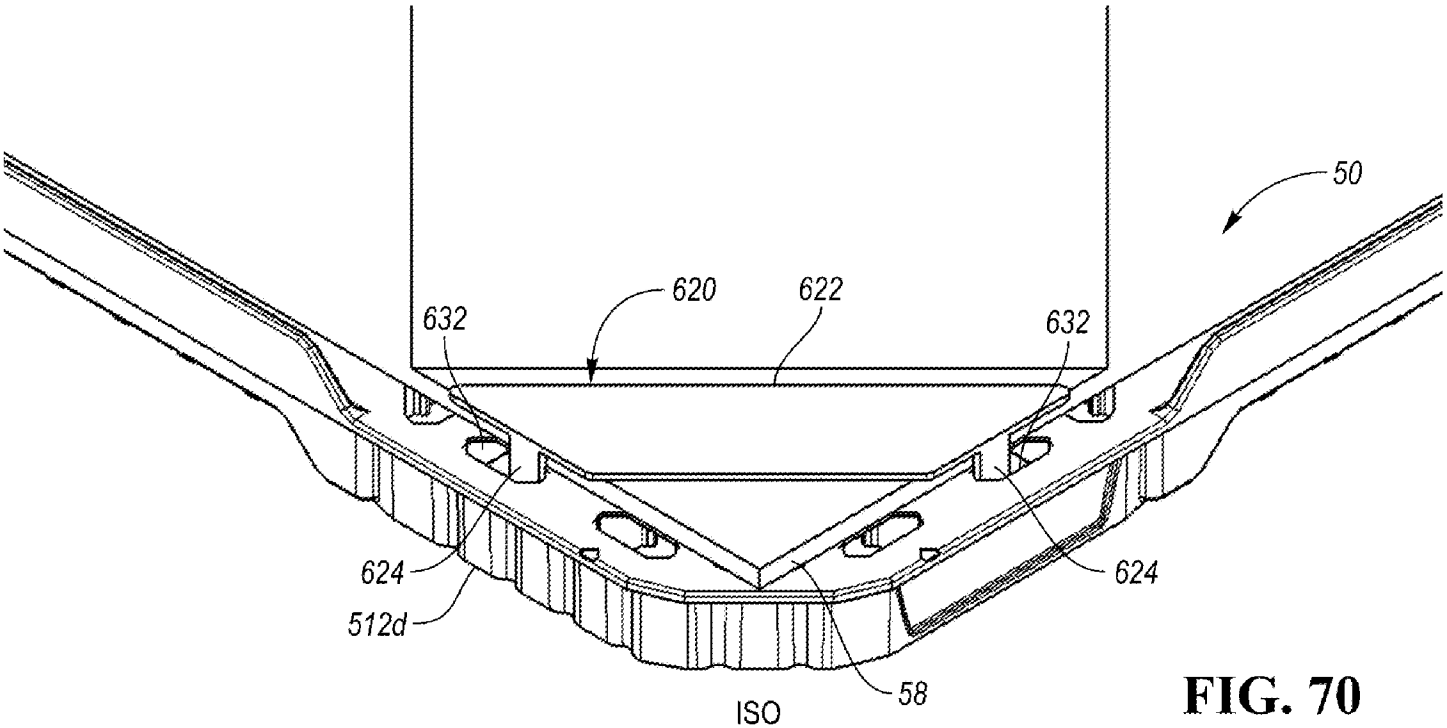
FIG. 70 shows the corner cap of FIG. 66 secured to a corner of a deck on top of one of the corner flaps of the box.

FIG. 70 shows the corner cap 620 secured to a corner of a deck 512*d* on top of one of the corner flaps 58 of the box 50. The snap-fit connectors 624 are snap-fit into apertures 632 in the deck 512*d*. The corner cap 620 sandwiches the corner flaps 58 to the corner column of the deck 512*d* to secure the box 50 to the pallet (not shown). Similar corner caps 620 are used to secure the other corner flaps 58 to the pallet deck 512*d*.

Figure 71:
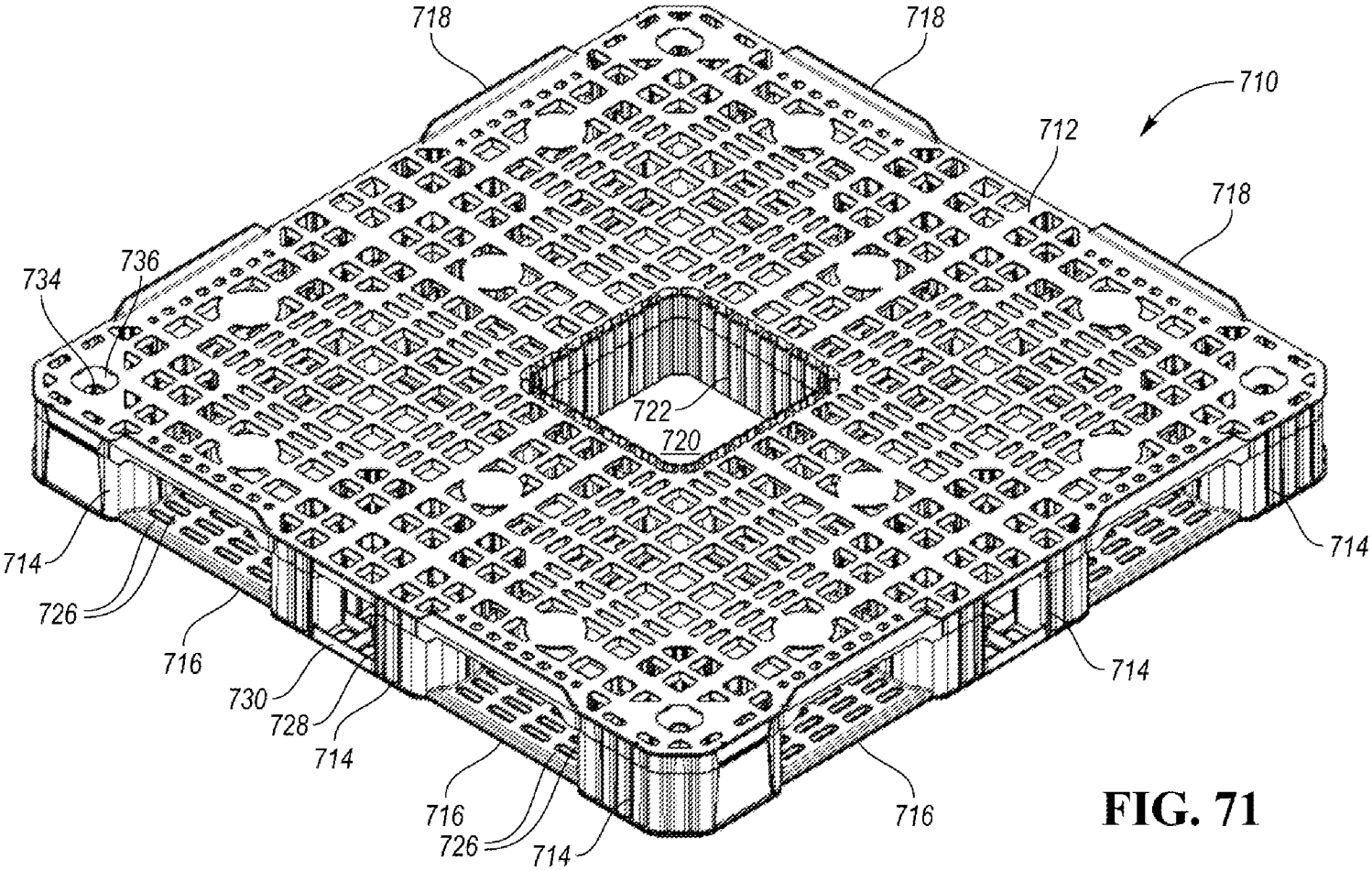
FIG. 71 is a perspective view of a pallet according to a seventh embodiment.

A pallet 710 according to a seventh embodiment is shown in FIG. 71. The pallet 710 includes a deck 712 having an upper surface for supporting goods thereon. The deck 712 is supported above a floor by a plurality of columns 714, which optionally may be connected to one another by runners 716. A peripheral lip 718 is formed at the periphery of the deck 712 and interrupted by the columns 714. The pallet 710 is preferably injection molded of a suitable plastic, but it can be thermoformed or rotomolded.

A large central opening 720 is formed through a center portion of the deck 712 and passes entirely through the pallet 710. The opening 720 is large, i.e. at least approximately one fifth (⅕) each of the width and length of the deck 712. The opening 720 should be less than half each of the width and length of the deck 712. More preferably the opening 720 should be approximately one quarter (¼) to approximately one third (⅓) each of the width and length of the deck 712, and even more preferably approximately one quarter (¼) each of the width and length of the deck 712. The opening 720 is approximately the same width as the non-corner outer columns 714 aligned therewith. In the example illustrated, the pallet 710 is approximately 48 inches by 48 inches and the opening 720 is approximately 12 inches by 12 inches. The opening does not have to be square, but could be elongated or rounded.

A peripheral wall 722 circumscribes the opening 720 to provide support to the center of the deck 712 as a central column. The peripheral wall 722 extends down to a plane containing the bottoms surfaces of the pallet 710 and transfers weight on the upper surface of the deck 712 to the floor.

The corners of the deck 712 each include connectors for securing the flaps of a box, such as apertures 734 with concave upper surfaces 736, which are identical to the apertures 534 and concave upper surfaces 536 of FIG. 49. However any of the previously described methods for securing the box could be used.

In this embodiment, teeth 726 are added to the tine openings between the columns 714, such as on the upper surfaces of the runners 716. Further, recesses 728 are formed through the outer walls of the non-corner outer columns 714. The recesses 728 are sized to receive a brace, as will be explained below. Ribs 730 protrude into the recesses 728. The ribs 730 extend in a direction extending from one adjacent column 714 to the other. The ribs 730 are preferably positioned proximate an outer edge of the runner 716.

Figure 72:
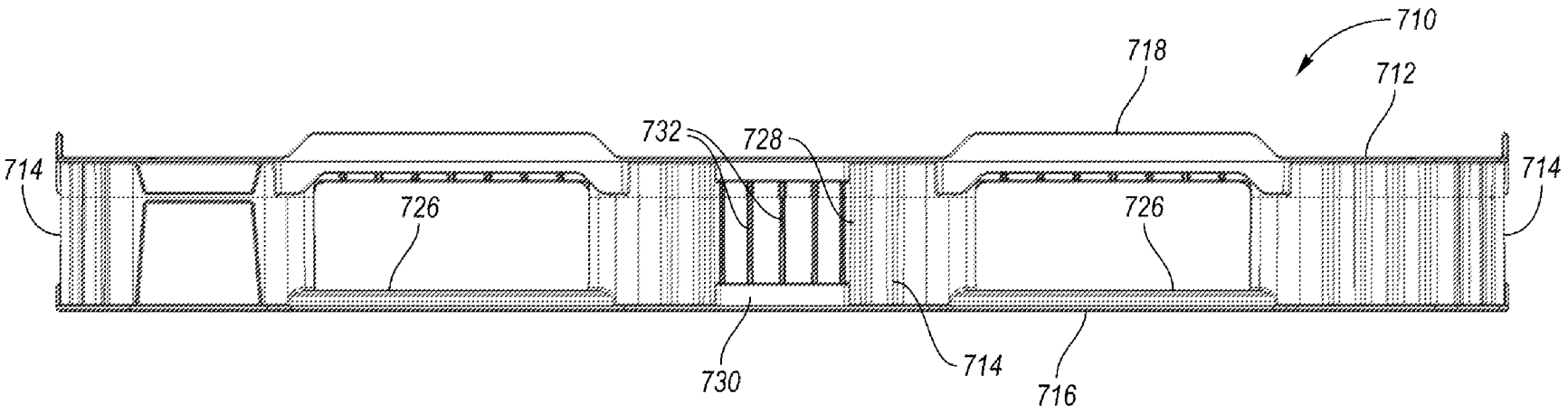
FIG. 72 is a side view of the pallet of FIG. 71.

FIG. 72 is a side view of the pallet 710. The recess 728 in the column 714 does not need to extend all the way through the column, but only needs to be deep enough to receive the brace. In FIG. 72, vertical ribs 732 of the column 714 are visible beyond the recess 728.

Figure 73:
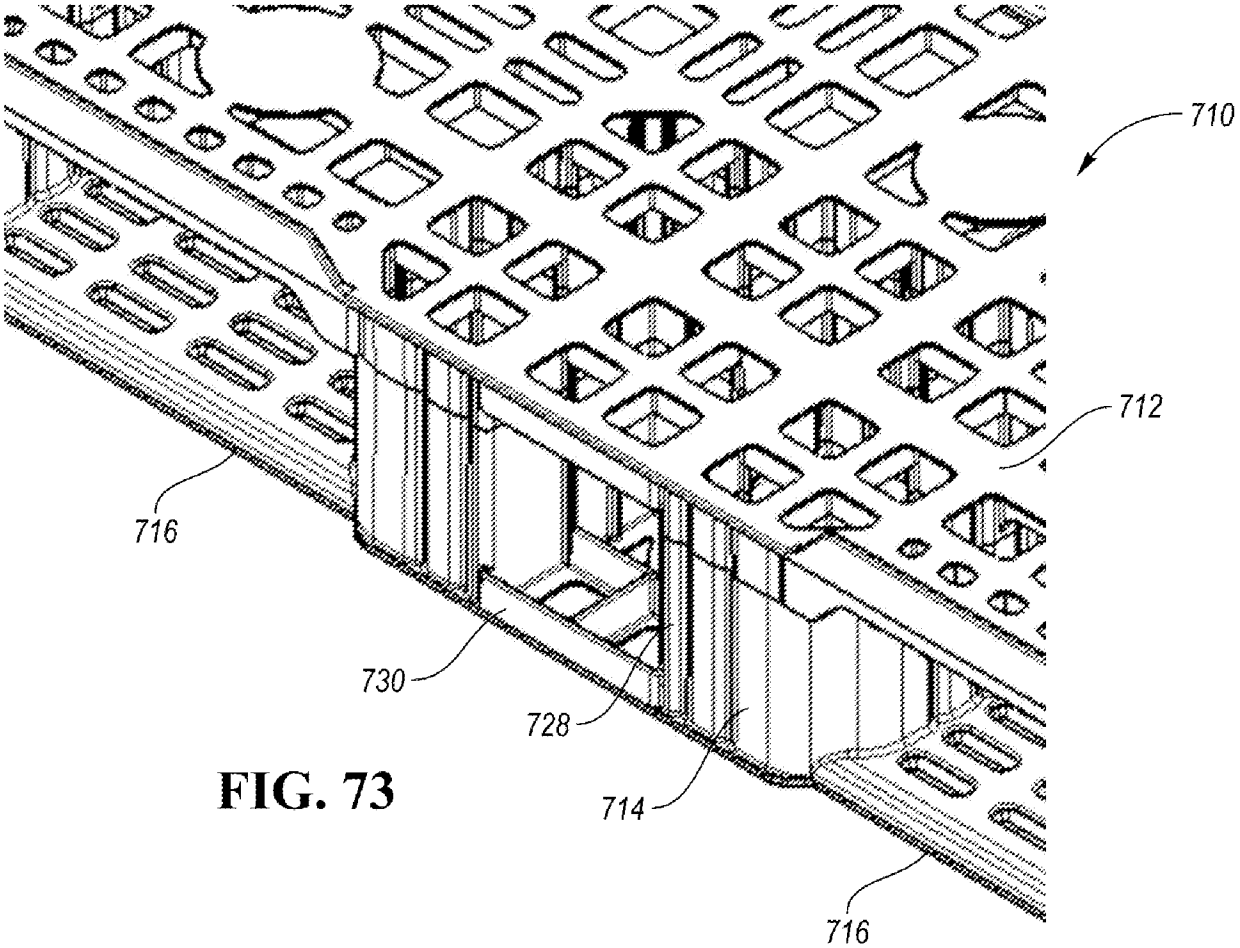
FIG. 73 is an enlarged view of a non-corner, outer column of the pallet of FIG. 71.

FIG. 73 is an enlarged perspective view of the recess 728 in the column 714. As shown, the rib 730 may extend along the outermost edge of the recess 728.

Figure 74:
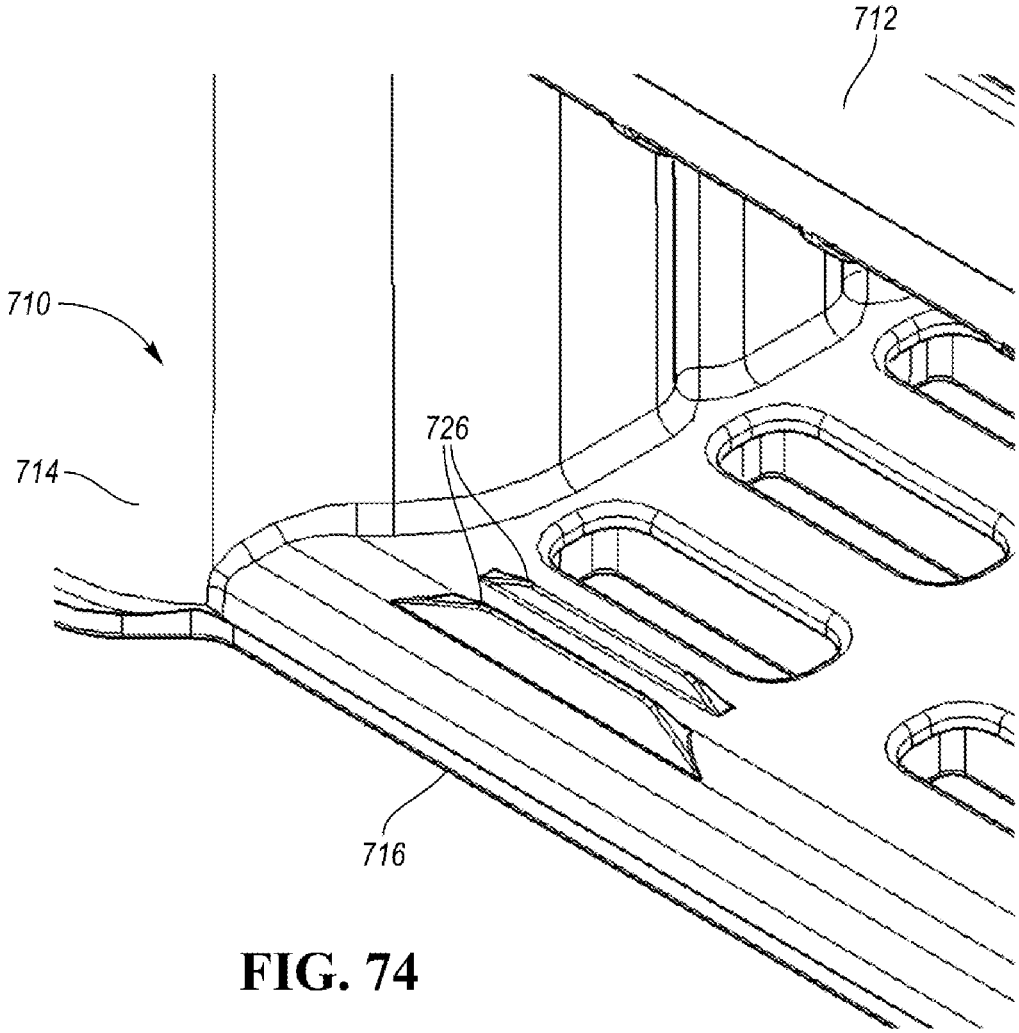
FIG. 74 is an enlarged view of a tine opening of the pallet of FIG. 71.

FIG. 74 is an enlarged perspective view of one of the tine openings. The teeth 726 protrude upward from the runner 716. The teeth 716 are elongated in a direction parallel to the runner 716.

Figure 75:
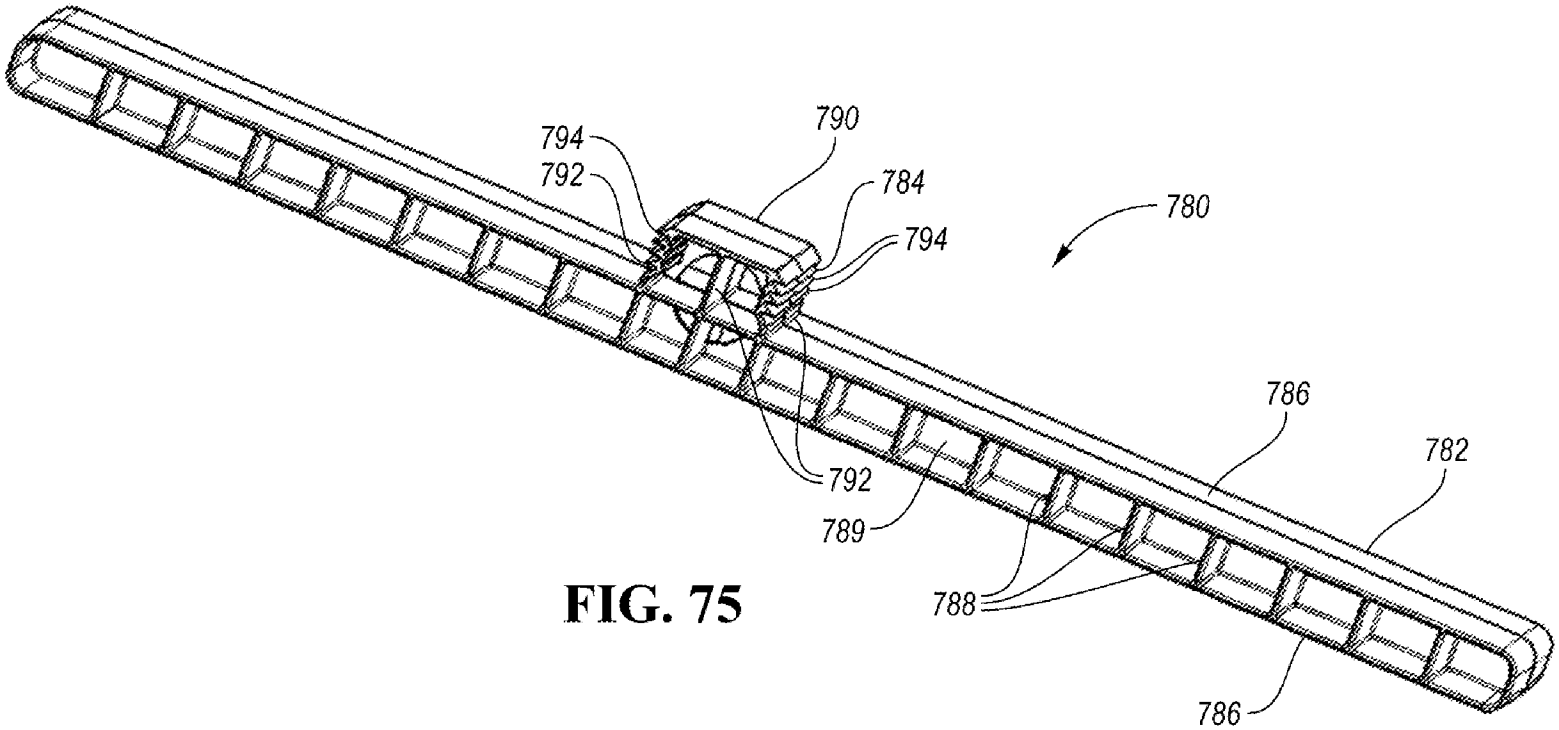
FIG. 75 is a perspective view of a brace according to a sixth embodiment.

FIG. 75 is a perspective view of a brace 780 according to a sixth embodiment. The brace 780 includes an elongated body portion 782 and a retainer portion 784 protruding generally transversely away from a mid-portion of the body portion 782. The retainer portion 784 extends transversely from the body portion 782. The body portion 782 includes outer walls 786 connected by a longitudinal mid-wall 789 and perpendicular ribs 788 that are perpendicular to the outer walls 786 and the mid-wall 789. The mid-wall 789 is approximately half-way between the front and rear edges of the outer walls 786.

The retainer portion 784 includes an outer wall 790 connected to the body portion 782 by a plurality of ribs 792 or walls. The retainer portion 784 is flexible or resiliently deformable. The outermost ribs 792 include a plurality of barbs 794, which may be angled downward toward the body portion 782.

Figure 76:
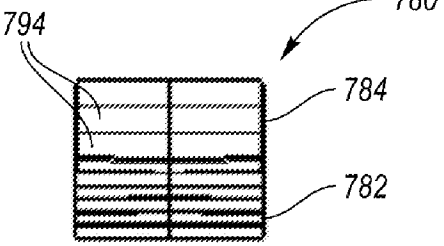
FIG. 76 is an end view of the brace of FIG. 75.
Figure 77:
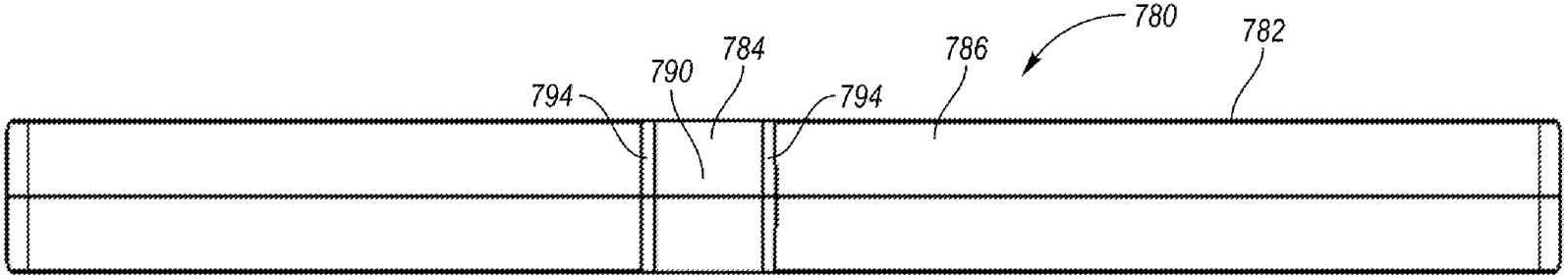
FIG. 77 is a top view of the brace of FIG. 75.
Figure 78:
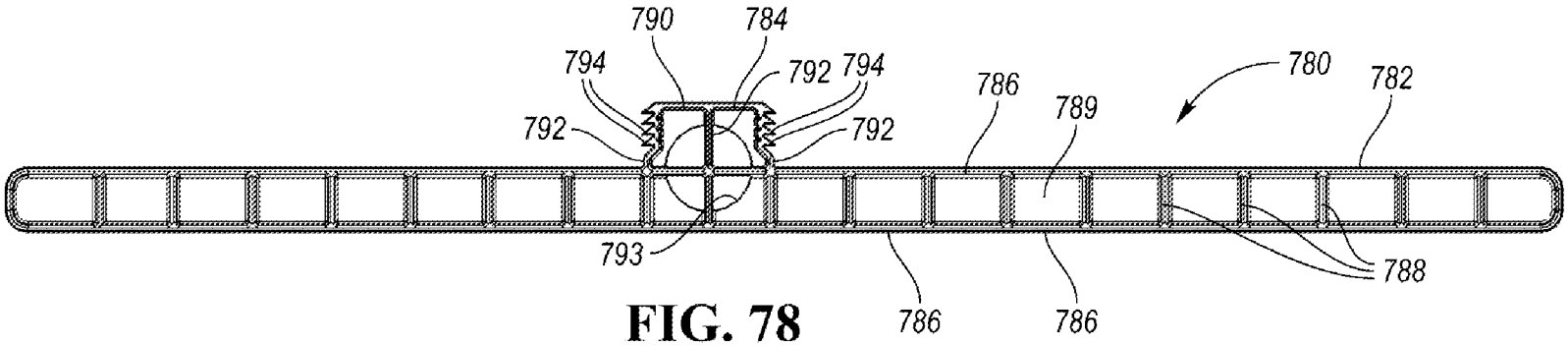
FIG. 78 is a side view of the brace of FIG. 75.

FIG. 76 is an end view of the brace 780. FIG. 77 is a top view of the brace 780. FIG. 78 is a side view of the brace 780, showing a circular opening 793 through the mid-wall 789. The opening 793 aids in injection-molding the brace 780.

Figure 79:
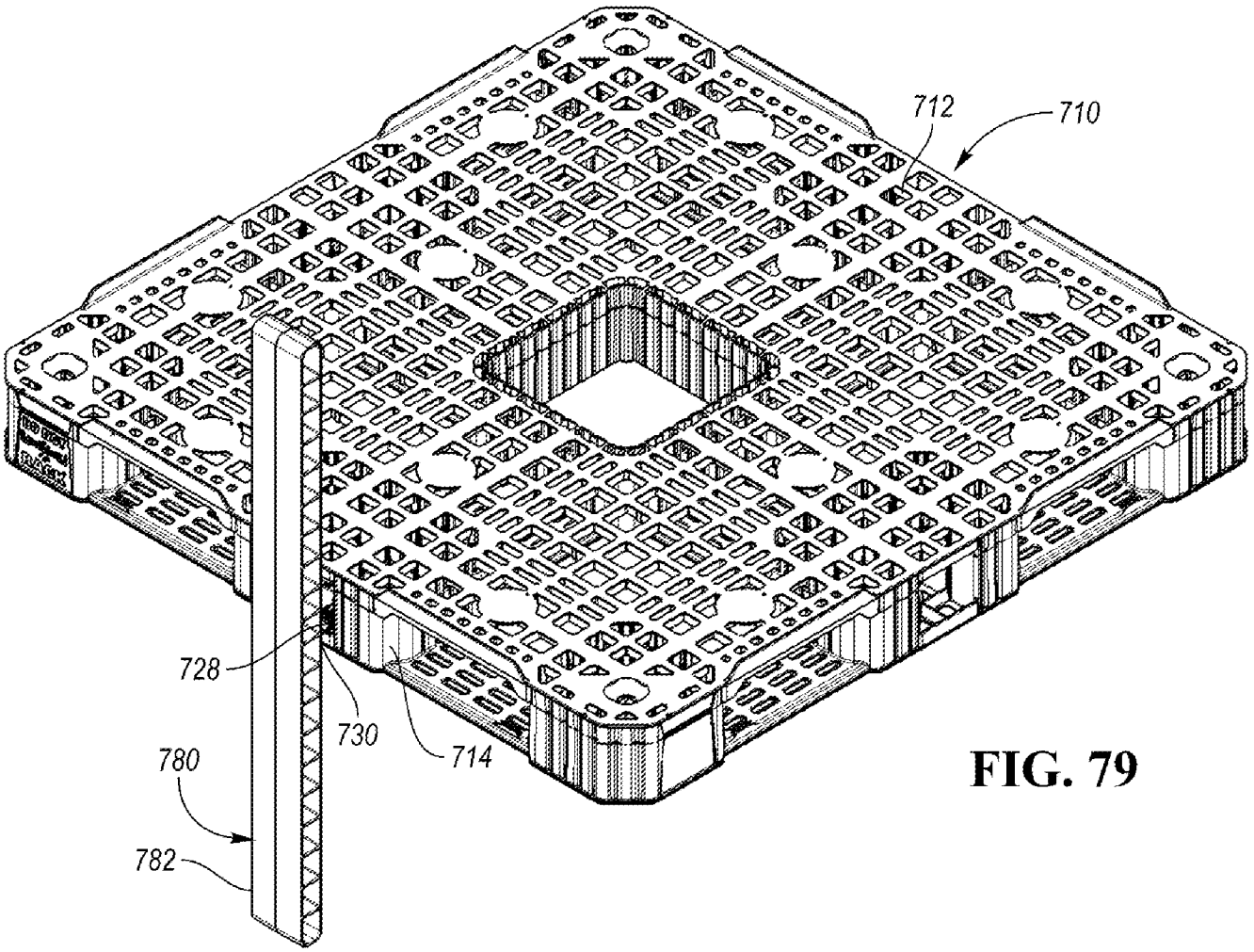
FIG. 79 shows the brace of FIG. 75 received in a non-corner, outer column of the pallet of FIG. 71.

FIG. 79 shows the brace 780 of FIG. 75 received in the recess 728 in one of the non-corner, outer columns 714 of the pallet 710 of FIG. 71. In this embodiment, all of the non-corner, outer columns 714 have identical recesses 728 and could receive a brace 780. Again, the brace 780 extends generally perpendicularly to the plane of the upper surface of the deck 712.

Figure 80:
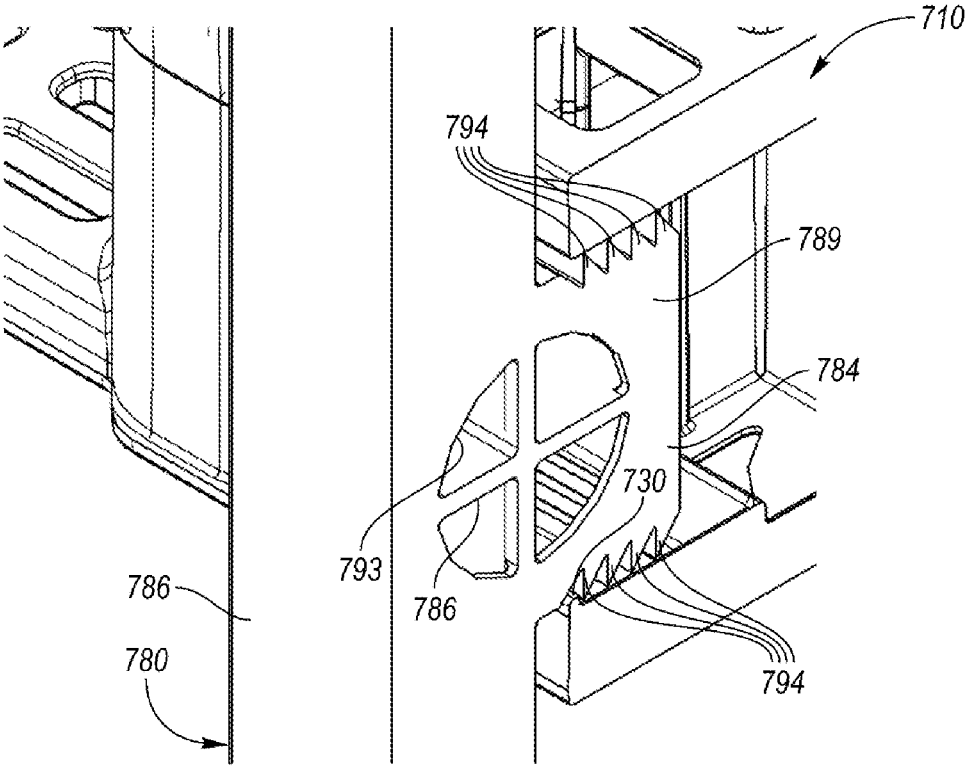
FIG. 80 is an enlarged view of the brace and pallet of FIG. 79, partially broken away.

FIG. 80 is an enlarged view of the brace 780 and pallet 710 of FIG. 79, partially broken away. The barbs 794 of the retainer portion 784 engage the rib 730 in the recess 728 of the column 714 to help retain the retainer portion 784. The ribs 794 on both sides of the retainer portion 784 are resiliently deformed when the retainer portion 784 is pressed into the recess 728 to further retainer the brace 780 in position.

Figure 81:
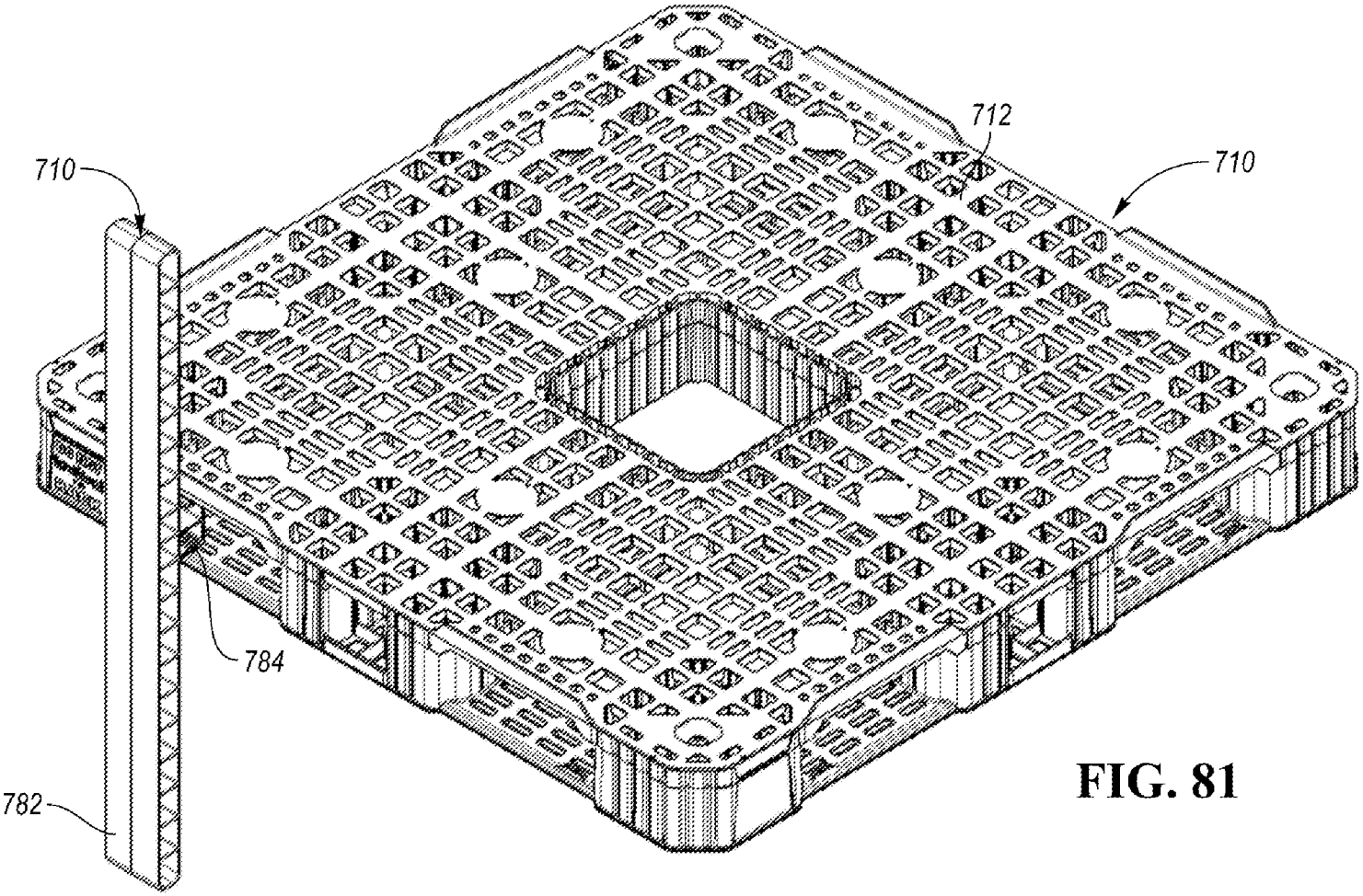
FIG. 81 shows the brace of FIG. 75 received in a tine opening of the pallet of FIG. 71.

FIG. 81 shows the brace 780 received in a tine opening of the pallet 710 of FIG. 71. Again, the brace 780 extends generally perpendicularly to the plane of the upper surface of the deck 712.

Figure 82:
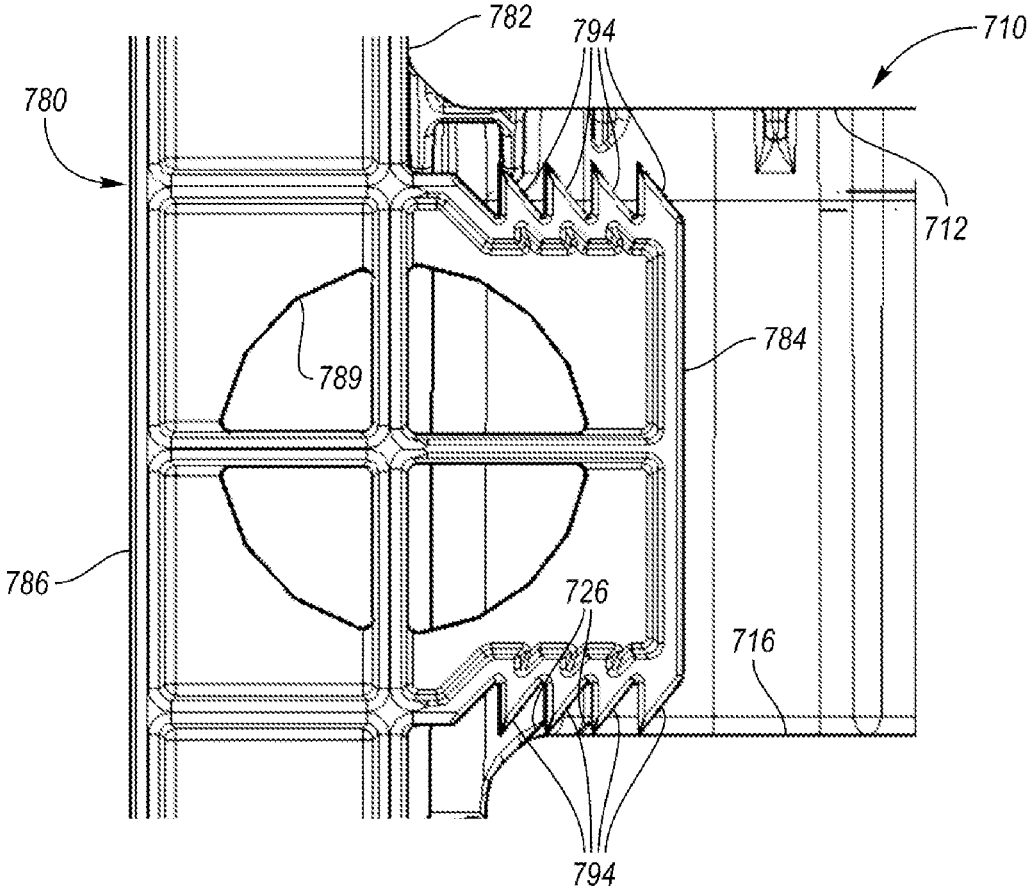
FIG. 82 is a section view of the brace and tine opening of FIG. 81.

FIG. 82 is a section view of the brace 780 and tine opening of FIG. 81. The ribs 794 on both sides of the retainer portion 784 are resiliently deformed when the retainer portion 784 is pressed into the tine opening to retainer the brace 780 in position. The barbs 794 engage the teeth 726 on the runner 716 to further retain the brace 780 in position.

With one or more braces 780 in any of the tine openings or recesses 728 in the center, outer columns 714, the braces 780 are used with the pallet 710 as shown in the previous embodiments to help retain the goods in place on the pallet 710.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck having an upper surface for supporting goods thereon, wherein the upper surface is formed by a plurality of intersecting plastic ribs, the deck having an opening therethrough, wherein the opening is at least approximately 1/5 a width and at least approximately 1/5 a length of the deck;

a peripheral wall extending downward from the upper surface and a periphery of the opening; and a plurality of columns supporting the deck, wherein the plurality of columns includes corner columns and non-corner outer columns, the plurality of columns defining fork tine openings on four sides of the pallet.

2. The pallet of claim 1 wherein the opening is approximately one fifth to approximately one half each of the width and length of the deck.

3. The pallet of claim 2 wherein the opening is approximately one quarter to approximately one third each of the width and length of the deck.

4. A pallet comprising:

a deck, the deck having an opening therethrough, wherein the opening is at least approximately 1/5 a width and at least approximately 1/5 a length of the deck;

fasteners removably securable to corners of the deck and each configured to secure a flap of a box to the deck; and a plurality of columns supporting the deck.

5. The pallet of claim 4 wherein the fasteners include corner caps configured to snap-fit to the deck and to sandwich flaps of the box to the deck.

6. The pallet of claim 5 wherein the corner caps include tabs configured to be connected to the columns.

7. The pallet of claim 5 wherein the fasteners include an upper wall and side extending downward from the upper wall, wherein the side walls are configured to connect to the deck of the pallet.

8. The pallet of claim 1 wherein the deck includes a peripheral lip at the periphery of the deck.

9. The pallet of claim 1 wherein the opening through the deck is approximately the same width as non-corner outer columns aligned therewith.

10. A pallet and box comprising:

a pallet having a deck, the deck having an opening therethrough, wherein the opening is at least approximately 1/5 a width and at least approximately 1/5 a length of the deck, the pallet further including a plurality of columns supporting the deck; and a box supported on the deck over the opening, wherein the box contains items that are smaller than the opening.

11. The pallet and box of claim 10 wherein portions of the box are secured to the deck of the pallet.

12. The pallet and box of claim 11 further including fasteners securing the portions of the box to the deck of the pallet.

13. The pallet and box of claim 12 wherein the portions of the box are flaps extending outward from the box on the deck.

14. The pallet and box of claim 13 wherein the fasteners include an upper wall and side extending downward from the upper wall, wherein the side walls are configured to connect to the deck of the pallet, and wherein the fasteners sandwich the flaps between the upper walls of the fasteners and the deck of the pallet.

15. A method for emptying items from a pallet including the steps of:

a) providing a box of items on a pallet, the pallet having a deck supported by columns and an opening through the deck; and b) cutting a wall extending across the opening through the deck and permitting the items in the box to fall through the opening through the deck.

16. The method of claim 15 wherein the wall is a bottom wall of the box.

17. A pallet system comprising:

a pallet including a deck supported by a plurality of columns; and at least one brace having an elongated body portion selectively secured to the pallet, such that the elongated body portion of the at least one brace is generally perpendicular to a plane of a support surface of the deck of the pallet and such that the elongated body portion of the at least one brace extends upward above the plane of a support surface of the deck of the pallet to a self-supporting upper free end of the elongated body portion the at least one brace further including a retainer portion projecting transversely from a point on the elongated body portion away from the upper free end to a retainer free end, wherein the retainer is configured to be retained in an opening formed in the pallet below the deck—has been inserted after "portion".

18. The pallet system of claim 17 wherein the elongated body portion extends downward below a plane containing lowermost surfaces of the deck to a lower free end of the elongated body portion.

19. A pallet system comprising:

a first pallet including a deck supported by a plurality of columns;

a second pallet loaded with goods, wherein the first pallet is stacked on the goods on the second pallet; and at least one brace having an elongated body portion selectively secured to the first pallet, such that the elongated body portion of the at least one brace is generally perpendicular to a plane of a support surface of the deck of the first pallet and such that the elongated body portion of the at least one brace extends upward above the plane of a support surface of the deck of the first pallet, the elongated body portion of the at least one brace abutting the goods on the second pallet.

20. The pallet system of claim 19 further including a third pallet loaded with goods adjacent the second pallet, wherein the goods on the third pallet abut the elongated body portion of the at least one brace.

21. The pallet system of claim 19 further including goods on the first pallet, wherein the elongated body portion abuts the good on the first pallet.

22. A pallet comprising:

a deck; and a plurality of columns supporting the deck, the plurality of columns including corner columns and non-corner outer columns, wherein tine openings are defined between each corner column and an adjacent non-corner outer column, at least one opening in at least one of the non-corner columns below the deck, each of the at least one openings configured to receive a retainer portion of a brace.

23. The pallet of claim 22 wherein the opening includes at least one rib or barb for retaining the retainer portion of the brace.

24. A brace for use with a pallet, the brace comprising:

an elongated body portion including outer walls connected to one another by ribs; and a retainer portion protruding generally transversely from the body portion, the retainer portion including barbs configured to secure the retainer portion in an opening.

25. The pallet of claim 4 wherein the fasteners include corner caps configured to snap-fit to the deck or a plurality of tapered stems each extending downward from an enlarged head to a relatively sharp end or retainers hingeably connected to the deck and including protrusion configured to snap-fit to the deck.

* * * * *